US012180960B2

(12) United States Patent
Sereda-Mohr

(10) Patent No.: US 12,180,960 B2
(45) Date of Patent: Dec. 31, 2024

(54) ROTARY POSITIVE DISPLACEMENT DEVICE

(71) Applicant: Spherical Rotors Inc., Calgary (CA)

(72) Inventor: Michael Justin Sereda-Mohr, Calgary (CA)

(73) Assignee: Spherical Rotors Inc., Calgary (CA)

( * ) Notice: Subject to any disclaimer, the term of this patent is extended or adjusted under 35 U.S.C. 154(b) by 0 days.

(21) Appl. No.: 18/478,563

(22) Filed: Sep. 29, 2023

(65) Prior Publication Data

US 2024/0384720 A1 Nov. 21, 2024

Related U.S. Application Data

(60) Provisional application No. 63/502,302, filed on May 15, 2023.

(51) Int. Cl.
*F04C 18/56* (2006.01)
*F01C 3/08* (2006.01)
(Continued)

(52) U.S. Cl.
CPC ..... *F04C 18/56* (2013.01); *F01C 3/08* (2013.01); *F04C 2/126* (2013.01); *F04C 3/08* (2013.01)

(58) Field of Classification Search
CPC ..... F04C 18/54–565; F04C 3/06–085; F04C 18/084; F04C 18/086; F04C 18/12–20;
(Continued)

(56) References Cited

U.S. PATENT DOCUMENTS 4,691,635 A 9/1987 Winterhalter
4,793,771 A 12/1988 Laing
(Continued)

FOREIGN PATENT DOCUMENTS

CA 2781051 12/2013
EP 1984602 10/2008
(Continued)

OTHER PUBLICATIONS

International Search Report and Written Opinion of the International Searching Authority Patent Application No. PCT/CA2024/050652 mailed Aug. 13, 2024, Canadian Intellectual Property Office.

*Primary Examiner* — Laert Dounis
(74) *Attorney, Agent, or Firm* — Spencer Fane LLP; Michael Bondi

(57) ABSTRACT

A rotary positive displacement device comprises a housing having low and high pressure ports; first and second rotors each having a frusto-spherical outer surface, an axial surface, a shaft and a rotational axis. The axial surfaces comprise a teardrop surface and an involute surface together defining a lobe and a corresponding valley. High and low pressure openings each extend between the first and second rotors and the corresponding high and low pressure ports. The first and second rotors intermesh so that the at least two chambers are separated by the axial surfaces of the first and second rotors, each chamber having a variable volume as the first and second rotors rotate about their respective rotational axes. A lower edge of the high pressure opening is positioned along an outer diameter of the outer surface of the second rotor and between the second rotor shaft and the first rotor valley.

23 Claims, 33 Drawing Sheets

(51) Int. Cl.
*F04C 2/12* (2006.01)
*F04C 3/08* (2006.01)

(58) Field of Classification Search
CPC ..... F04C 2/084; F04C 2/086; F04C 2/12–20; F01C 3/06–085; F01C 1/084; F01C 1/086; F01C 1/12–20
See application file for complete search history.

(56) References Cited

U.S. PATENT DOCUMENTS 4,815,432 A 3/1989 Sutton
4,877,379 A 10/1989 Okabe
4,942,816 A 7/1990 Bankel
4,995,317 A 2/1991 Bankel
5,066,207 A 11/1991 Valavaara
5,147,183 A 9/1992 Gettel
5,329,771 A 7/1994 Kytomaki
5,357,923 A 10/1994 Osterburg
5,372,107 A 12/1994 Smythe
5,427,350 A 6/1995 Rinkewich
5,449,235 A 9/1995 Buckmann
5,520,147 A 5/1996 Secord
5,674,053 A 6/1997 Paul
5,755,196 A * 5/1998 Klassen ..... F01C 3/06 123/204
5,839,399 A 11/1998 Luce
6,164,942 A 12/2000 Moller
6,739,852 B1 * 5/2004 Klassen ..... F01C 3/085 418/195
8,562,318 B1 10/2013 Gottfried
10,967,702 B2 4/2021 Mancini
11,242,726 B2 2/2022 Toews
2001/0031215 A1 10/2001 Klassen
2001/0043876 A1 11/2001 Mekler
2003/0209221 A1 11/2003 Klassen
2003/0231971 A1 12/2003 Klassen
2004/0250617 A1 12/2004 Klassen
2005/0276714 A1 12/2005 Klassen
2006/0260499 A1 11/2006 Westphal
2007/0051266 A1 3/2007 Zinell
2008/0141974 A1 6/2008 Bechtel
2009/0078231 A1 3/2009 Klassen
2011/0062711 A1 3/2011 Kang
2011/0065518 A1 3/2011 Patterson
2011/0106322 A1 5/2011 Ou
2011/0271676 A1 11/2011 Walpita
2011/0306011 A1 12/2011 Magneson
2011/0311351 A1 12/2011 Patterson et al.
2012/0001436 A1 1/2012 Sami
2012/0269669 A1 * 10/2012 Patterson ..... F01C 1/084 418/195
2012/0285282 A1 11/2012 Patterson
2013/0011286 A1 1/2013 Didin
2013/0071280 A1 3/2013 Klassen
2013/0080138 A1 3/2013 Bozchalui
2013/0160450 A1 6/2013 Cogswell
2013/0200634 A1 8/2013 Patterson
2014/0216000 A1 8/2014 Juan
2014/0271301 A1 * 9/2014 Juan ..... F04C 3/08 418/49
2015/0010413 A1 1/2015 Marsh
2015/0159516 A1 6/2015 Spadacini
2015/0260184 A1 9/2015 Farrell
2015/0361794 A1 * 12/2015 Patterson ..... F01D 1/32 418/191
2016/0179116 A1 6/2016 Bacque
2016/0329711 A1 11/2016 Majumder
2017/0040800 A1 2/2017 Majumder
2017/0117713 A1 4/2017 Majumder
2017/0130583 A1 5/2017 Juan
2017/0169140 A1 6/2017 Chen
2017/0204727 A1 7/2017 Lindsey
2017/0211460 A1 7/2017 Suzuki
2018/0045052 A1 * 2/2018 Fenton ..... F04C 18/48
2018/0090936 A1 3/2018 Guo
2018/0187549 A1 7/2018 Shu
2018/0283177 A1 10/2018 Bini
2019/0013675 A9 1/2019 Castor
2019/0044342 A1 2/2019 Pande
2019/0181643 A1 6/2019 Chae
2019/0271317 A1 * 9/2019 Juan ..... F04C 18/56
2020/0195011 A1 6/2020 De Callafon
2020/0235578 A1 7/2020 Majumder
2020/0291935 A1 9/2020 Gottfried
2021/0119452 A1 4/2021 Weaver
2022/0029425 A1 1/2022 Ough
2022/0052578 A1 2/2022 Cross
2022/0060018 A1 2/2022 Jung
2022/0112809 A1 4/2022 Gaia
2022/0368131 A1 11/2022 Zhou
2022/0393467 A1 12/2022 Zhou

FOREIGN PATENT DOCUMENTS

WO WO-1990014503 11/1990
WO WO-9961753 A1 * 12/1999 ..... F01C 1/063
WO 2010031173 A1 3/2010
WO WO-2011146388 11/2011
WO WO-2012062007 5/2012
WO WO-2012089837 7/2012
WO WO-2014017943 1/2014
WO WO-2015028708 3/2015
WO WO-2016139574 9/2016
WO WO-2018074651 4/2018
WO 2019113704 A1 6/2019
WO WO-2020057423 3/2020
WO WO-2021208613 10/2021

* cited by examiner

ROTARY POSITIVE DISPLACEMENT DEVICE

CROSS REFERENCE TO RELATED APPLICATIONS

This application claims the benefit of U.S. Provisional Application No. 63/502,302 filed on May 15, 2023 and entitled "Rotary Positive Displacement Device", which is incorporated herein by reference.

TECHNICAL FIELD

This disclosure relates to positive displacement machines that convert energy; for example, positive displacement expanders comprising rotors that rotate in a single rotational direction to release a working fluid contained in operating chambers of the rotors. In another example, the rotors of the rotary positive displacement device may be rotationally reversible, acting as a compressor.

BACKGROUND

References herein to patent documents or other matter is not to be taken as a statement that the document or matter was known or that the information it contains was part of the common general knowledge as at the priority date of any of the claims.

Mechanical machines are devices that convert energy to achieve a desired objective. Energy is the ability to produce or create work, while work is the process in which the energy transfer takes place, for example, a force applied to an object makes it move in the direction of the force. An engine or electric motor connected to a compressor or pump may boost the energy of a fluid, for example, so that the fluid may travel down a pipeline. A fluid is comprised of a mixture of gases and/or liquids.

Potential and kinetic energy of a fluid may be reduced in order to provide useful work via an expander or liquid motor. In one example, an electric motor is used to drive a screw compressor, which continually fills a vessel with compressed air at a comparably elevated pressure. Those knowledgeable in the art understand that the air could be subsequently released to reversibly operate the screw compressor as a screw expander. This simple form of Compressed Air Energy Storage (CAES) could allow a facility owner to purchase comparably low cost electricity to drive the screw compressor when there is a surplus on the electrical grid and later release the high pressure air to produce higher price electricity when the price is high. Energy storage strategies help encourage wide-spread adoption of intermittent renewable power generation. Similarly, an electric motor may be used to pump liquid to a higher elevation. Some pumps may be reversibly operated as a "liquid motor" with the reversibly operated electric motor producing electricity as an electrical generator.

Two generic principles for gas compression involve the use of positive displacement devices or dynamic compression devices. Dynamic compression is accomplished from rotating blades on an impeller accelerating gas to a high velocity which is subsequently transformed into static pressure in a diffuser where it is decelerated. Dynamic expansion occurs in "turbines" where gas expands across blades to rotate blades at high velocity and low drag to produce useful work. Compression and expansion equipment can be incorporated on the same shaft, for example in a gas turbine. For example, a jet engine uses dynamic compression to pull in air, subsequent internal combustion of a fuel-air mixture and finally useful work is produced through a turbine to drive the compressor on the same shaft. Remaining kinetic energy in the exhaust produces forward thrust. Another example of dynamic compression is integrally geared centrifugal compressors. This 'open flow' type of compression/expansion can be well suited to applications that have high and near constant volumetric throughput with a relatively low and near constant compression/expansion ratio with only small variations in gas composition expected and little to no expected liquid formation in gas applications. A large number of blades and stages can be used with equipment in the 10 s or even 100 s of MW.

The applicants of U.S. patent Ser. No. 11/242,726 explain that "To use a single turbine and have adequate efficiency over an entire range of ambient conditions is problematic. It has been found that use of two or more turbines in series or parallel which are optimized for different ambient conditions addresses the problem."

Dynamic compression devices can face additional challenges including "surge" where a reduction in volumetric throughput can lead to flow reversal. Very generally speaking, it is the applicant's understanding that dynamic compression/expansion equipment may be more complicated and therefore may be more expensive to build than positive displacement devices in many applications below 1-5 MW. There are exceptions such as centrifugal pumps and axial fans, both of which may be relatively simple devices that work well in applications with high volumetric throughput and low compression ratios. In applications in the range of approximately 10 to 90 MW or approximately 100 to 900 MW, it is the applicant's understanding that dynamic compression/expansion devices may often be scalable and therefore see a reduction in cost per MW. At this power range, positive displacement compression/expansion devices would typically require duplication of equipment.

Positive displacement compression/expansion devices allow a fluid to enter a chamber, then seal the chamber from the upstream/downstream piping, before allowing the chamber to be in fluid communication with the downstream piping. Accordingly, the upstream and downstream pressure can vary significantly across a single stage and relatively high pressure rated designs are available. Devices such as reciprocating piston-cylinder devices require valves and packing glands, both of which can be major sources of internal and external leakage, respectively. Leakage past packing glands is a major source of greenhouse gas emissions in the natural gas compression industry. Valves are designed to open/close at a specific operating pressure and as the actual operating pressure or gas composition changes, inefficiency and eventual failure may occur. The portion of volume in the chamber that cannot be evacuated is often referred to as the "clearance volume" and the relatively high pressure gas that is inefficiently recirculated is often referred to as the "recirculated volume". The piston in reciprocating piston-cylinder devices does not come into contact with the ends of the cylinder. This characteristic and the geometry at the valves both introduce a significant clearance volume. In other words, the final compression "stroke" of the piston cannot evacuate all of the high pressure gas remaining in the cylindrical chamber before it is subsequently mixed with the lower pressure intake gas. A large clearance volume can dominate the recirculated volume, but internal leakage from higher pressure to lower pressure, for example at the gap between the piston and cylinder, may also contribute. Application engineers have hundreds of combinations of frame, cylinder and valve configurations to choose from for a given application.

For example, much of the natural gas pipeline network in Alberta and in North America ranges from 1000-1440 psig in pressure, with some upstream pipeline pressures being at a much lower pressure. Although natural gas production wells can initially start above pipeline pressure, and therefore a compressor isn't required initially, as the natural gas is released from the reservoir, the pressure at the surface typically eventually approaches near atmospheric pressure. When the pressure upstream of the compressor decreases, typically a producer must decide between installing new, larger, cylinders (i.e. with new valves) and/or investing in upstream compression to keep the current reciprocating compressor utilized well. Most natural gas compressors in service are driven by reciprocating natural gas engines which have very limited turn-down capabilities to efficiently adjust to the lower expected power requirement of the compressor. Some producers opt for inefficient bypass methods where recompression is required to keep the engine loaded up. In other cases, a significant investment is made towards (upstream) booster compression, with the intention of keeping the existing compression closer to the original design conditions, including volumetric throughput.

Rotary positive displacement devices such as screw compressors are also common since their widespread adoption approximately 50 years ago. Since the chamber itself moves past stationary porting, no valves are required, substantially increasing reliability. Some screw compressors may better accommodate varying pressure ratios by slowly adjusting the position of "slide gates". The simple rotary motion of the screw rotors alleviates a lot of vibration concerns that reciprocating compressors may have associated with continuously accelerating and decelerating mass. Oil-flooded screw compressors/expanders allow higher pressure lubricating oil to bleed into the gas, allowing these devices to be zero-emissions in operation. Liquids have a much higher heat capacity than gases. This fluid mixture makes much higher compression/expansion ratios possible in a single stage compared to a reciprocating compressor/expander. Reciprocating equipment typically requires 2-3 stages of compression in many natural gas compression applications, with inter-cooling after each stage to manage the temperature increase of the gas. Oil-flooded screw compressors have been proven to reliably operate in applications with meaningful volumetric throughput that have upstream and/or downstream pressures ranging from 0 to 350 psig. Some of these combinations would produce excessively high gas temperatures in a single stage of compression if lubricating oil were not used to manage the heat of compression. Since the screw rotor shafts can only be supported by bearings at the ends of the shafts, excessive chamber pressure causes the shafts to bend which eventually causes contact between the rotors and housing and/or excessive internal leakages. Recirculated gas volumes introduced by the slide gates and high pressure axial port can also substantially reduce efficiency. This efficiency is particularly reduced when lubricating oil is not used to help seal, which is often the case in closed-loop cycles such as the Organic Rankine Cycle (ORC), which uses a refrigerant as the working fluid.

The ORC uses a heat exchanger to allow a source of geothermal or waste heat to fully boil the working fluid. The refrigerant remains in a vapor state both before and after expansion as it produces useful work, making both turbines or screw expanders examples of appropriate equipment. It is the applicant's belief that when above 1 MW of power may be generated, the higher efficiency and lower cost option is generally turbines, while below 1 MW, screw expanders may be more attractive, largely due to their low upfront costs. After the expander, heat is rejected to the environment to fully condense the refrigerant into a liquid so that it can be subsequently pumped up to high pressure to be boiled again. It will be appreciated that more power is thermodynamically available to be harnessed when there is a larger temperature differential between the heat source and heat sink (i.e. environment). A useful first calculation to perform is the Carnot efficiency equation using the temperatures in Kelvin:

$$\eta = 1 - \frac{T_{cold}}{T_{hot}}$$

This known equation represents the maximum efficiency, "η", that a hypothetical heat engine may have in operation between the relatively higher temperature heat source, "$T_{hot}$", and the lower temperature heat sink, "$T_{cold}$". In reality, the practically attainable efficiency will be noticeably lower, but this equation may be a good starting point to demonstrate the potential approximate relative benefit of attempting to track the variance in ambient temperature (i.e. "$T_{cold}$") versus employing the industry standard of designing the system to run like it is always a hot summer day.

If a high grade waste heat source (i.e. >650° C.) is available, then rejecting heat at −40° C. instead of 30° C. would increase the Carnot efficiency from 67.2% to 74.7%. Since most of the waste heat sources are low-grade (i.e. <200-277° C.), with many geothermal brine type applications in Alberta, Canada reaching no more than 110° C. at the surface heat exchanger, 110° C. will be used as a second example. In this 110° C. source temperature case, the Carnot efficiency can be increased from 20.9% to 39.1% on a cold winter day. If ambient conditions range from −40° C. to 30° C. and heat exchangers are designed with a 10° C. temperature differential, for example, then the refrigerant would vary from −30° C. to 100° C. in the winter and 40° C. to 100° C. in the summer. The respective Carnot efficiencies would be calculated as 16.1% to 34.8%. Losses in the process and mechanical equipment need to be taken into account for more accuracy, but the difference in Carnot efficiency implies that somewhere in the ballpark of 2*x* more power could be generated on a cold winter day versus a warm summer day if efficient mechanical equipment existed in the prior art to handle the application range. At lower source temperatures, a larger variance in seasonal power generation could be expected.

Additional power may be generated with a larger temperature differential by using a larger pressure ratio in the power generation cycle. Turbines require additional rows of blades since each row of blades can only withstand a limited pressure differential. Some speculate that the efficiency would still be adequate if two turbines are used, since the turbines could be fed in series or parallel depending on the season, but even the theoretical performance seems to be unclear.

Screw expanders are believed to be the dominant choice for ORC applications below 1 MW. It is believed that the lower upfront cost of dry screw expanders is a significant selling feature, despite the efficiency being lower than for turbines, at least when comparing performance in a near constant operational range. In one example, a dry screw expander may be around 60-65% (isentropic) efficiency with a turbine being around 85% efficient in the same near constant operation range. Dry screw expander stages are operated in series or parallel. Sometimes just a single stage is required, which is typical in oil-flooded screw compressors/expanders.

In some applications, oil-flooding can improve efficiency by about 10%. However, dry screws seem to be preferred for ORC applications under 1 MW, perhaps partly due to the simplicity and upfront cost savings. Screws with a fixed pressure ratio can offer a relatively high efficiency when operating conditions match the design conditions. However, this lack of adjustability is often not very practical and efficiency penalties result when the chamber becomes in fluid-communication with gas in the adjacent piping either too early or too late. The introduction of slide gates adds sufficient flexibility for many applications. However, the recirculated gas volume that is introduced is a significant source of inefficiency. In any configuration, the screw rotor profile requires an axial port which also contributes to recirculated gas volume. Recirculated gas volume introduces large inefficiency at high pressure-ratios. This inefficiency can be inadequate when attempting to apply a screw expander in the Trilateral Flash Cycle (TFC) or Partial Evaporating Cycle (PEC), which require a relatively smaller chamber volume to be initially sealed in comparison to the Organic Rankine Cycle (ORC). In the ORC, the refrigerant is completely boiled, while in the TFC, none of the refrigerant is boiled; it is still 100% (saturated) liquid phase when expansion begins. The PEC is somewhere between ORC and TFC, with the refrigerant being partially liquid phase and partially vapor phase when expansion begins.

It should be noted that turbines are used in vapor applications where less than 10% by mass of liquids are expected, since these high velocity liquids impinging on the blades cause damage. Turbines are designed for a particular gas or combination of gases, and the efficiency can drop significantly if the gas composition changes. The Kalina Cycle makes use of a mixture of ammonium vapor and water vapor, which have substantially the same molecular weight. Therefore, turbines can maintain their efficiency with varying proportions of ammonium vapor and water vapor; this composition is varied to lower the boiling point and therefore more closely match the ambient temperature when condensing the refrigerant mixture. It is believed that equipment is selected accordingly to match conditions for a warm summer day, with little to no adjustments made for seasonal temperature variations. When compared to the Rankine Cycle, which is linked to the boiling point of pure water, the Kalina Cycle is understood to enable a higher temperature differential by condensing at a lower temperature. As suggested by the examples above, a higher Carnot efficiency is expected. It is believed that the additional complexity, but also high source temperature compatibility of the Kalina Cycle makes the cycle most competitive at high grade (i.e. >650° C.) waste heat sources where the Rankine Cycle would commonly be used. It should also be noted that rotary screw expanders are far less sensitive to gas composition, so they could work well with a variety of gas compositions.

Several power generation cycles have been proposed in the public domain. An exergoeconomic comparison can be done to weigh both thermodynamic and economic viewpoints. Some have speculated that the Trilateral Flash Cycle (TFC) could be the lowest cost per unit of power produced at source temperatures below 120° C. if there were a commercially available expander capable of achieving an 85% isentropic efficiency in the TFC. An example of an exergoeconomic comparison is provided in [https://ideas.repec.org/a/eee/energy/v83y2015icp712-722.html, Accessed on 5 May 2023], titled "Exergoeconomic comparison of TLC (Trilateral Rankine cycle), ORC (organic Rankine cycle) and Kalina cycle using a low grade heat source".

The authors of [https://www.sciencedirect.com/science/article/pii/S187661021931224X entitled "Trilateral Flash Cycle (TFC): A Promising Thermodynamic Cycle for Low Grade Heat to Power Generation", Accessed on 5 May 2023] concluded that "TFC has about at least 50% more power generation potential than that of conventional ORC for the same heat source and heat sink conditions if the heat source temperature is just below 100° C. TFC even has the potential of power generation from the heat source below 80° C. where ORC is not economically viable." It was also said that the "TFC system can utilize up to 70% of available thermal energy where ORC can only deal with 20%." Also, "It is obvious that TFC system requires larger heat exchanger and condenser as it deals with larger amount of heat than that of ORC, however, it also requires more pumping power which basically reflects more initial investment which can be compensated by producing additional power." Additionally, "TFC system can facilitate to cool down the system leaving hot water temperature close to ambient temperature and reduces overall wastage of energy."

The ORC may be superior in situations where the heat source will be condensed from a vapor to a liquid because this provides the ORC refrigerant with a lot of heat energy at a comparatively high temperature to fully boil the refrigerant. Since so much heat energy is required to boil the refrigerant in the ORC, this is why the utilization of energy becomes so low at source temperatures below 90° C. where no phase change of the heat source is expected. In many locations in the world, temperatures of 90-120° C. can be obtained by drilling several kilometers down and pumping geothermal brine up. The Oil and Gas Industry has already done this in many locations, including in Alberta. In some examples, where oil reservoirs have been depleted over the past decades, mostly hot water is being brought to the surface by Electric Submersible Pumps (ESPs). Eventually the operational costs of supplying that electricity and maintaining that equipment will exceed the profit that can be made from producing the small amount of oil that comes up from the water, justifying the abandonment of the well. Despite the efficiency of the TFC being lower than the ORC, far more net power could be generated in these applications with the finite brine source because the TFC uses far more of the available heat. If the net power output from the TFC is sufficiently higher than the parasitic electrical load of the ESP(s), then it would make sense to continue to run the equipment even after all the oil had been depleted. This would imply that excess electricity could be sold to the grid, or used locally for applications like crypto-currency mining. Geothermal electricity production is a reliable source of renewable base-load power that could become important for countries that are attempting to minimize use of non-renewable sources of power, but are struggling with widespread adoption of intermittent renewable power sources. As an example, many ESP well applications could be in the 50-300 kW range with wells feeding into satellites that could have 1 MW or more of ESPs upstream.

Across many industries, Pressure Control Valves (PCVs) keep the system pressure below a desired upper limit safely or maintain a part of a circuit at a pressure set point. In Flow Control Valve (FCV) applications, a flow set point may be maintained, with the flow calculated based on the gas composition, temperature and/or pressure measurements.

This calculation may need to be proven to be accurate enough to meet jurisdictional requirements; for example, Measurement Canada requirements in Canada. In either example, the Control Valve (CV) controls the flow of the fluid by changing its flow path based on the signal from the controller, which changes the temperature, pressure and/or flow. Gases may experience high velocity choked flow, which in some cases could lead to acoustical pulsations and/or premature wear. When the required gas pressure drop is high enough, the expected high temperature drop could lead to freezing. This is commonly mitigated by burning natural gas to provide heat for line heaters upstream of the control valve. In cryogenic gas plants, it is common for a Flow Control Valve (FCV) known as a Joule Thomson Valve or JT Valve to be placed in parallel to a turboexpander (turbine) for startup purposes. While the isenthalpic throttling process does not theoretically steal energy from the gas, the generation of useful work via a turboexpander does result in lower energy and temperature of the gas. Dynamic expansion devices such as turbines may not adequately replace a CV partly because the open-flow design does not allow the flow to be stopped completely. Positive displacement expansion devices known in the prior art also lack the capabilities to be a suitable replacement for CVs. For example, a control valve may require 0-100% volumetric capacity control adjustment over a wide range of expected pressures on the upstream and downstream sides.

In one example, around 40-400 W may be required at remote locations to allow for remote monitoring and to actuate valves. For example, a site may use radio, cellular and/or satellite connectivity to transmit critical data in real-time. Natural gas from wells may sometimes be vented to the atmosphere, for example, when it is being used to actuate valves because there is insufficient power to operate air compressors or electrically actuate valves. Although solar panels and batteries can be a solution at times, these may be an expensive and unreliable option, especially where theft and vandalism are occurring or in northern climates having reduced sunlight, especially in the winter. However, venting natural gas to the atmosphere contributes to increased greenhouse gas emissions, and there exists regulatory and financial incentives in some jurisdictions to reduce or eliminate greenhouse gas emissions. Thus, it is desirable to develop new mechanisms for remote monitoring and actuation of valves at remote wellsites while reducing greenhouse gas emissions.

Cold climates such as Canada face additional challenges when attempting to reduce greenhouse gas emissions because natural gas is commonly burned to produce heat. Electric vehicles, for example as manufactured by Tesla™, were initially deployed with electric resistive heating, with newer models now being released with "heat pump" technology. A "heat pump" itself actually consists of a compressor, which moves a refrigerant through a refrigeration cycle, including a heat exchanger to extract heat from the source. An issue encountered with electric resistive heating in electric vehicles was the significant amount of electrical energy that is required in cold climates to keep the cabin at a comfortable temperature. The significant amount of heat loss and subsequent electricity consumption forced consumers to charge their vehicles more frequently when traveling long distances. Even when it is −40° C. outside, the ambient environment is an abundant source of thermal energy. Since temperature can only flow from higher temperature to lower temperature, heat pump cycles have an internal refrigerant drop below ambient temperature. This refrigerant begins as a liquid-vapor mixture and the environment supplies heat energy to boil the refrigerant until it is a vapor mixture. The amount of heat energy supplied from the environment typically far exceeds the electrical energy required to run the subsequent (isentropic) compression process. Compression boosts the pressure of the refrigerant and brings the temperature above a comfortable cabin temperature. A heat exchanger is used to transfer latent heat from the condensation process of the refrigerant into the comparably cooler cabin air. The resulting high pressure, and higher temperature liquid-vapor refrigerant undergoes isenthalpic expansion via a throttling valve to complete the cycle. The Coefficient of Performance (COP) is defined as the ratio of useful heating (or cooling) provided over the input work required. As an example, if three times more heat is provided to the cabin in comparison to the electricity used to run the compressor, then a COP of 3 is calculated. This would imply that three times less electricity were required for the purpose of heating the cabin, resulting in significantly less electricity usage.

In a similar process to the heat pump cycle, a reversing valve can be used to provide Air Conditioning (AC) to the cabin. Warm cabin air rejects heat to evaporate/boil comparably cooler refrigerant, causing a liquid to vapor phase change. This vapor is boosted in pressure and temperature via isentropic compression before rejecting heat to the comparably lower temperature environment. As the high pressure and temperature refrigerant rejects heat to the environment, it becomes a liquid-vapor mixture. The temperature and pressure drop via isenthalpic throttling before the refrigerant enters the heat exchanger that functions to cool the cabin air. Minimizing wasted energy helps maintain electric vehicle range. U.S. Pat. No. 10,967,702 B2 is assigned to Tesla Inc. and titled "Optimal source electric vehicle heat pump with extreme temperature heating capability and efficient thermal preconditioning". It is stated that "in the second heating mode, the vehicle thermal management system 300 of FIG. 4 supports at least one enhanced heating mode to increase a heating rate of the vehicle cabin. In a first enhanced heating mode, the vehicle thermal management system 300 causes a compressor drive circuit to operate the compressor 214 in a lossy mode to generate heat, i.e., the electric motor of the compressor 214 is operated directly as a high-voltage electrical heater in extremely cold startup conditions. For example, if the compressor 214 motor is rated up to 8 kW continuous power consumption, in theory, it could be used to deliver 8 kW of heating power to the vehicle cabin."

The author of the article titled "How Tesla Heat Pump Works (vs HVAC Heat Pumps)" [https://aircondlounge.com/how-tesla-heat-pump-works/by Yu Chang Zhen, Accessed on 5 May 2023] states that "in a dire situation where the ambient temperature drop below freezing point, the compressor of the Tesla heat pump will switch to an inefficient mode or "lossy mode" to provide a direct one-to-one energy ratio heating to the cabin." Also stated is that "this heating mode yields a COP of 1, just like an electric space heater. However it keeps the people inside the vehicle warm and toasty even when the outside temperature is 10 degrees Celsius below freezing point."

Air source heat pump systems used to heat electric vehicles or buildings face a challenging variation in operating conditions. In the fall, spring and summer, ambient conditions may be somewhat close to desired interior temperatures, requiring a modest compression ratio and therefore high operational efficiency and COP in either heating or cooling mode. Cold winter days in Canada; especially those around −40° C., require very high compression ratios.

Dynamic compression devices lack the required flexibility, while commercially available positive displacement technologies are quite inefficient at such high compression ratio applications. Screw compressors are valveless and offer some flexibility to adapt to the changing inlet pressure, but the reduction in volumetric throughput from internal recirculated gas volumes and internal leakages makes high compression ratio cases inefficient. There is often a need for low to medium duty cycle capacity where screw equipment can become increasingly less efficient. Slower speed operation allows a noticeably larger percentage of the flow to leak internally from higher pressure to lower pressure, thereby increasing the recirculated volume and decreasing the efficiency. In extreme scenarios, compressors can reach a limit where far too high of compression ratios are attempted compared to resulting recirculated volume. In this scenario, net flow from the high pressure to low pressure side is theoretically possible, contributing to substantial temperature build-up in the compressor.

In one example, the heat pump system in an electric vehicle could have a scroll compressor with shaft rotational speeds ranging from 500 RPM to 9,000 RPM. Scroll compressors can have near zero clearance volume and low recirculated volume, even at low operational speeds, which may demonstrate a substantially linear relationship between operational speed and both flow rate and power consumption. These qualities, combined with relatively quiet operation make them a common choice where the flow rate and implied duty cycle varies significantly. Compression occurs as gas becomes trapped in crescent-shaped pockets between the involute spiral shaped geometries. The volume of the compression chamber decreases as it reaches the center of the assembly, where it becomes in fluid communication with the gas in the high pressure piping via a discharge port. The size and geometry of the outlet port determines the amount of internal compression and there are practical limitations on the achievable compression ratio before this fluid communication occurs. When the desired compression ratio exceeds the limitations of the equipment, the pressure in the chamber can be significantly lower when it first becomes fluidly connected to the gas at the high pressure piping. This premature fluid communication with the chamber and gas in the compressor discharge piping is known as "under-compression" and is expected to introduce increasingly higher inefficiency when higher compressions ratios are attempted. There are practical compression limitations, which are mainly related to the size and geometry of the outlet port and the size, shape and wall thickness of the scrolls themselves. Scroll compressors may be able to generate up to 150 psig in a single stage unit. Scroll equipment is used in relatively low power heat pump, refrigeration and air conditioning applications, but in many other applications multiple units would be required, which may be prohibitively expensive. Scroll compressors have a relatively high upfront cost and are not easily repairable, due to the complex geometry of the components. Inlet valves are not required, but sometimes discharge valves are used. There is an efficiency penalty associated with the flow restriction introduced by adding a discharge valve, but in high compression ratio applications where the upstream and/or downstream pressure(s) vary significantly, larger efficiency penalties might be expected without the discharge valve.

Markets may exist, especially below 1 MW, for a highly efficient, reliable, rotary positive displacement device. Mechanical equipment experts may regard isothermal compressors and isentropic expanders as the most desirable equipment in most applications. The applicant of U.S. Pat. No. 5,674,053 stated that "a single stage compression of gas at ambient to 4000 psig would result in a gas temperature of over 600° C. This temperature exceeds the desired operating temperature of valves, seals and other components in the compressor. To avoid the use of exotic materials, it is often desirable to maintain the gas charge at substantially lower temperatures." Also understood is the ability for high temperatures to be avoided in high compression ratios in a single stage when comparably high heat capacity liquids are introduced in the gas, which is commonly known as oil-flooding. It will be appreciated that high operational flexibility, low equipment costs, low mechanical overhead, high efficiency and high reliability may be desirable design objectives. It may also be desirable to provide a single device that is capable of a wide range of processes, including a range between near-isothermal processes to near-isentropic processes. The applicants of U.S. Pat. No. 10,975,869 stated that "Oil flooded screw compressors that attempted operation at discharge pressures much higher than 350 psig have experienced wear and/or other mechanical design issues that make such devices unreliable, and thus not widely adopted. Thus, the constraint for high discharge pressures with screw compressors has been mechanical design, and not a lack of pursuit or understanding of the appeal of very high compression ratios in combination with high discharge pressures in a single stage and with controlled temperatures. "Dry gas compression is understood to substantially lack liquid and solid entrainment and therefore multiple stages of compression are typically required. For example, a screw compressor may be capable of compressing atmospheric pressure "0 psig" gas to up to 350 psig by using three stages. It is understood that the gas is typically cooled with heat exchangers after each stage of compression. Oil-flooded screw compressors may be capable of compressing "0 psig" gas to up to 350 psig in a single stage of compression without producing excessive temperatures because the higher heat capacity of the liquid oil and amount used significantly impact the temperature that the gas reaches as it rejects heat to the oil. It is understood that the "pressure ratio" is defined as the ratio of the pressure at the high pressure side of a compressor to its pressure at the low pressure side, using stagnation pressures. Given typical ambient conditions this example may be calculated with a pressure ratio of around $$\frac{364\ psia}{14\ psia} = 26.$$

Expansion is the reverse process of compression, using the same calculation of "pressure ratio".

In North America, reciprocating compressors are widely used along much of the natural gas gathering pipelines when the natural gas is boosted above 350 psig (i.e. above the pressure rating that screw compressors have been proven to be reliable at). A relatively large number of gathering pipelines may feed into relatively fewer and larger diameter transmission pipelines, before many distribution pipelines are used to deliver natural gas to end users. As an example, many natural gas gathering and transmission pipelines in North America are rated for 1440 psig (i.e. pounds per square inch gauge) of pressure. In other examples, the pressure in a pipeline can exceed 1440 psig. The pressure of newly drilled natural gas wells can often exceed this maximum rating and therefore be reduced via a throttling valve, which is also known as a choke valve, before the gas may be safely incorporated. As the natural gas is expended from the well, the pressure decreases accordingly and can approach 0 psig or even less at the surface, eventually requiring a compressor to boost the pressure enough to maintain natural gas production. For example, the pressure within the gathering pipeline may range from 0 to 1440 psig. In another example, the pressure within a gathering pipeline may range from 0 to 1600 psig or more. For example, when a compressor is initially installed, a pressure ratio of just over 1 may be required, but over time this required pressure ratio could be 110 or more, which, to the knowledge of the Applicant, no prior art equipment has been shown to address successfully.

As an example, the pressure within a transmission pipeline may range from 400 psig to 1440 psig. As another example, the pressure at the end of a transmission pipeline may range from 400 psig to 900 psig and the pressure in a subsequent distribution pipeline may range from 0.25 psig to 100 psig, with generally lower pressures at the end of the respective pipelines. Higher pressures are associated with higher densities and therefore less volume is required in the pipelines and relatively smaller diameter pipelines may be used. A pressure differential is required to flow the gas through the pipeline at a desired flow rate, also accounting for friction that the gas experiences with the inner walls of the pipelines.

Reciprocating compressors have a piston component accelerating and decelerating in a cylindrical housing, making use of pressure-activated valves to allow gas to enter/exit chambers. These valves are custom designed for a particular gas composition and expected pressure and often experience premature failure as conditions change. While relatively expensive modifications may be possible, it is common practice for the natural gas to leak out of a reciprocating compressor where the piston rod rubs at the packing glands. Considerable clearance volume is required where the piston would otherwise slam into the stationary housing at the ends of the stroke and there is little to no capability to reliably introduce liquids for the same concern, since liquids are known to be substantially less compressible than gases and may not exit the limited flow area offered by the valves in time. The clearance volume significantly increases recirculated volume, which is gas that needs to be inefficiently recompressed altogether. Typical applications may include multiple stages of compression with inter-cooling and adjustments to the volumetric throughput are limited and inefficient. While screw compressors may offer improvements to many of these challenges, there still is a need for an improved device that may reliably operate with a pressure rating above 350 psig.

Similar challenges are understood to exist for the reverse (expansion) process, especially at power ratings below about 1 MW where turbines may become less cost-effective to employ. Many applications are in need of a more reliable, efficient and flexible compressor and/or expander; especially one that is capable of high pressure ratios in a single stage. However, one limitation of the prior art is that the pressure ratio that can be reliably and efficiently achieved is limited by significant recirculated gas volume and/or other geometry related constraints. In an extreme example, in relatively high pressure ratio cases, the volumetric throughput reduction associated with recompression of the recirculated volume could actually result in a negative net volumetric throughput. In other words, effort would be exhausted in causing the compressor to boost the pressure of a gas and the net result could be undesirable backflow of said gas. This extreme example demonstrates that there are certain known limitations to the pressure ratio that a compressor can practically achieve, which is understood to be significantly impacted by the recirculated volume of the compressor. High recirculated volume would significantly reduce expander efficiency as well, because this portion of flow may not noticeably contribute to useful work.

As an example, heat pump and power generation cycles ideally match a higher pressure ratio as the temperature differential between the heat source and heat sink temperatures increases. However, no equipment is known in the prior art that may have a combination of low enough recirculated volume (i.e. including internal leakages) and other capabilities to properly address all of the pressure ratios that these cycles ideally desire. It should be noted that scroll equipment can be used in expansion when there is no valve at the high pressure side, but this equipment has not been shown to be appropriate enough to demonstrate widespread use in power generation cycles. Also, to the Applicant's knowledge, no equipment is known in the prior art that may efficiently and reliably accommodate the ideal range of pressure ratio adjustment in heat pump and power generation cycles. In order to address limitations in the prior art, it may be common practice to operate these cycles in suboptimal conditions, for example not generating excess power that may be available in the winter time. Air-source heat pump cycles in the prior art are believed to be capable of boosting ambient temperature air as low as around −15° C. up to around 20° C.-25° C. with acceptable efficiency and in colder ambient conditions, it may be typical for natural gas or electricity to be consumed to still achieve a desired temperature of 20° C.-25° C. for example. In one example, two scroll compressor stages may be used in an air-source heat pump cycle to achieve a COP of 1 at an ambient temperature of −25° while achieving a desired temperature of 20°-25° in a building space. In electric vehicle applications, there may only be enough space for one compressor stage, increasing the need for a compressor that can more efficiently handle the high compression ratios required in a single stage to boost the large temperature differentials. When electric vehicles are driven in cold climates (e.g. −15° C. to −40° C. ambient conditions), the expected driving range between battery charges may be significantly reduced accordingly as a comfortable cabin temperature of 20° C.-25° C. is maintained. A compressor with lower recirculated volume than is known in the prior art may be required in cohort with a wide range of on-the-fly, efficient, pressure ratio adjustability in the heat pump cycle to avoid this supplemental energy wastage.

Some companies state they have a gas expander that acts as power-generating (gas) pressure reducing valve, which is understood to produce power without substantially adjusting the volumetric throughput of the gas. To the best of the knowledge of the applicant, no gas expanders act as a power-generating gas control valve. An expander acting as a power-generating gas control valve, is understood to produce power while adjusting the volumetric throughput of the gas by 0-100%. While such functionality is desirable, to the knowledge of the Applicant, a power-generating gas control valve requires an expanded range of volumetric capacity control that is not disclosed in the prior art expanders. Control valve applications at remote sites along natural gas pipelines may vent natural gas to the atmosphere during operation if no other sources of electricity or pressurized fluid are present. Maintenance operations may sometimes involve releasing natural gas contained in piping and equipment to the atmosphere.

SUMMARY

In one aspect of the present disclosure, what is disclosed herein may be particularly useful for applications below 1 MW, where positive displacement equipment is generally the dominant choice; however, this is not intended to be limiting and it will be appreciated that the present disclosure may also be utilized for applications at or exceeding 1 MW.

As indicated by the foregoing examples, there is a need to develop equipment that is capable of high pressure ratios (i.e. over 110:1 or higher as an example) in a single stage in combination with higher pressure ratings (i.e. over 350 psig as an example) and that controlling temperature may be done by introducing liquid into the gas. Also indicated is the practical limitation of sufficiently increasing the pressure ratio without a means of sufficiently reducing the recirculated volume and/or without a means of modifying limiting geometrical constraints. Also desirable is the ability to efficiently accommodate varying pressure ratios and/or ideally a range of 0-100% volumetric capacity control.

The novel Rotary Positive Displacement Device disclosed herein may, in some embodiments, be the first expander capable of efficiently producing power and the full functionality of a gas control valve over an expanded range of pressure ratios. A range of 0-100% volumetric capacity control may also be offered as well as reversible expansion/compression modes without changing internal structures. In control valve applications, this novel Rotary Positive Displacement Device generates power in expansion mode, provides its own seal when the equipment isn't in use and/or compression mode may be used to substantially evacuate fluid from the low pressure side before maintenance is done. The novel Rotary Positive Displacement Device disclosed herein may also reduce the recirculated volume by orders of magnitude beyond anything known in the prior art, which may result in efficiency improvements in different applications and improved pressure ratios and use in heat pump cycles and power generation cycles, including the Trilateral Flash Cycle (TFC) and/or Partially Evaporated Cycle (PEC) where prior art equipment may not have been successfully implemented. As an example, the novel Rotary Positive Displacement Device disclosed herein may be implemented in an air-source heat pump cycle with −40° C. ambient air to achieve interior temperatures of around 20-25° C., in one example, without supplemental energy, for example from the consumption of natural gas or electricity. This may significantly reduce the range loss that electric vehicles face in −40° C. ambient conditions. In other words, the novel rotary positive displacement equipment disclosed herein may be particularly suitable to integrate with the thermal management system and minimize electric vehicle range loss when the cabin requires heating. The novel Rotary Positive Displacement Device disclosed herein contains a minimal number of components and does not require components that are known in some of the prior art equipment to experience significant wear, such as valves or packing glands. Therefore, it is believed that the devices disclosed herein will operate reliably and safely with long component lifespan.

As another example, the novel Rotary Positive Displacement Device may, in some aspects, provide certain advantages in Compressed Air Energy Storage (CAES) applications with the same equipment being reversibly operated as both a compressor and expander to reduce costs and with the high pressure ratio capabilities and flexibility allowing for the efficient filling of a fixed volume storage vessel. High efficiency may also be important in this application as it is expected to improve the economics of such applications. While some exemplary applications have been disclosed, it shall be understood that the previous paragraphs are not an exhaustive list regarding what the novel Rotary Positive Displacement Device may be well suited for.

The compact device disclosed herein, in one example, is particularly advantageous for the ability to efficiently accommodate a large range of upstream and downstream pressures, working fluid composition and desired volumetric throughput in a single stage of expansion and/or compression. In one example, this device may be particularly advantageous at comparably increasing heat output in a heat pump cycle, while significantly reducing electricity usage to conserve range in electric vehicles and/or regulate interior building temperature. In one example, the rotary positive displacement device may generate power and/or useful work while also acting as a control valve, reliably generating power and/or compressed air at remote locations. The device may be particularly advantageous at increasing power generation capabilities in low grade waste heat recovery applications. In one example, the device may generate power in the Trilateral Flash Cycle (TFC) or Partially Evaporating Cycle (PEC) to further cool the heat source, as is desired, in one example, when hot water from an industrial process is being returned to an ecosystem.

The term substantially is used herein to indicate being largely, but not necessarily wholly that which is specified, nearly. The term frusto is used herein to define a section or segment of a geometric surface or shape. As an example, the term frusto-spherical surface is used to define a surface lying on a sphere, but not only a segment of the entire sphere. Therefore, the term frusto defines a portion of the surface of a solid herein. As an example, when referring to the outer surface of the rotors, the term "frusto-spherical" defines a surface lying on a sphere; said spherical surface has regions removed and does not form a continuous sphere. As further examples, a "frusto-conical" surface may lie on a cone and a "frusto-cylindrical" surface may lie on a cylinder.

The term "working fluid" is used herein to denote any combination of gases and/or liquids that are generally directed through the Rotary Positive Displacement Device disclosed herein. It is to be understood that while some solids may also be present in the "working fluid" the conveyance of solids is generally not the intent of the Rotary Positive Displacement Device. The term "compression" is defined herein as the act of increasing the pressure of the working fluid, which is understood to be any combination of gases and/or liquids. The term "compressor" is defined herein as a Rotary Positive Displacement Device that increases the pressure of a working fluid which is comprised of some amount of gas or vapor. The term "expansion" is defined herein as a Rotary Positive Displacement Device that decreases the pressure of a working fluid which is comprised of any combination of gases and/or liquids. The term "expander" is defined herein as a Rotary Positive Displacement Device that decreases the pressure of a working fluid which is comprised of some amount of gas or vapor. The term "pump" is defined herein as a Rotary Positive Displacement Device that increases the pressure of a working fluid which is substantially comprised of liquid. The term "liquid motor" is defined herein as a Rotary Positive Displacement Device that decreases the pressure of a working fluid which is substantially comprised of liquid. Therefore, the term "Rotary Positive Displacement Device", capitalized to refer to the device(s) disclosed herein, may be used interchangeably with the terms "compressor", "expander", "pump" and "liquid motor" to denote the same device.

The term "adiabatic" as used herein, denotes any expansion or compression process involving substantially no transfer of heat to or from a gas contained in the working fluid, respectively.

The term "isothermal" as used herein, denotes any non-adiabatic compression process that derives energetic benefit, including increased efficiency, from the deliberate transfer of heat from a gas contained in the working fluid as well as any non-adiabatic expansion process involving a deliberate transfer of heat to a gas contained in the working fluid. It is to be understood that the deliberate transfer of heat to or from a gas contained in the working fluid may be used to modify the temperature of the gas accordingly, offering advantages in some applications.

The terms "low pressure" and "high pressure" as used herein, denotes any relative difference in working fluid pressure wherein "high pressure" is understood to be at a relatively higher pressure than "low pressure" without any implied limitation regarding the magnitudes of the pressures.

The terms "driver" and "generator" as used herein, may be used interchangeably when referring to "drivers" and "generators" which may be reversibly operated to drive or be driven. As one example, electrical motors are a driver that may be reversibly operated as a generator. Hydraulics, pneumatics and human power are other examples of "drivers and generators". It is to be understood that use of the term "driver" does not limit use for example when relating to drivers that are not known to be reversibly operated such as engines that combust natural gas, diesel and/or gasoline fuel.

Several examples of the novel Rotary Positive Displacement Device are disclosed herein which include methods for constructing basic sawtooth rotor geometry, advanced sawtooth rotor geometry and customized sawtooth rotor geometries with varying numbers of lobes and lobe tip geometries. Pairs of rotors with frusto-spherical outer surfaces may mesh, with respectively interposing lobes and valleys, inside of the immediately adjacent frusto-spherical inner surfaces of gates and/or stationary housing components, forming chambers there between. Openings formed by gates and/or stationary housing components may be adjustable, for example if gates are used and circumferentially repositioned via actuator assemblies, selectively enabling conveyance of a working fluid through the Rotary Positive Displacement Device. The gates may be further positioned to substantially obstruct outer ports when zero or near zero volumetric throughput is desired. In some embodiments, the full range of 0-100% volumetric throughput capabilities may allow use as a control valve.

Bearings may be placed in close proximity to the chambers to minimize deflection and increase pressure ratings to exceed 350 psig. Since the maximum deflection may be substantially cubically related to the axial distance between the bearings and the radial component of the pressure-induced load acting on the respective rotor, in one example, the pressure rating may be much larger than 350 psig. In one example, the pressure rating may be at or around 1440 psig, which may be useful in addressing applications along natural gas pipelines. In another example the pressure rating may be at or around 5000 psig, which may be useful in addressing markets where the working fluid is substantially hydrogen based. In one example there may be a single driver, which may be a reversible motor/generator or another Rotary Positive Displacement Device for example to provide capabilities of rotating the rotor shaft in either rotational direction to respectively facilitate both compression and expansion capabilities. In another example, motors/generators are coupled on both respective first/second rotor shaft to reduce or even eliminate torque transfer between immediately adjacent rotor surfaces, which may increase component lifespan in the absence of gearing and/or a U-joint for example. In yet another example, a plurality of motors/generators with differing rated speeds may interact with one or both rotor shafts to offer speed adjustment without requiring a costly Variable Frequency Drive (VFD) or transmission. The internal adjustability of the Rotary Positive Displacement Device may allow for such driver choices.

In one aspect of the present disclosure, it is desirable to provide a reliable, high efficiency expander and/or compressor with high operational flexibility, wherein in some embodiments, is capable of efficiently handling varying fluid compositions, pressures and desired flow rates.

In another aspect of the present disclosure, it is desirable to provide a high efficiency expander and/or compressor with low equipment cost and low mechanical overhead in some embodiments, as compared to existing expander and/or compressor devices.

In another aspect of the present disclosure, it is desirable to provide a high efficiency expander and/or compressor that, in some embodiments, may range from being near isothermal to near isentropic.

Through reference to the following description, accompanying drawings and the claims, these and other characteristics, along with advantages and features of the present invention disclosed herein, will become apparent. It is to be understood that the features of the various examples described herein may exist in various combinations and permutations without mutual exclusivity.

In some embodiments, a rotary positive displacement device comprises: a housing having a low pressure port and a high pressure port; a first rotor having a frusto-spherical outer surface, an axial surface, a first rotor shaft and a first rotational axis passing through the first rotor shaft, wherein the axial surface comprises at least one teardrop surface and at least one involute surface, the at least one teardrop surface and at least one involute surface together defining at least one lobe and a corresponding valley; a second rotor having a frusto-spherical outer surface, an axial surface, a second rotor shaft and a second rotational axis passing through the second rotor shaft, the axial surface comprises at least one teardrop surface and at least one involute surface, the at least one teardrop surface and at least one involute surface together defining at least one lobe and a corresponding valley, the second rotational axis intersecting with the first rotational axis; a high pressure opening extending between the first and second rotors and the high pressure port of the housing; and a low pressure opening extending between the first and second rotors and the low pressure port of the housing, wherein the low pressure opening is configured to selectively communicate with one or more chambers of the at least two chambers. The second rotor is configured to intermesh with the first rotor such that at least two chambers are separated by the axial surfaces of the first and second rotors, each chamber of the at least two chambers having a variable volume as the first and second rotors rotate about their respective rotational axes. A lobe tip of each rotor is in contact with, so as to form a seal against, the corresponding teardrop surface of the other rotor. The involute surface of each rotor is in contact with, so as to form a seal against, the corresponding involute surface of the other rotor. The high pressure opening comprises a lower edge, the lower edge positioned along an outer diameter of the frusto-spherical outer surface of the second rotor, wherein the lower edge is positioned between the second rotor shaft and the at least one valley of the first rotor.

In some embodiments, each involute surface of the first and second rotors includes an involute curve at the outer diameter of the first and second rotors, the involute curve having a distal point adjacent to the corresponding lobe tip, the distal point having a distance measured between the distal point and the corresponding shaft of the rotor, wherein the said measured distance is greater than a distance measured between any other point on the involute curve and the corresponding shaft. Each involute curve has a substantially horizontal slope at the distal point, the substantially horizontal slope being tangent to the involute curve and the substantially horizontal slope lying in a plane that is substantially perpendicular to the corresponding rotational axis of the first and second rotors.

In some embodiments, the lobe tip of each lobe of each of the first and second rotors is a rounded lobe tip, the rounded lobe tip comprising a spline curve. In some embodiments, the spline curve of each lobe tip varies at each diameter of each rotor of the first and second rotors.

In some embodiments, the at least one involute surface of each axial surface of each rotor includes a radial recess extending along the at least one involute surface, the radial recess extending to the outer diameter of the rotor.

In some embodiments, the high pressure opening is formed in the housing of the device. In some embodiments, the low pressure opening is formed in the housing of the device.

In some embodiments, the high pressure opening comprises an aperture in a repositionable high pressure gate, the high pressure gate sandwiched between the intermeshed first and second rotors and the housing, wherein the aperture of the high pressure gate may be selectively circumferentially positioned relative to the position of the at least two chambers formed between the intermeshed first and second rotors. In some embodiments, the corresponding low pressure opening is formed in the housing of the device.

In some embodiments, the low pressure opening comprises an aperture in a repositionable low pressure gate, the low pressure gate sandwiched between the intermeshed first and second rotors and the housing, wherein the aperture of the low pressure gate may be selectively circumferentially positioned relative to the position of the at least two chambers formed between the intermeshed first and second rotors. In some embodiments, the low pressure gate comprises two or more low pressure apertures.

In some embodiments, the low pressure opening is an aperture in a repositionable low pressure gate and the high pressure opening is an aperture in a repositionable high pressure gate, the low pressure and high pressure gates each sandwiched between the intermeshed first and second rotors and the housing, wherein each aperture of the low pressure and high pressure gates may be independently and selectively circumferentially positioned relative to the position of the at least two chambers formed between the intermeshed first and second rotors.

In some embodiments, at least one of the high pressure gate and the low pressure gate are selectively circumferentially positionable via an actuator. The actuator may, in some embodiments, drive a worm drive, wherein at least one of the high pressure gate and the low pressure gate comprises a worm wheel of the worm drive.

In some embodiments, the high pressure opening comprises the aperture in the repositionable high pressure gate and an abutting aperture in the housing, wherein the aperture in the repositionable high pressure gate comprises adjustable leading and trailing edges and the abutting aperture in the housing comprises stationary leading and trailing edges and the lower edge, and wherein the configuration of the high pressure opening may be changed by selectively positioning the aperture of the repositionable high pressure gate relative to the stationary abutting aperture in the housing. In some embodiments, the corresponding low pressure opening is formed in the housing of the device.

In some embodiments, the low pressure gate is selectively circumferentially positioned so as to align the low pressure aperture with each chamber of the at least two chambers such that each chamber will pass the low pressure aperture and be sealed by the low pressure gate at a selected volumetric capacity of each chamber.

In some embodiments, the high pressure gate is selectively circumferentially positioned so as to align the high pressure aperture with each chamber of the at least two chambers such that each chamber will pass the high pressure aperture and the volume in each chamber of the at least two chambers will be maintained at a selected volume ratio.

In some embodiments, at least one of the high pressure gate and the low pressure gate is circumferentially repositioned so as to selectively form a seal between the at least two chambers formed between the intermeshed first and second rotors and the corresponding high pressure port or low pressure port.

In some embodiments, at least one of the first and second rotors is a driven rotor, wherein the shaft of the driven rotor is driven by a driver. The driver may be, in some embodiments, selected from a group comprising: an electric motor, an electric motor controlled with a variable frequency drive (VFD), hydraulics, pneumatics, a second rotary positive displacement device.

In some embodiments, the lower edge of the high pressure opening substantially lies in a plane that is substantially perpendicular to the first rotational axis.

In some embodiments, the lower edge of the high pressure opening is positioned substantially between the at least one lobe tip of the first rotor and the at least one valley of the second rotor.

BRIEF DESCRIPTION OF THE DRAWINGS

Like reference characters in the drawings generally refer to the same parts throughout the different views.

DETAILED DESCRIPTION

Figure 1:
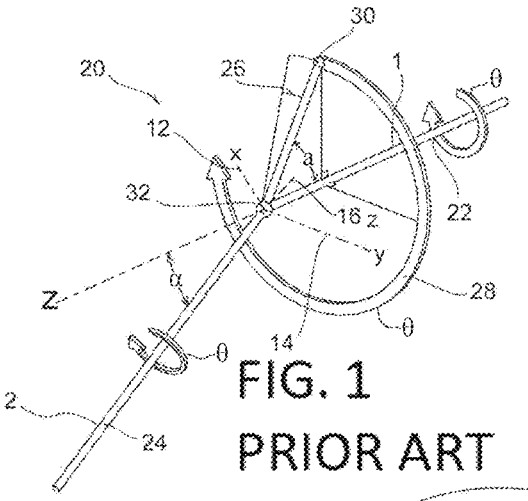
FIG. 1 PRIOR ART
FIG. 1 shows a general geometric concept as applied to rotors for creating a base curve between two rotors having rotational axes that intersect and are offset from co-linear, as disclosed in the prior art.

This disclosure includes several examples of rotary positive displacement devices within the scope of the present disclosure. In some aspects, some embodiments may have high operational flexibility, high power to mass ratio and/or comparatively low cost. The devices disclosed herein, in one example, provides an expander that may be reversibly operated as a compressor without any change to the structures. The devices disclosed herein, in another example, may be operated as a pump that may be reversibly operated as a liquid motor.

To aid in description and reduce the length of the text, in some instances, specific examples of a component include an alphabetic suffix denoting the specific example of a more generic example. For instance, the lobe tips 138A/138B may denote the lobe tips on the respective "idler" and "driver" rotors and a sawtooth rotor contains a lobe tip 138. In some examples, a specific label is shown in the drawing, and the generic label is used in the specification indicative of the specific example and equivalents.

Both positive displacement and dynamic displacement expansion and/or compression devices are discussed in the background section. For the purposes of this disclosure, it is to be understood that while liquids may be substantially incompressible, an increase or decrease in pressure across the device may be referred to as compression or expansion, respectively. Several addressable markets are discussed in the background section which do not represent all of the potential markets that the novel Rotary Positive Displacement Device 100 (See FIGS. 91-92) may be applicable in, and is not intended to be limiting. The Rotary Positive Displacement Device 100, in another aspect of the present disclosure, may be comprised of basic, advanced or customizable sawtooth rotor profiles.

Construction of Teardrop

The basic, advanced and customizable sawtooth rotor profiles comprise of teardrop surfaces with instructions outlined below. The construction of a teardrop base curve, prior to offsetting, is described in the prior art. With reference to FIGS. 1 to 4: Axes 1 and 2 intersect at the intersect point 32, with a first axis (Cartesian coordinate) system 20 comprising of axis 12 indicating the x direction, axis 14 indicating the Y direction and axis 16 indicating the Z direction. Axis 1 is collinear with the Z axis, "16 z". Axis 2 is set at a prescribed angle "a" (i.e. aka "alpha angle" or "p") from the Z axis, "16 z". The alpha angle may be an acute angle with a magnitude less than 90° or π/2 radians. Reference axis 26 is set at a prescribed angle "a" (i.e. aka "reference angle") from axis 1. The reference axis 26 contains the reference point 30. The reference angle may be an obtuse angle with a magnitude greater than 90° or π/2 radians and less than 180° or π radians. As axes 1 and 2 rotate by an equal amount, "θ", the reference point 30 defines the arc path 28. This arc path 28 is circumferentially positioned around the first axis 1, but with respect to the rotating axis 24, the path of the reference point 30 defines base curve 33, with points lying on an outer sphere 34. Reference axis 26 may be used to define the base curve 33, but when a shape, for example a conical frustum with radius, "ρ", from reference axis 26, with defining surface 38, is moved with reference axis 26 the offset surface 42 is created.

The sawtooth rotor profiles disclosed herein make use of a teardrop shaped base curve 33 formed from the reference axis 26 positioned equidistant from reference axes and 2, at an angle a=alpha/2+90° from axis 1.

Sharp Lobe Tip Basic Sawtooth Geometry—One Lobe with Helical Involute

Figure 3:
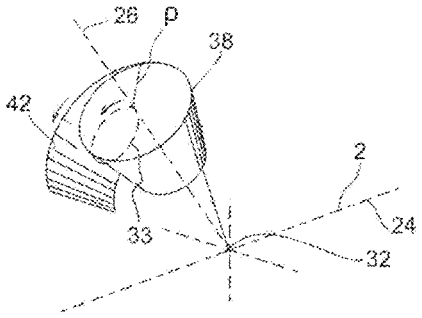
FIG. 3 PRIOR ART
FIG. 3 shows the path of travel of a central reference axis around the base curve between the relative rotation of both rotors whereby a defining surface, which in one form can be a frustoconical surface or other shape, is positioned around the central reference axis, as disclosed in the prior art.
Figure 4:
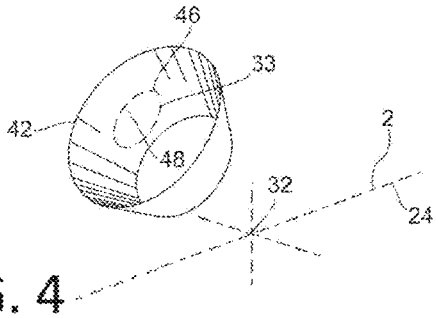
FIG. 4 PRIOR ART
FIG. 4 shows the offset surface which in one form is based upon the defining surface as shown in FIG. 3.

With reference to FIG. 3, it can be appreciated that when "rho" (p) is zero along the axis 26, the defining surface 38 becomes a line and all points, for example point 46 and point 48, on the base curve 33 also lie on the offset surface 42 which is frusto-conical in this example. As will be illustrated, this will result in a sharp lobe tip. Although a sharp lobe tip may not be practical in many applications, it is important to understand the required mathematics before progressing to sawtooth geometries that offset the teardrop base curve to produce a round lobe tip.

It should be appreciated that there may be more than one method to produce varying sawtooth geometries, including, but not limited to, methods involving mathematics and varying software, including Computer Animated Design (CAD) software. It will be appreciated that any rotors and devices falling within the scope of the claims of the present disclosure are intended to be included, regardless of any specific method or software utilized to produce the geometry of the rotors and devices.

Figure 2:
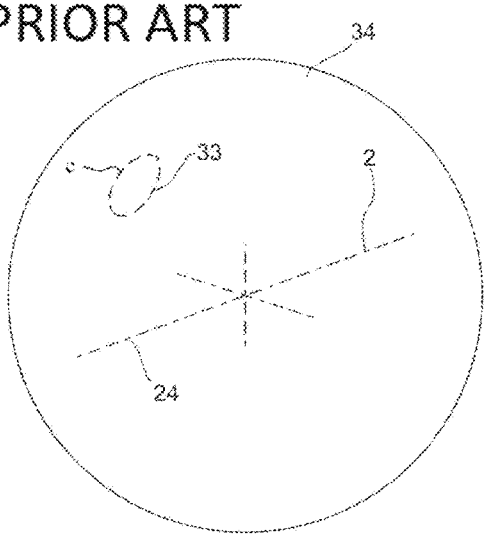
FIG. 2 PRIOR ART
FIG. 2 shows the resultant base curve positioned on the outer surface of a sphere, as disclosed in the prior art.

Parameter "R" is the radius of the imaginary sphere that the base curves lie on. Referring to FIGS. 1 to 3, let vector "v" represent the vector in Cartesian coordinates that extends from the point origin 32 to reference point 30:

$$v = \begin{bmatrix} X \\ Y \\ Z \end{bmatrix} = \begin{bmatrix} R\sin(a-p) \\ 0 \\ R\cos(a-p) \end{bmatrix}$$

It will be appreciated that rotating the vector v while keeping the Cartesian coordinate system fixed is mathematically equivalent to keeping the vector v fixed while rotating the Cartesian coordinate system. Four vector rotations can be applied to vector v to create the base curve "c" (See FIG. 2). The parameter "t" represents theta, θ, (i.e. the rotation angle of a rotor about its respective axis). When the reference angle a=p/2+90°, a teardrop shape is formed over 0<t<360 by using the following set of rotations and matrix multiplication:

Rotate v by +p (i.e. the alpha angle) about Y axis.

Rotate the resulting vector by +t about the Z axis.

Then rotate the resulting vector by −p about the Y axis.

Finally rotate the resulting vector by −t about the Z axis, giving the full matrix multiplication written out:

$$c = \begin{bmatrix} \cos(-t) & -\sin(-t) & 0 \\ \sin(-t) & \cos(-t) & 0 \\ 0 & 0 & 1 \end{bmatrix} \begin{bmatrix} \cos(-p) & 0 & \sin(-p) \\ 0 & 1 & 0 \\ -\sin(-p) & 0 & \cos(-p) \end{bmatrix} \begin{bmatrix} \cos(t) & -\sin(t) & 0 \\ \sin(t) & \cos(t) & 0 \\ 0 & 0 & 1 \end{bmatrix} \begin{bmatrix} \cos(p) & 0 & \sin(p) \\ 0 & 1 & 0 \\ -\sin(p) & 0 & \cos(p) \end{bmatrix} \begin{bmatrix} R\sin(a-p) \\ 0 \\ R\cos(a-p) \end{bmatrix}$$

$$cc = \begin{bmatrix} X(t) \\ Y(t) \\ Z(t) \end{bmatrix} = \begin{bmatrix} R\big(\cos(t)(\cos(p)\cos(t)\sin(a) - \cos(a)\sin(p)) + \sin(t)^2\sin(a)\big) \\ R(-\sin(t)(\cos(p)\cos(t)\sin(a) - \cos(a)\sin(p)) + \cos(t)\sin(t)\sin(a)) \\ R(\sin(p)\cos(t)\sin(a) + \cos(a)\cos(p)) \end{bmatrix}$$

When a=p/2+π/2 radians, the base curve, c, becomes the teardrop base curve, which can be simplified as follows:

$$\text{Teardrop} = \begin{bmatrix} T_x(t) \\ T_y(t) \\ T_z(t) \end{bmatrix} = \begin{bmatrix} R(\cos(p/2)(\cos(p)\cos(t)^2 + \sin(t)^2) + \sin(p/2)\sin(p)\cos(t)) \\ R(-2\sin(p/2)\sin(p)\sin(t/2)^2\sin(t)) \\ R(\sin(p/2)\cos(t)(\cos(p)+1) - \cos(p)) \end{bmatrix}$$

Various mathematical manipulations are done in this disclosure with equations that have points lying on a unit sphere where R=1 in the below equation.

$$R=1=\sqrt{X^2+Y^2+Z^2}$$

It is to be understood that if the parameter R is missing in a teardrop or involute equation, that the X, Y and Z terms may be multiplied by a factor of R to scale to any desired radius. Therefore, the teardrop equation may be re-written below, which is implied to have points existing on a unit sphere where R=1:

$$\text{Teardrop} = \begin{bmatrix} T_x(t) \\ T_y(t) \\ T_z(t) \end{bmatrix} = \begin{bmatrix} (\cos(p/2)(\cos(p)\cos(t)^2 + \sin(t)^2) + \sin(p/2)\sin(p)\cos(t)) \\ (-2\sin(p/2)\sin(p)\sin(t/2)^2\sin(t)) \\ (\sin(p/2)(\cos(t)(\cos(p)+1) - \cos(p))) \end{bmatrix}$$

Figure 5:
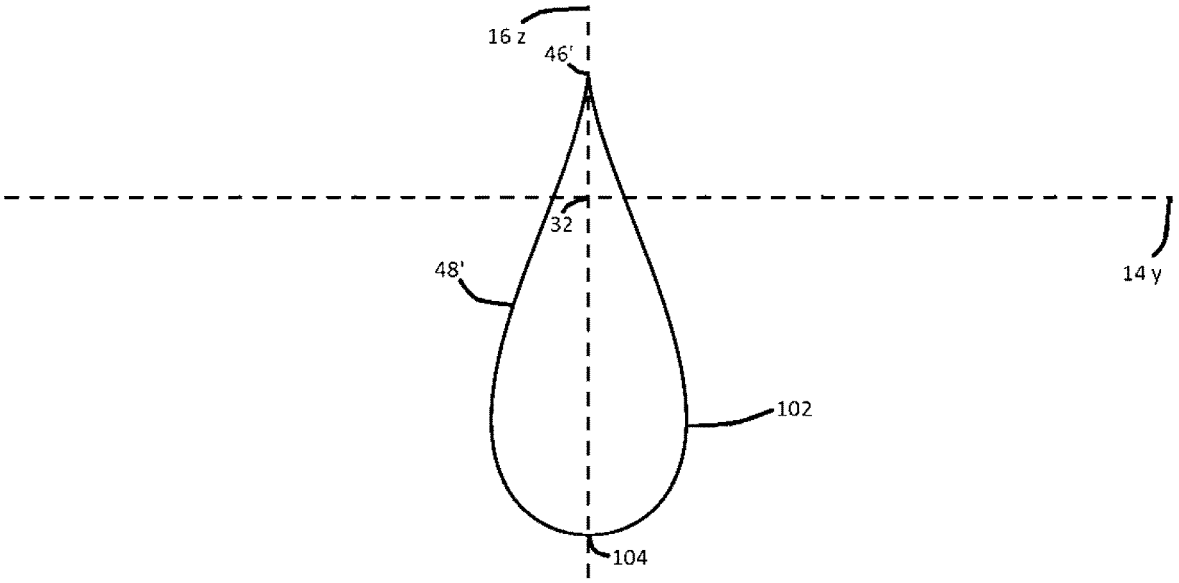
FIG. 5 is a top view of a teardrop base curve, understood to be positioned on the outer surface of a sphere.

As seen in FIG. 5, the teardrop base curve 102 may first be plotted on the Y-Z plane with the Z axis 16 shown vertically and Y axis 14 shown horizontally. The intersection point 32 of axes 22, 24 and axes 14, 16 is also shown, matching labels seen in FIGS. 1-4. This disclosure includes step-by-step examples using an alpha angle (i.e. a or p) with a value of 300 and reference angle a=p/2+90°=30°/2+90°=105°. However, it is to be understood that the alpha angle can vary significantly; typically, as much as between 0° and 60°. It should also be understood that very small alpha angles lead to relatively low power density compared to relatively high alpha angles. An alpha angle of 0 implies two collinear shafts where no expansion or compression work is done. However, excessively high alpha angles do cut a much larger amount of material out of the rotor shaft and therefore there is indeed an upper limit which is dependent on the operational conditions such as the pressure-induced and/or centrifugal loads expected. A certain minimum amount of material may be required on the rotor shaft to accommodate bearings and maintain adequate rigidity. The teardrop base curve 102 is produced from the above equation being plotted from 0°≤t≤360°, where the parameter t represents the rotation angle, θ, (FIG. 1). Along this path, 46' corresponds to both 0° and 360°, 48' corresponds to 90° and 104 corresponds to 180°. According to the right-hand rule of Cartesian coordinate systems, positive X values are out of the page. It is to be understood that the teardrop plotted in FIG. 5 consists of points with positive X values.

Figure 6:
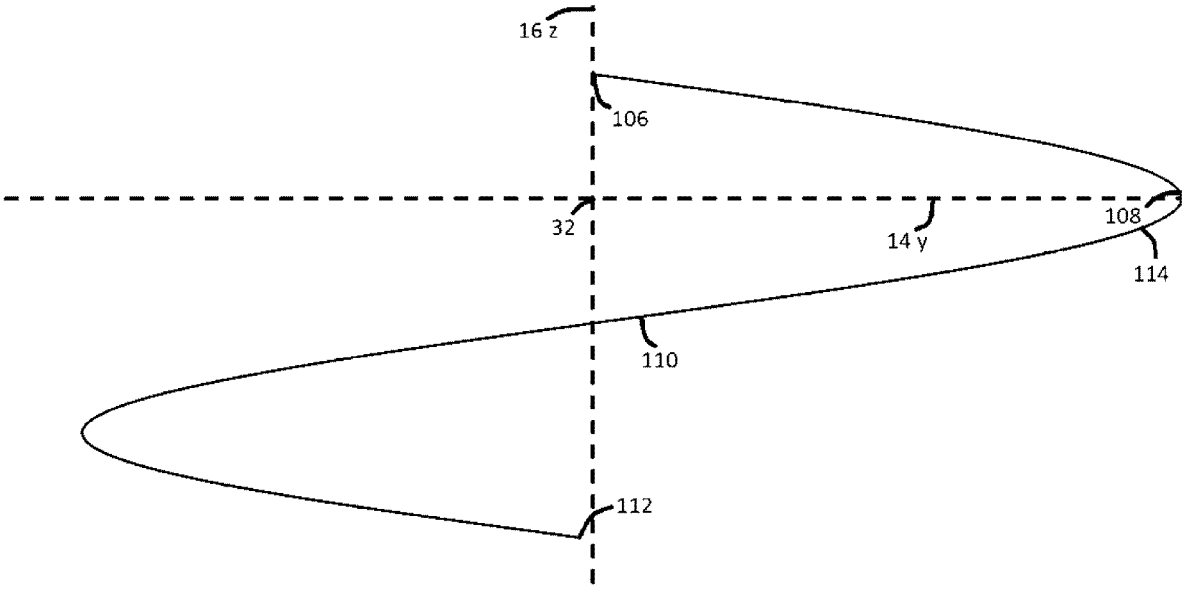
FIG. 6 is a top view of a helical involute understood to be positioned on the outer surface of a sphere.
Figure 7:
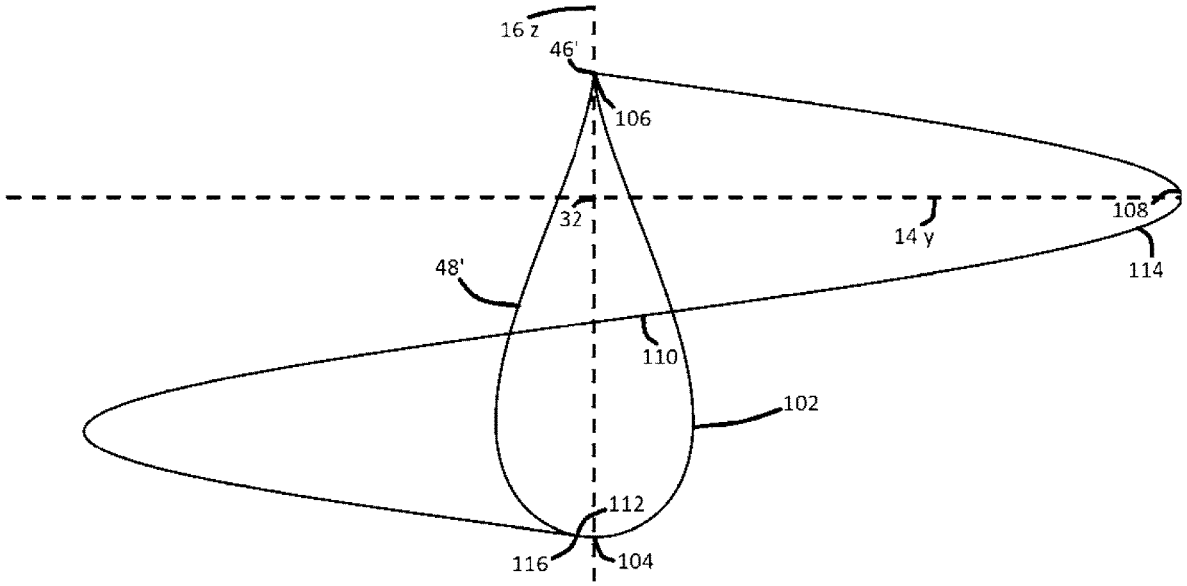
FIG. 7 is a top view of the teardrop base curve seen in FIG. 5 and the helical involute seen in FIG. 6.
Figure 8:
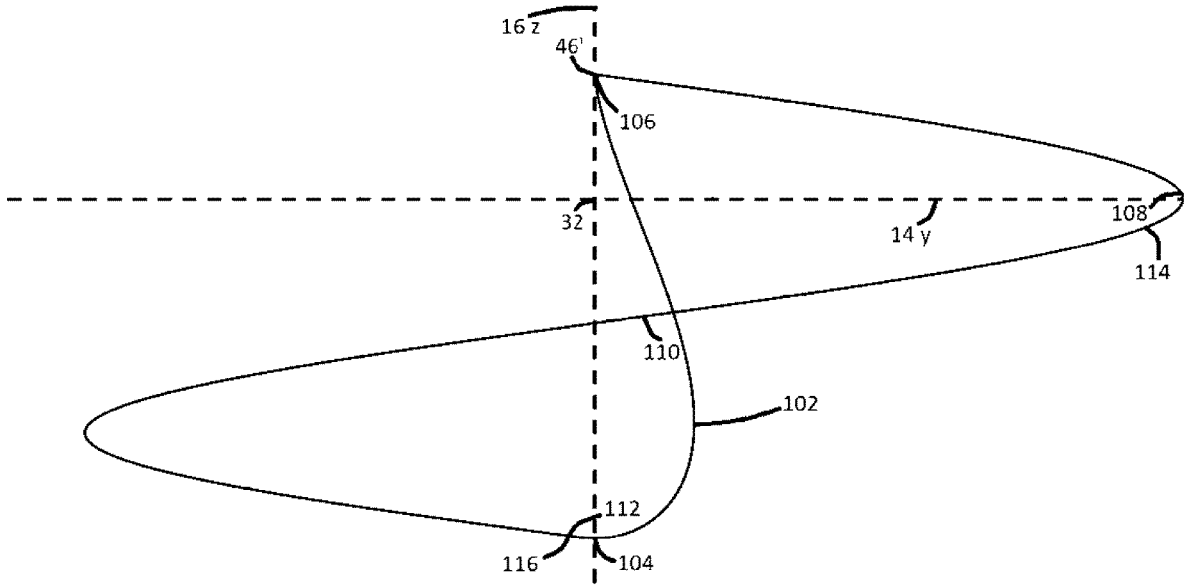
FIG. 8 is a top view of part of the teardrop base curve seen in FIG. 7 and the helical involute seen in FIG. 7.

A sharp lobe tip sawtooth geometry is comprised of intersecting teardrop and involute curves. For a basic sawtooth geometry, the Cartesian parameterization of a Spherical Helix equation is manipulated to plot the involute base curve 114 seen in FIGS. 6 to 7 with start point 106 and end point 112 coincident with respective points 46' and 116 on the teardrop base curve 102. It is to be understood that these curves are substantially tangent at the points 116 and 112, as can be seen in FIG. 8 after trimming was done. The "helical involute equation" used to plot the involute base curve 114 seen in FIGS. 6 to 7 will be denoted as follows:

$$\text{Helical Involute} = I_H(t) = \begin{bmatrix} I_{H,x}(t) \\ I_{H,y}(t) \\ I_{H,z}(t) \end{bmatrix}$$

The parameter "t" is typically used in parametric equations, but in the case of the involute curve 114, it does not represent the rotational position, theta (θ), seen in FIG. 1. Looking to the example seen in FIG. 7, the helical involute equation at t=0 (i.e. point 106) produces equivalent X, Y and Z coordinates as the teardrop equation at t=0 (i.e. point 46').

It is to be understood that a Total Sum of Squares (TSS) approach may be used, minimizing the result of the below TSS equation at points 46/106 and points 116/112.

$$TSS=(T_x(t=0)-I_{H,x}(t=0))^2+(T_y(t=0)-I_{H,y}(t=0))^2+(T_z(t=0)-I_{H,z}(t=0))^2+(T_x(t)-I_{H,x}(t))^2+(T_y(t)-I_{H,y}(t))^2+(T_z(t)-I_{H,z}(t))^2$$

While the TSS is being minimized at t=0 on both the teardrop equation and helical involute equation, the second desired location of coincidence is also included. It is to be understood that the value of R is equivalent in the teardrop equation and helical involute equation. It is good practice to set R=1 in both equations and also verify that all points of both equations indeed lie on the unit sphere, satisfying the basic equation shown below:

$$R=1=\sqrt{X^2+Y^2+Z^2}$$

Figure 9:
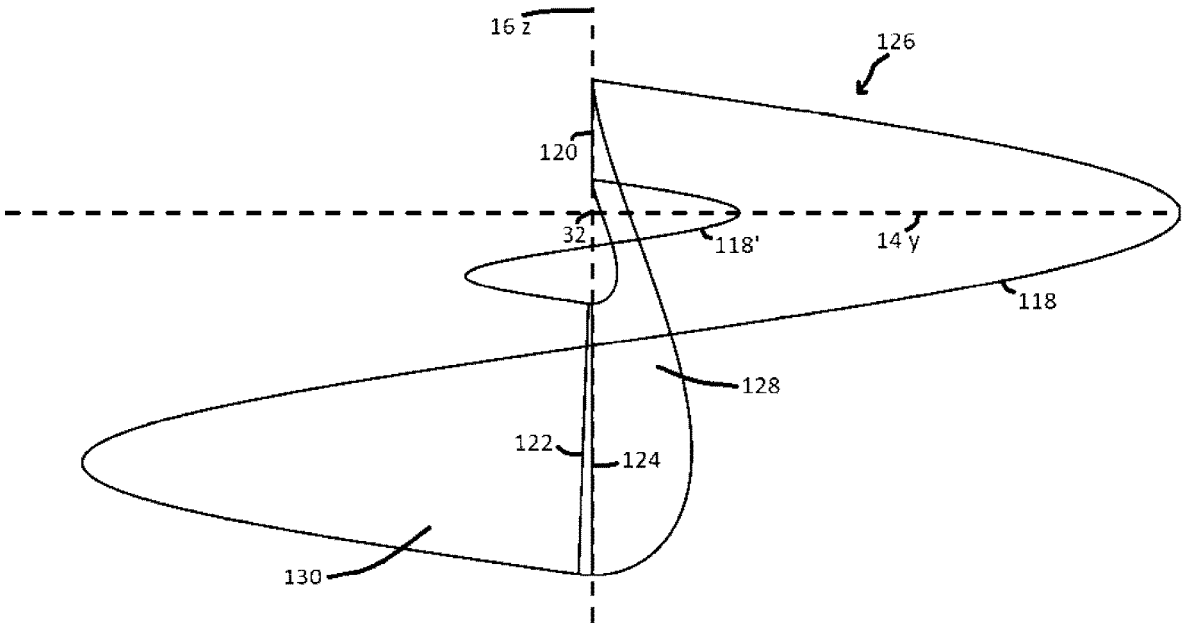
FIG. 9 is a top view of a partial wireframe model of a sharp lobe tip basic sawtooth one lobe rotor, including the partial teardrop base curve and helical involute seen in FIG. 8.

In this example, the input variables remain unchanged for varying values of R. As seen in FIGS. 8-9, the sawtooth rotor profile 118 is a curve comprised of a minimum of both a teardrop base curve 102 and an involute curve 114. In FIG. 9, it is to be understood that sawtooth rotor profile 118' has points lying on a sphere that is a smaller diameter than that shown in sawtooth rotor profile 118. Since a surface is a continuous set of points that has length and breadth, but no thickness, it is to be understood that an infinite number of sawtooth rotor profiles 118 with varying radius, R, would form a surface. Straight lines 120, 122 and 124 are shown to be collinear with the intersect point 32. These radial lines have ends terminating at curves 118 and 118'.

It will be appreciated by persons skilled in the art how to create surfaces from base curves. For example, a boundary surface may be created with curves 118 and 118' that would have points coincident with points on lines 120, 122 and 124. Alternatively, the radial line 120 could be swept along the path of 118/118' until it reaches it's starting position. Since curves 118/118' are on spheres concentric to the intersect point 32, lines 120, 122 and 124 are all equal length. It is also to be understood that an infinitesimally small value for the radius, R, used to generate sawtooth rotor profile 118' may be approximated as a point. However, the resulting sharp point lobe tip 138 of the rotor geometry 132 shown in FIG. 10 may be comparatively more difficult to manufacture and may allow the working fluid to leak from one chamber to another as a result of the increased difficulty in accurately manufacturing a rotor having a sharp point lobe tip. The sawtooth rotor surfaces 126 created by these methods is comprised of a teardrop surface 128, bound by lines/curves 120, 122, 118, 118' and an involute surface 130, bound by lines/curves 120, 122, 118, 118'.

Figure 10:
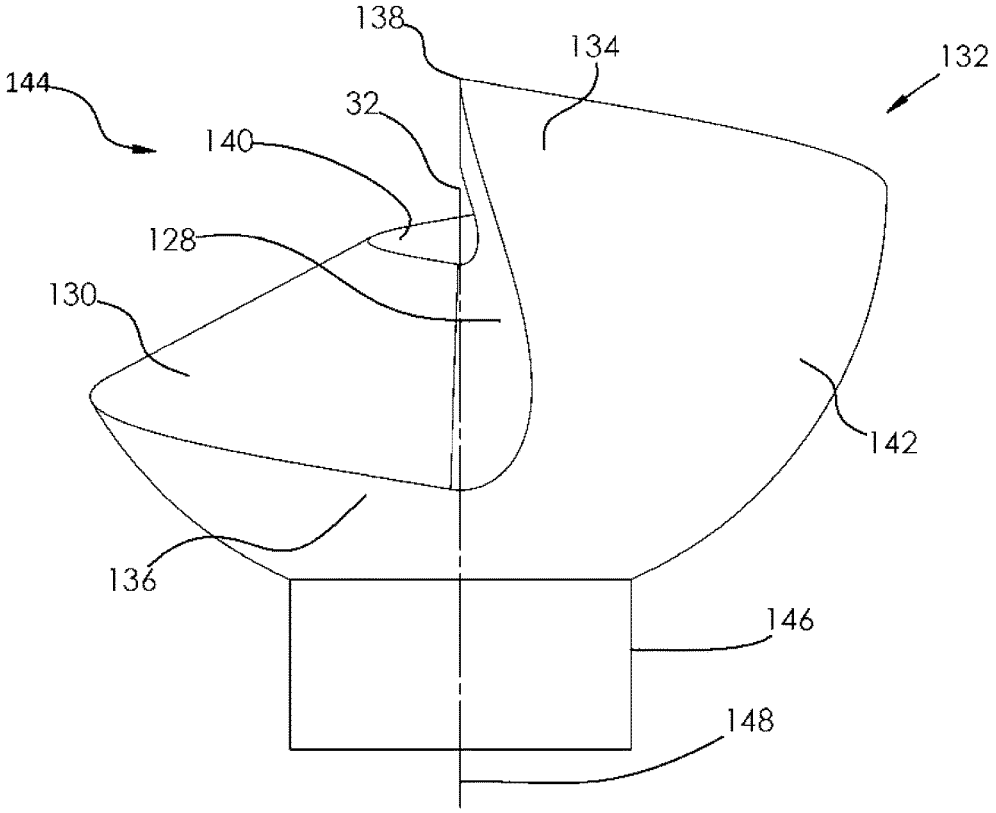
FIG. 10 is a top view of the sharp lobe tip basic sawtooth one lobe rotor, including some of the elements contained in FIG. 9.

It is to be understood that the sharp lobe tip sawtooth geometry 132 seen in FIG. 10 contains the sawtooth rotor surfaces 126 seen in FIG. 9. The sawtooth geometry is comprised of lobe(s) 134 and valley(s) 136. The lobe tip 138 may be considered sharp when it consists of a single line 120. Frusto-spherical inner surface 140 and frusto-spherical outer surface 142 also define the sawtooth geometry 132. A first rotor 144 may comprise of a radially extended member defining the first rotor shaft 146, which is understood to be substantially concentric with both the Z axis 16 and first rotational axis 148.

Figure 11:
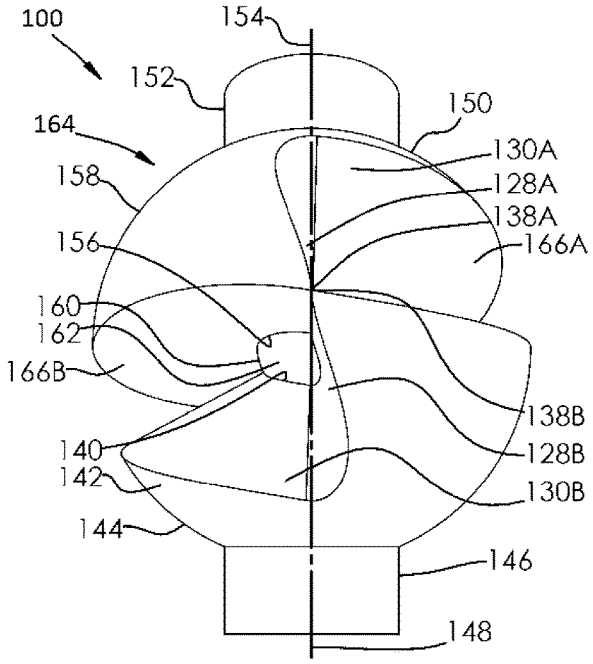
FIG. 11 is a top view of two of the rotors seen in FIG. 10 to form an example sawtooth assembly, with rotors in a 180° rotational position.

The second rotor 150 (i.e. See FIG. 11) may be generated with the same methodology used to generate the first rotor 144. In one example, the second rotor shaft 152 may be identical to the first rotor shaft 146 and the rotors may be substantially identical. It is to be understood that, in this example, the second rotational axis 154 is substantially concentric to the second rotor shaft 152. The alpha angle, denoted as a or p, is understood to be the offset angle from being co-linear between the intersecting axes 148 and 154 (See FIG. 26) when the rotors are meshed appropriately as seen in FIG. 11. It will be appreciated that a housing (not shown) and bearings (not shown) would be used to substantially maintain the concentricity of surfaces and the alpha angle. The second rotor 150 may also comprise frusto-spherical inner surface 156 and frusto-spherical outer surface 158. An inner ball 160 with frusto-spherical outer surface 162 may be used to fill the void defined by the frusto-spherical inner surfaces 140/156. In one example, a rotor 144/150 may lack frusto-spherical inner surfaces 140/156 and instead contain the frusto-spherical outer surface 162 that would otherwise be on the separate inner ball 160 component. It is believed that this factor may lead to more expensive production costs and potentially increase leakage when attempting to minimize the radius left from machining and ideally match it to the other rotor. The sawtooth assembly 164 is understood to have interposing lobes 134 and valleys 136, with chambers 166 defined therebetween.

Maintaining a front view of the first rotor 144, it may be seen in FIGS. 11-14 how the lobe tip 138A of the second rotor traces the outline of the teardrop surface 128B in respectively sequential rotational positions. Simultaneously, the lobe tip 138B of the first rotor 144 traces the outline of the teardrop surface 128A on the second rotor 150. Through the progression of one full rotation, it may be seen that the lobe tips 138 A/B and respective opposing teardrop surfaces 128 B/A maintain close contact. Likewise, opposing involute surfaces 130A and 130B maintain close contact.

Figure 12:
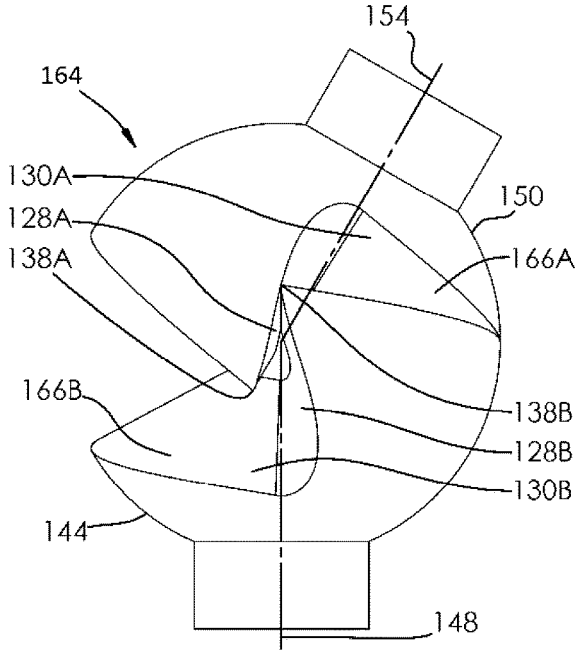
FIG. 12 is a side view of the components seen in FIG. 11, with rotors in a 270° rotational position.
Figure 13:
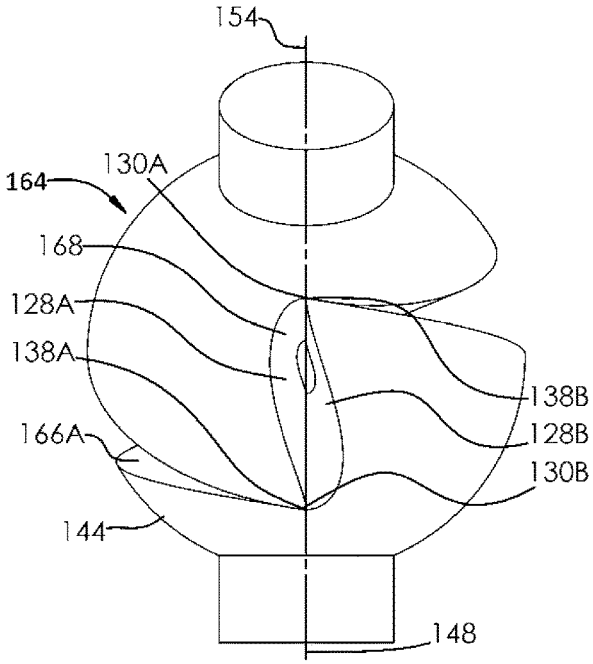
FIG. 13 is a bottom view of the components seen in FIG. 11, with rotors in a 360° rotational position.
Figure 14:
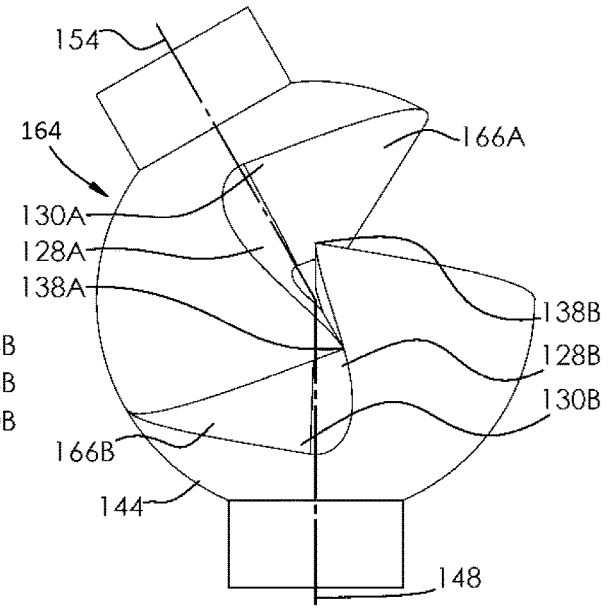
FIG. 14 is a side view taken from the opposing side seen in FIG. 12 of the components seen in FIG. 11, with rotors in a 90° rotational position.

The sawtooth assembly 164 seen in FIG. 13 is said to be in a first rotational position because the chamber 166A is at the maximum possible volume. The teardrop volume 168 seen at this particular rotational position is not useful in contributing to compression or expansion work. In the case of a compressor, FIG. 14 represents a second rotational position, where chamber 166A has decreased in volume. Chamber 166B represents a new volume that is formed. Next, FIG. 11 represents a third rotational position where chamber 166A and chamber 166B are substantially identical in volume. In FIG. 12, it can be seen in a fourth rotational position where chamber 166B has become comparably much larger than the decreasing volume of chamber 166A. This chamber 166A volume becomes substantially zero just prior to the position seen in FIG. 13 and chamber 166B from FIG. 12 may be renamed as chamber 166A in FIG. 13 to repeat the process. In this example, a full 360° of shaft rotation is required for the simultaneous intaking of a working fluid via chamber 166B and discharging of a working fluid in chamber 166A.

It is commonly understood that a video consists of a series of frames/images that are sequentially displayed. The function of a compressor was explained by studying FIGS. 13, 14, 11, 12 and 13 in that respective order. It is to be understood that the Rotary Positive Displacement Device 100 may be reversibly operated as an expander by studying FIGS. 13, 12, 11, 14 and 13 in that respective order. In this manner, a chamber 166A increases in volume as it is filled with a comparably high pressure working fluid. At some point, the chamber 166A would be sealed to capture additional work as the working fluid expands, prior to being released.

The views seen in FIGS. 11-14 are complimentary to understanding the position of the second rotor 150 relative to the first rotor 144. If the first rotor 144 were not allowed to rotate relative the housing (not shown), then the motion of the second rotor would follow a nutating motion with the second rotational axis 154 sweeping to form a conical shape. If both the housing (not shown) and first rotor 144 were stationary, then it is expected that valves would be required. Additionally, the nutating motion of the second rotor 150 may increase the total loads that the bearings (not shown) would react. As a preferred mode of operation, both the first rotor 144 and second rotor 150 rotate about their respective axes 148/154 inside of a stationary housing (See FIG. 92). When studying FIGS. 11-14, it is therefore implied that the viewer is also rotating with the first rotor 144. To be clear, the axes 148/154 do not re-position inside of the stationary housing during operation of the rotary positive displacement device 100. This is a fundamental difference between a rotary and nutating positive displacement device with sawtooth rotors.

As can be seen in FIG. 11, lobe tips 138A and 138B form part of the seal required for chambers 166A and 166B. In FIG. 12, lobe tip 138B and teardrop surface 128A form a seal. Some applications may not require as proficient sealing methods as other applications, and as mentioned, sharp lobe tips such as lobe tips 138A/B may not provide as good of a seal as compared to some of the other geometries described in the present disclosure. One potential issue of sharp lobe tips is that contact between the sharp lobe tip and the opposing surface may lead to excessive Hertzian contact stresses and wear may render the seal unviable over time. However, as mentioned, sharp lobe tips may be suitable for some applications, such as where tight seals are not required and torque transfer between sharp lobe tips with teardrop surfaces is low enough to avoid excessive Hertzian contact stresses.

Round Lobe Tip Basic Sawtooth Geometry—One Lobe with Helical Involute

An offsetting method is required to prepare round lobe tip sawtooth geometry. The below method was discovered.

First, a normal vector is obtained as a function of parameter t along the teardrop equation, T(t). It is to be understood, that if a variable, "u", is an infinitesimally small value, then the parameter t in the teardrop equation may be replaced with t+u or t−u without resulting in a significant deviation from the intended offset curve. It is also to be understood that every point in the teardrop equation, T(t), can also represent a vector of length R that originates from the intersect point 32 at the origin. In this manner, T(t+u) and T(t−u) may appear to be nearly co-linear, but they are not. It will be understood that the cross product of two vectors will produce a vector that is orthogonal to each of the two vectors per the right-hand rule. Using the below mathematics will produce a normal vector, N, that is normal to the teardrop curve at any value of t.

$$\overrightarrow{N(t)} = \begin{bmatrix} N_x \\ N_y \\ N_z \end{bmatrix} = \frac{\overrightarrow{T(t+u)} \times \overrightarrow{T(t-u)}}{\|\overrightarrow{T(t+u)} \times \overrightarrow{T(t-u)}\|}$$

It is to be noted that 'u' is an infinitesimally small positive value for the offset teardrop base curve 170 to be larger than the teardrop base curve 102 (See FIG. 15) with the above formula. The cross product is anti-commutative, so using a negative value for u or reversing the +/−signs in the equation can easily be corrected by multiplying the normal vector by −1. Note that up until this point, the R terms in equations have been dropped to work with unit spheres, where the X, Y and Z points of each equation may be checked against the below equation:

$$R=1=\sqrt{X^2+Y^2+Z^2}$$

Figure 15:
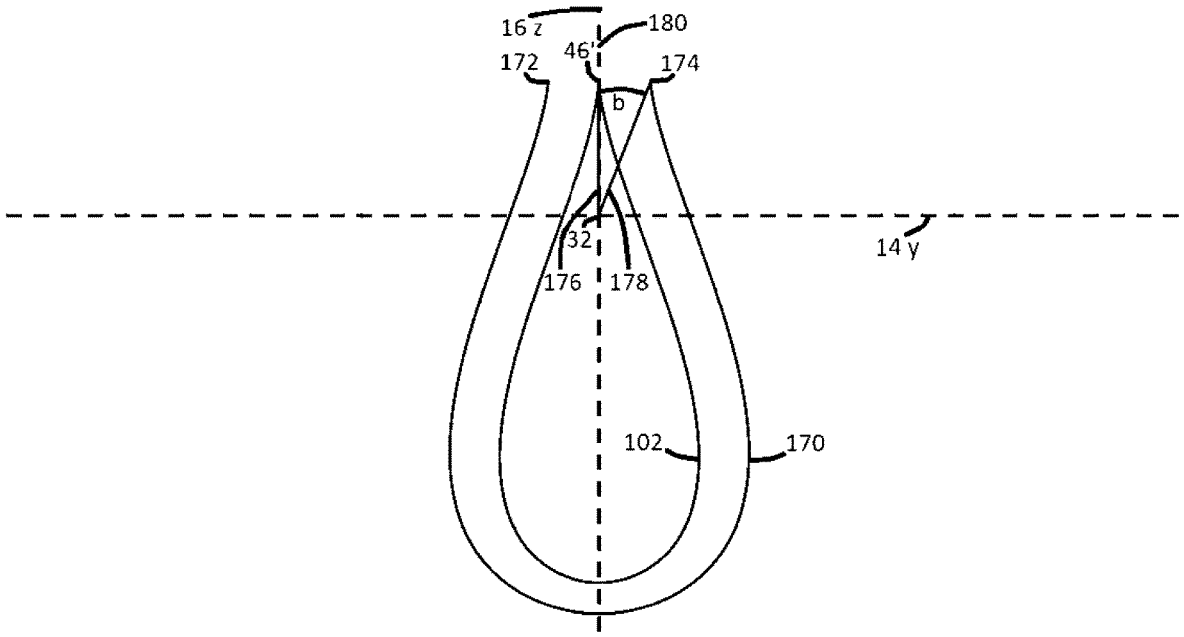
FIG. 15 is a top view of the teardrop base curve seen in FIG. 5, including an offset teardrop base curve.

A variable, 'b' is the desired offset angle. In the examples shown herein, $$b = \frac{5°\pi}{180°}$$

rad. As seen in FIG. 15, if a vector 176 is drawn from the intersect point 32 to the point 46' on the teardrop base curve 102 and a vector 178 is drawn from the intersect point 32 to the point 174 on the offset teardrop base curve 170; the angle between these vectors has a value of b. It was discovered that the below equation can be used to plot the offset teardrop base curve 170 from $0<t<2\pi$:

$$\text{Offset Teardrop} = T_o(t) = \begin{bmatrix} T_{o,x} \\ T_{o,y} \\ T_{o,z} \end{bmatrix} = \begin{bmatrix} R(\cos(b)T_x + \sin(b)N_x \\ R(\cos(b)T_y + \sin(b)N_y) \\ R(\cos(b)T_z + \sin(b)N_z) \end{bmatrix}$$

Keeping R=1 will keep all of the points of the offset teardrop base curve 170 on the unit sphere as follows:

$$\text{Offset Teardrop} = T_o(t) = \begin{bmatrix} T_{o,x} \\ T_{o,y} \\ T_{o,z} \end{bmatrix} = \begin{bmatrix} (\cos(b)T_x + \sin(b)N_x) \\ (\cos(b)T_y + \sin(b)N_y) \\ (\cos(b)T_z + \sin(b)N_z) \end{bmatrix}$$

This equation in plotted in FIG. 15. Using the methods herein, a single point 180 may be plotted at t=0 and t=2π that would still lie on the X-Z Plane, but it is not necessary to plot this point or to draw an arc path to complete the offset around the teardrop base curve 102. Since point 180 is not plotted, it is to be understood that points 172 and 174 have the maximum expected value of Z and only the portion of the offset teardrop base curve 170 between points 172 and 174 is plotted. Point 172 corresponds to a value of t that is small, but larger than 0, while point 174 corresponds to a much larger value of t that is less than 2π.

Figure 16:
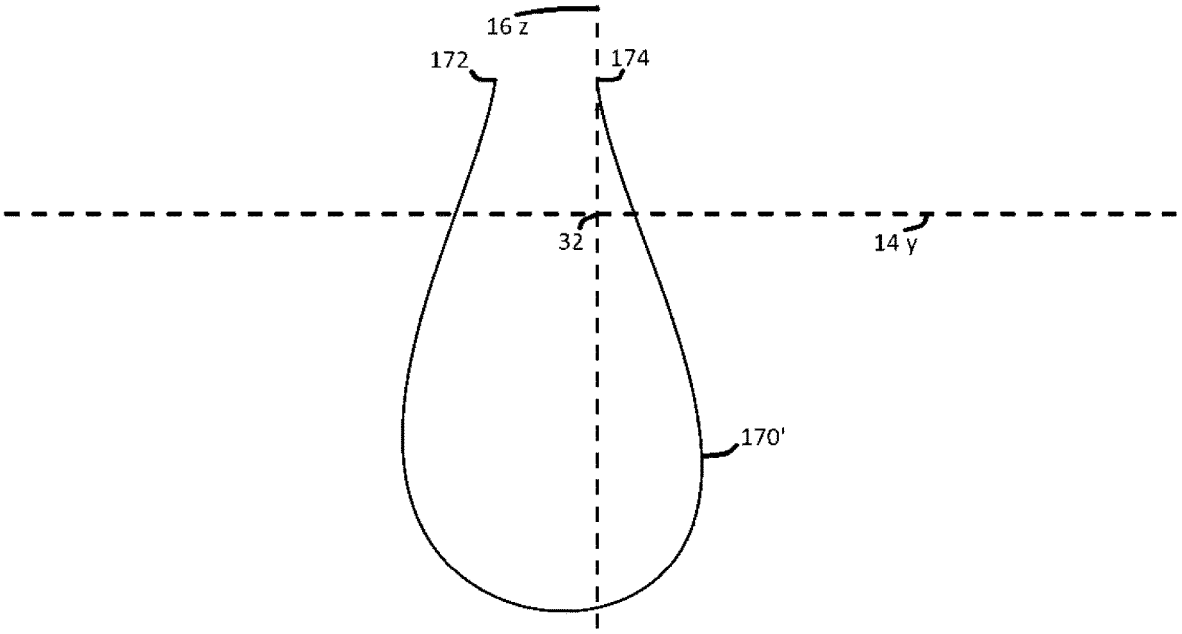
FIG. 16 is a top view of a shifted offset teardrop base curve.

Next, a vector rotation of "−e" about the Z axis is applied to the offset teardrop base curve 170 until the point 174 lies on the X-Y Plane as shown in FIG. 16. The mathematics of the shifted offset teardrop base curve 170' are shown below:

$$\text{Shifted Offset Teardrop} = T_{so}(t) = \begin{bmatrix} T_{so,x} \\ T_{so,y} \\ T_{so,z} \end{bmatrix} = \begin{bmatrix} \cos(-e) & -\sin(-e) & 0 \\ \sin(-e) & \cos(-e) & 0 \\ 0 & 0 & 1 \end{bmatrix}$$

$$\begin{bmatrix} R(T_{o,x}) \\ R(T_{o,y}) \\ R(T_{o,z}) \end{bmatrix} = \begin{bmatrix} R(\cos(e)T_{o,x} + \sin(e)T_{o,y}) \\ R(\cos(e)T_{o,y} - \sin(e)T_{o,x}) \\ R(T_{o,z}) \end{bmatrix}$$

Plotting on a unit sphere, the shifted offset teardrop equation is written as follows:

$$\text{Shifted Offset Teardrop} = T_{so}(t) =$$

$$\begin{bmatrix} T_{so,x} \\ T_{so,y} \\ T_{so,z} \end{bmatrix} = \begin{bmatrix} \cos(-e) & -\sin(-e) & 0 \\ \sin(-e) & \cos(-e) & 0 \\ 0 & 0 & 1 \end{bmatrix} \begin{bmatrix} (T_{o,x}) \\ (T_{o,y}) \\ (T_{o,z}) \end{bmatrix} = \begin{bmatrix} (\cos(e)T_{o,x} + \sin(e)T_{o,y}) \\ (\cos(e)T_{o,y} - \sin(e)T_{o,x}) \\ (T_{o,z}) \end{bmatrix}$$

Those skilled in the art would appreciate how to connect the offset involute base curve 184 and teardrop base curve 170' with a tangent arc to produce the constant radius circular arc 200, trimming as appropriate. Another methodology is required to be able to vary the radius of the circular arc between the offset involute base curve 184 and teardrop base curve 170', if desired. For example, see FIGS. 17 to 18.

The intersection of a plane with a sphere result in the formation of a circle and a portion of the circumference of a circle may be referred to as an arc. In FIG. 15, a radial line 178 of length R=1 was seen to connect the non-shifted end position of the offset teardrop base curve 170. This same radial line 178 can be seen in FIG. 18 relative to the shifted offset teardrop base curve 170'. The point 198 exists on radial line 178 at a distance of cos(b)*R from intersect point 32. To be clear, the value of R is the radius of the sphere, and length of line 178, which is R=1 in the example provided. It is to be understood that a plane may be drawn that is perpendicular to radial line 178 while passing through point 198 and the circular arc 200. Persons skilled in the art would appreciate how to plot the circular arc 200 and trim the offset involute base curve 184 to achieve tangency at the respective points 202 and 204. It is to be understood that when the variable b is a constant function of parameter t when offsetting the teardrop base curve 102, for example as seen in FIG. 15, then this constant radius offset is preferably accompanied by a constant radius circular arc 200 so that the resulting lobe tip and teardrop surface will remain in close contact across varying rotational positions, as will be demonstrated herein.

Figure 18:
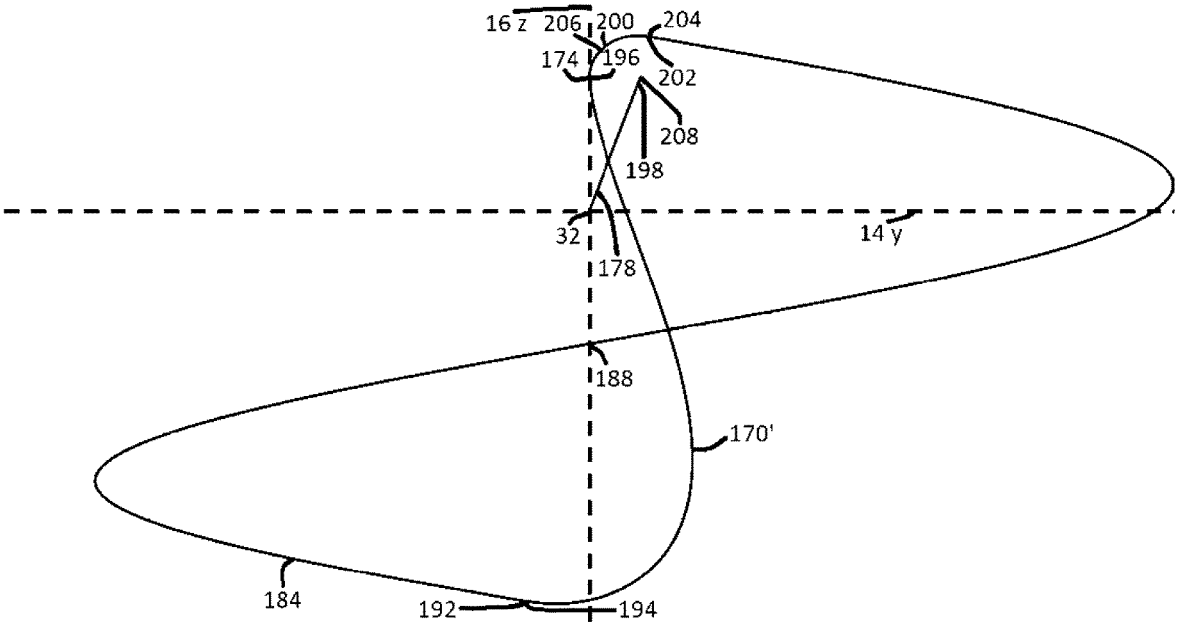
FIG. 18 is a top view of a partial wireframe model of a round lobe tip basic sawtooth one lobe rotor with some of the curves seen in FIG. 17, including a circular arc at the lobe tip.

In the example seen in FIG. 18 a constant radius circular arc 200 was plotted. A plane may be written in the following form:

$$N_x(X-X_p)+N_y(Y-Y_p)+N_z(Z-Z_p)=0$$

In this form, $N_x$, $N_y$ and $N_z$ represent the respective X, Y and Z components of the vector normal to the plane. The length of this normal vector is not important, so for convenience, the respective $N_x$, $N_y$ and $N_z$ terms may be replaced with the X, Y and Z coordinates of point 198. The respective X, Y and Z coordinates of any point on the plane may be used for $X_p$, $Y_p$ and $Z_p$, but it is intuitive to select point 174 of the shifted offset teardrop base curve 170' (See FIG. 16), which is also understood to be a point on the unit sphere.

A vector may be defined as the subtraction of one point relative to another. In this example, a normal unit vector may be defined using the X, Y and Z coordinates of a point 206 on circular arc 200 minus the X, Y and Z coordinates of point 208 at the end of line 178. It is to be understood that a table of normal unit vectors may be plotted as the point 206 is moved from the location of point 196 along the circular arc 200 to the point 202. In this manner, the point 208 may be offset by an angle of b to produce the circular arc 200. It is to be understood that the value of b could be varied at varying positions of point 206 to produce a circular arc 200 with varying radius. It is to be understood that a plurality of points can be defined in this manner and continuously pieced together with continuity. The terms "spline" or "spline curve", used interchangeably herein are used herein to define the construction of a curve which closely follows a sequence of points. Mathematically, a spline curve may consist of a piecewise combination of a plurality of polynomials. In one example, the spline curve may consist of circular arcs and line segments. In another example, the spline curve may consist of a single circular arc. In the below equation, the respective X, Y and Z coordinates of point 208 on the unit sphere are represented by $G_x$, $G_y$ and $G_z$.

$$\text{Circular Arc} = A(t) = \begin{bmatrix} A_x \\ A_y \\ A_z \end{bmatrix} = \begin{bmatrix} R(\cos(b)G_x + \sin(b)N_x) \\ R(\cos(b)G_y + \sin(b)N_y) \\ R(\cos(b)G_z + \sin(b)N_z) \end{bmatrix}$$

It is to be understood that points from the teardrop base curve 102 in FIG. 15 were offset in the same manner. If a circular arc 200 of non-constant radius is used, and close contact is desired between the lobe tip and teardrop surface, then it may be necessary to vary the offset angle b along the teardrop base curve 102 while the offset method is used. In this manner, the offset angle b would vary as parameter t is varied.

Figure 19:
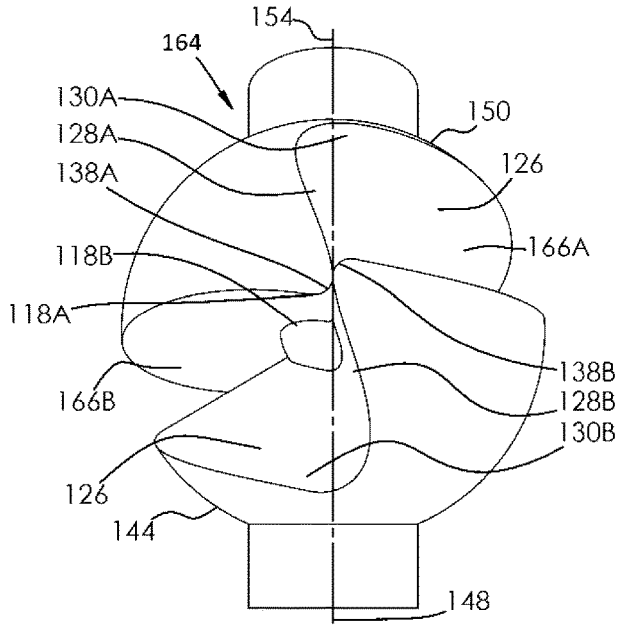
FIG. 19 is a top view of some of the elements seen in FIG. 18, to form an example sawtooth assembly, with rotors in a 180° rotational position.
Figure 23:
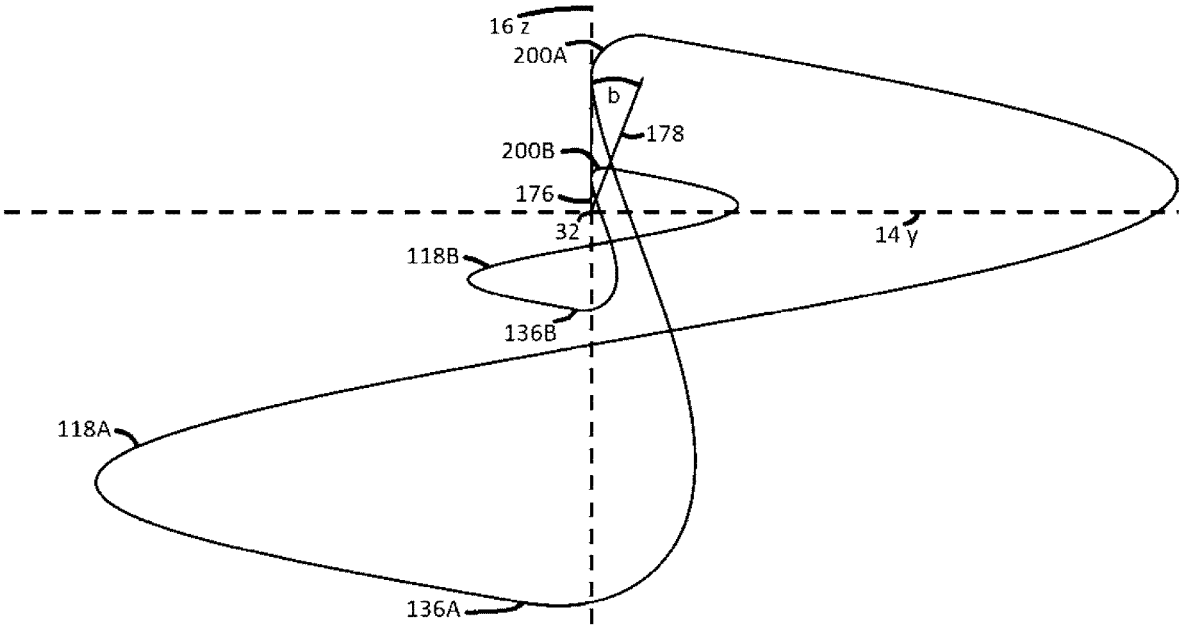
FIG. 23 is a top view of a partial wireframe model of the example round lobe tip basic sawtooth one lobe rotor seen in FIG. 18, including additional elements.

The sawtooth assembly 164 seen in FIG. 19 has first rotor 144 and second rotor 150 constructed with the same input variables used in FIG. 18. In the example seen in FIG. 19, the sawtooth rotor surfaces 126 are constructed by radially scaling the shifted offset teardrop base curve 170' and involute base curve 184 plotted on a unit sphere in FIG. 18. The sawtooth rotor profiles 118 A/B seen in FIG. 23 show the respective outer and inner curves of the sawtooth rotor surfaces 126 in FIG. 19. FIGS. 19-22 show the sawtooth assembly at varying rotational positions. As seen in FIG. 23, the same value of the offset angle b was used for the respective outer and inner sawtooth rotor profiles 118A/B. In this manner, the arc length of the circular arc 200A is clearly larger than the arc length of the circular arc 200B. A comparably smaller diameter machining tool is required to access the inner valley 136B compared to the outer valley 136A. In some scenarios, using smaller machining tools may noticeably increase machining costs, leading to a practical minimum inner diameter when using a constant offset angle b.

Figure 20:
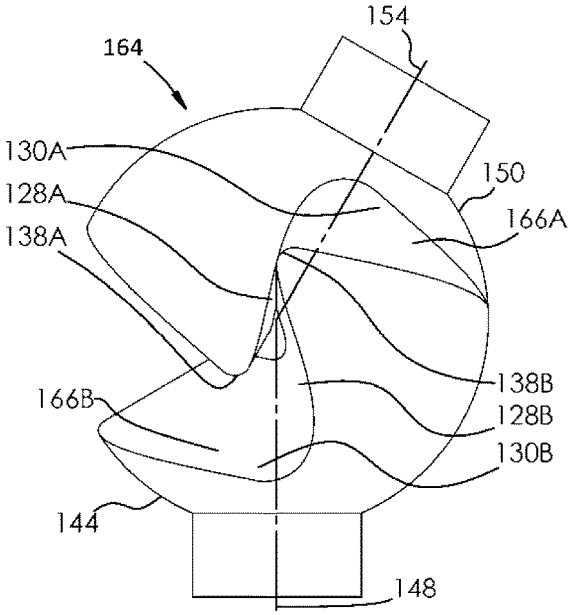
FIG. 20 is a side view of the components seen in FIG. 19, with rotors in a 270° rotational position.
Figure 21:
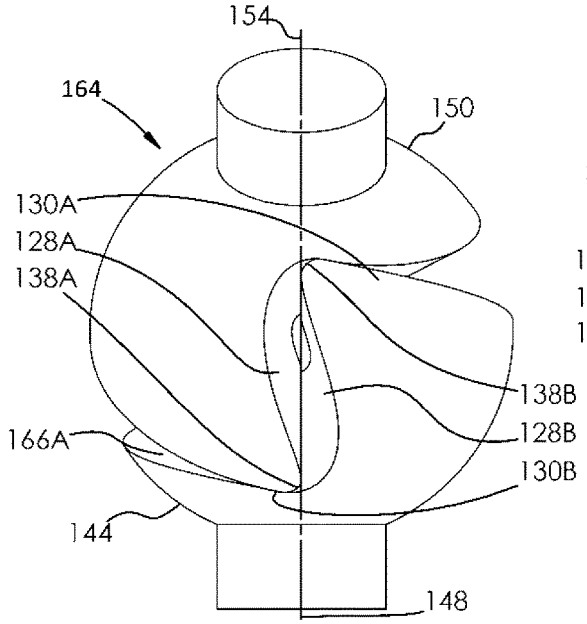
FIG. 21 is a bottom view of the components seen in FIG. 19, with rotors in a 360° rotational position.
Figure 22:
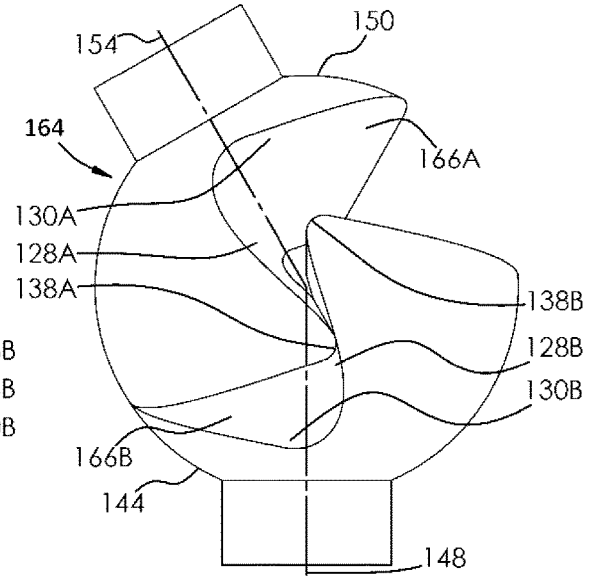
FIG. 22 is a side view taken from the opposing side seen in FIG. 20 of the components seen in FIG. 19, with rotors in a 90° rotational position.

Some differences between the round lobe tip geometry example seen in FIG. 20 and the sharp lobe tip geometry seen in FIG. 12 are compared as follows. In one example, the working fluid in chamber 166A is at a relatively higher pressure than a working fluid at chamber 166B for FIG. 12 and FIG. 20. If lobe tip 138B is not in contact with teardrop surface 128A, a gap exists to allow a non-zero amount of working fluid to pass from chamber 166A to chamber 166B over a finite time period. It should be noted that the amount of leakage when calculated as a percentage of total volumetric throughput may be relatively low in many examples, but a relative comparison to the performance can be made for equivalent variables. The round lobe tip geometry (see FIG. 20) has relatively smaller gap heights adjacent to the minimum gap where near contact occurs in this example when compared to the sharp lobe tip geometry (see FIG. 12). Therefore, even if the sharp lobe tip geometry does not experience significant wear, round lobe tip geometry is expected to have superior sealing capabilities.

Figure 24:
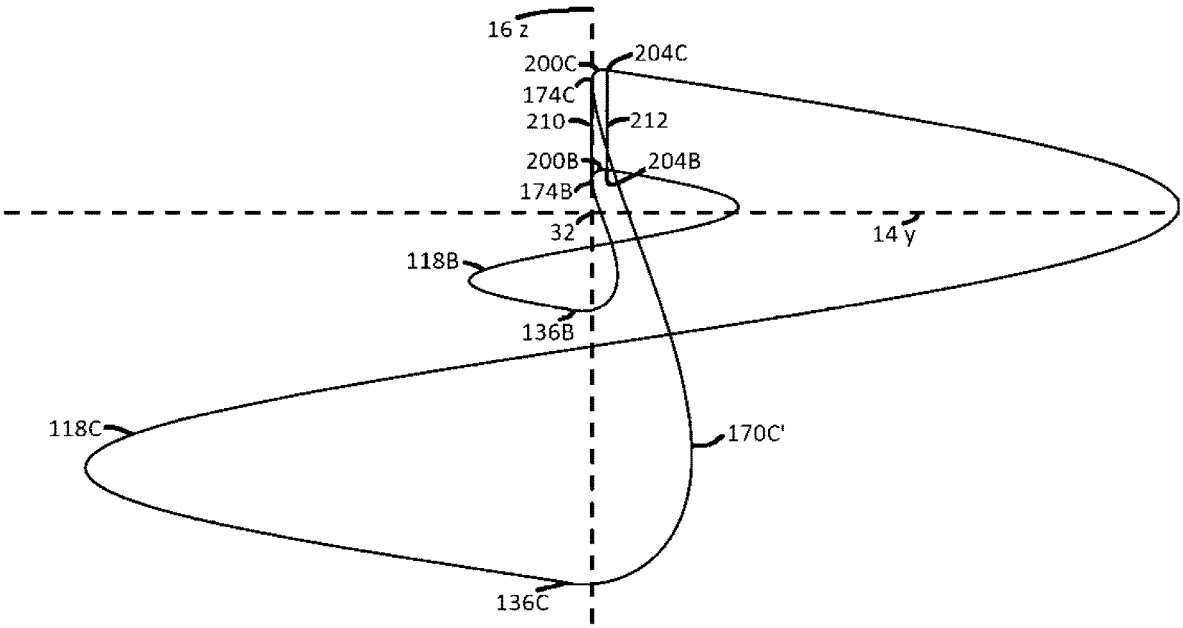
FIG. 24 is a top view of a partial wireframe model of a constant radius lobe tip basic sawtooth one lobe rotor.
Figure 25:
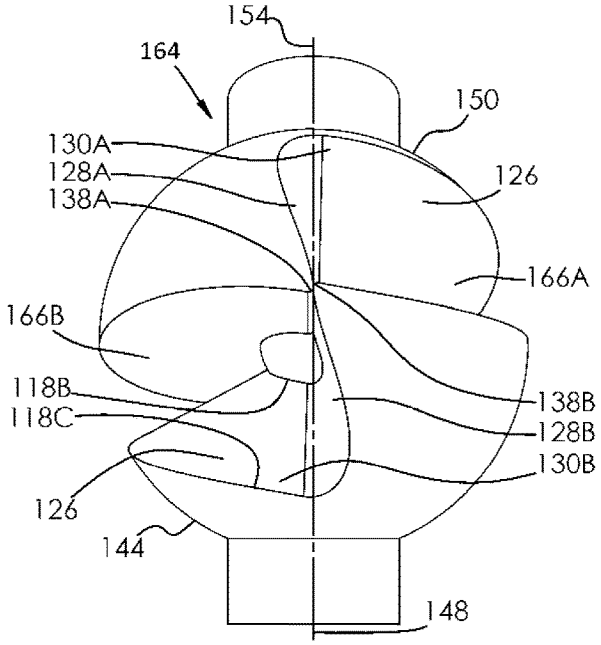
FIG. 25 is a top view of some of the elements seen in FIG. 24, to form an example sawtooth assembly, with rotors in a 180° rotational position.

Constant Radius Round Lobe Tip Basic Sawtooth Geometry—One Lobe with Helical Involute It is to be understood that the offset angle b could vary at every value of the spherical radius, R. In one example it may be shown how the lobe tip itself could have a constant radius. As seen in FIG. 24, the arc length of circular arc 200B/200C are substantially equivalent. The circular arcs 200B seen in FIG. 23 and FIG. 24 are also substantially equivalent, both of which were created with an offset angle of b=5°. Looking to FIG. 24, the (shifted) offset teardrop base curve 170C' was plotted at a spherical radius that is approximately 4× larger compared to spherical radius of profile 118B. An offset angle of b=1.25° was chosen for the profile 118C shown in FIG. 24, which is 4× smaller than the offset angle of b=5° that is used for the sawtooth rotor profile 118B shown in FIG. 24. Straight line 210 connects points 174B and 174C. Line 212 is substantially parallel to line 210. Line 212 originates at point 204B and terminates at point 204C, which is set to be at the same spherical radius, R, as the (shifted) offset teardrop base curve 170C'. The same TSS approach is used, adding the X, Y and Z coordinates of point 204C as an additional constraint. The sawtooth rotor profiles 118B and 118C seen in FIG. 24, are also labeled in FIG. 25. In FIGS. 25-28, the sawtooth assembly 164 can be seen in varying rotational positions.

Figure 26:
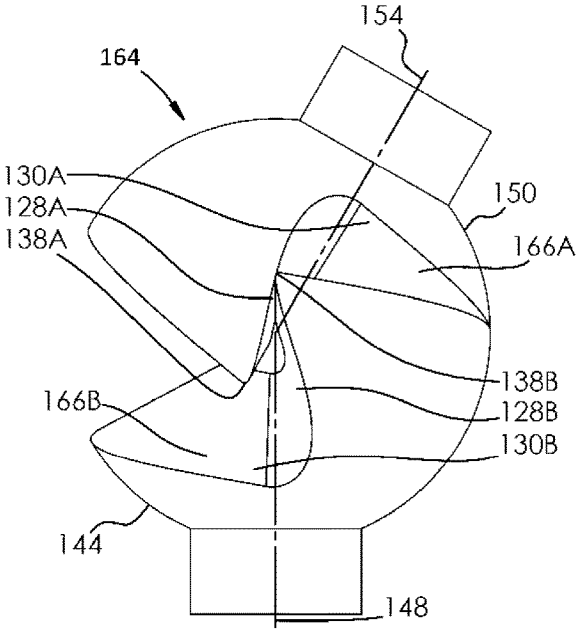
FIG. 26 is a side view of the components seen in FIG. 25, with rotors in a 270° rotational position.
Figure 27:
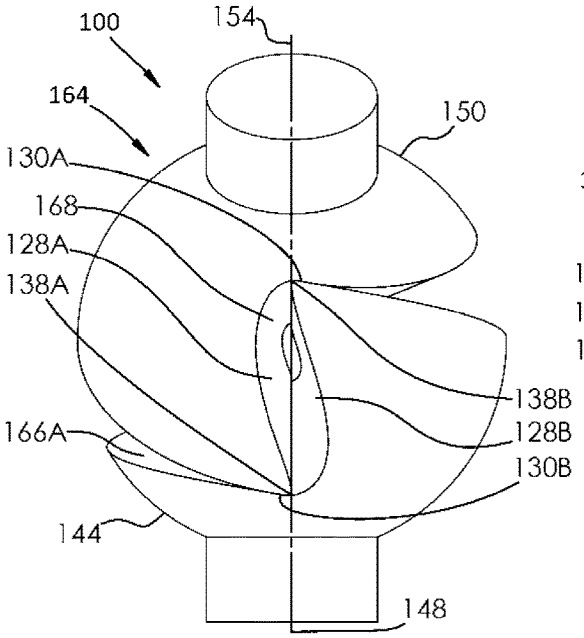
FIG. 27 is a bottom view of the components seen in FIG. 25, with rotors in a 360° rotational position.
Figure 28:
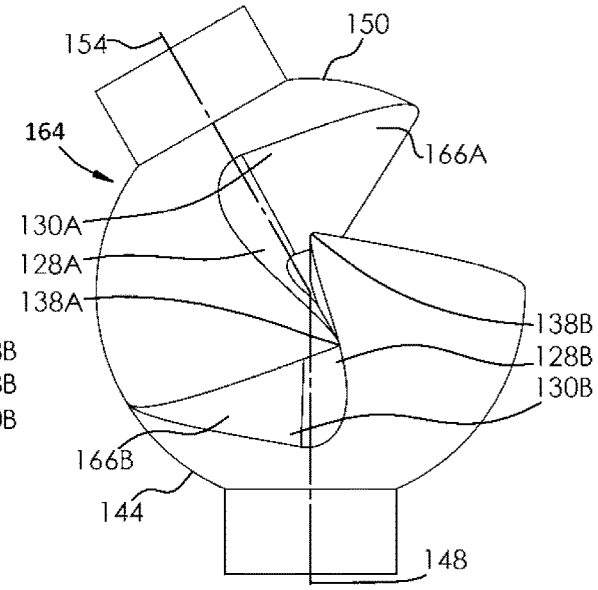
FIG. 28 is a side view taken from the opposing side seen in FIG. 26 of the components seen in FIG. 25, with rotors in a 90° rotational position.

A sawtooth geometry with only one Lobe is expected to be the most efficient in many applications because the pressure in the teardrop volume 168 in FIG. 27 is substantially equivalent to the pressure at the low pressure side of the Rotary Positive Displacement Device 100. This is the case for either a compressor or an expander. In compression mode, chamber 166B in FIG. 26 would be intaking from the low pressure side, immediately before being split into chamber 166A and teardrop volume 168 in FIG. 27. Moments later, the teardrop volume 168 combines with chamber 166A in FIG. 28, when both chambers are at a pressure substantially equivalent to the low pressure side of the Rotary Positive Displacement Device 100. In expansion mode, the Rotary Positive Displacement Device 100 is reversibly operated, so FIGS. 26-28 are studied in the reverse order. Chamber 166A in FIG. 28 loses the teardrop volume 168 in FIG. 27, while both of these volumes are at a pressure substantially equivalent to the low pressure side of the Rotary Positive Displacement Device 100. The updated chamber 166A in FIG. 27 is at relatively low pressure when combined with the substantially same pressure teardrop volume 168 in FIG. 27. This combined chamber is labeled as chamber 166B in FIG. 26. When using more than one lobe the teardrop volume 168 may introduce noticeable losses, since the pressure will be somewhat higher than the pressure at the low pressure side of the Rotary Positive Displacement Device 100. In compression mode, this means that some amount of gas was compressed and then allowed to expand back down to the low pressure side. In expansion mode, this means that some amount of gas stopped contributing to useful work prematurely. Both introduce some efficiency penalty albeit typically the penalty is acceptable since the pressure in the teardrop volume 168 is typically much closer to the pressure at the low pressure side than the high pressure side of the Rotary Positive Displacement Device 100.

Round Lobe Tip Basic Sawtooth Geometry—Three Lobe with Helical Involute

As discussed above, the one lobe geometry is simple and efficient, but the asymmetry does introduce dynamic imbalance that should be addressed in high horsepower applications. That is, relatively large rotors spinning relatively fast may produce a significant load on the bearings if balancing techniques are insufficient. Having multiple lobes that are substantially circularly symmetric may significantly reduce or even eliminate the need to apply balancing techniques known by persons skilled in the art. Despite being less efficient, using more than one lobe may increase the volumetric throughput noticeably for a given rotor size and operational speed.

Figure 17:
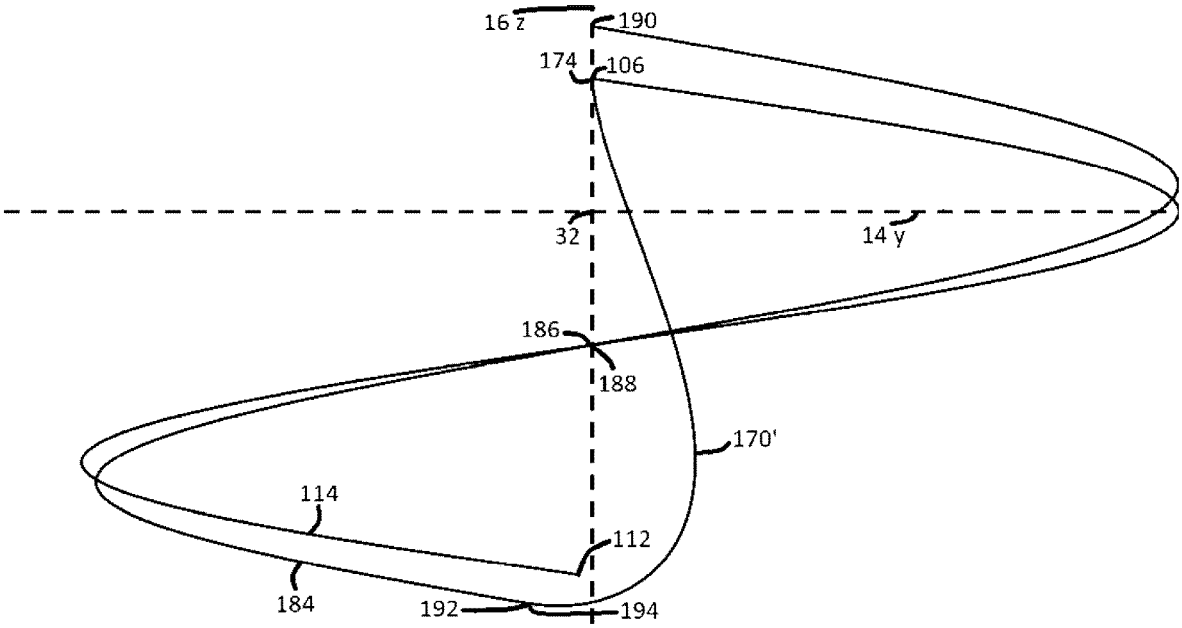
FIG. 17 is a top view of the curve seen in FIG. 16, including an involute curve and offset involute curve.

As previously discussed, both the involute base curve 114 and offset involute base curve 184 in FIG. 17 are seen to intersect at respective Points 186 and 188 found near the midpoints of their respective curve. For this one-lobe geometry, both of these coincident Points 186 and 188 are on the X-Z plane at the diametrically opposite side of the shifted offset teardrop base curve 170'.

Figure 29:
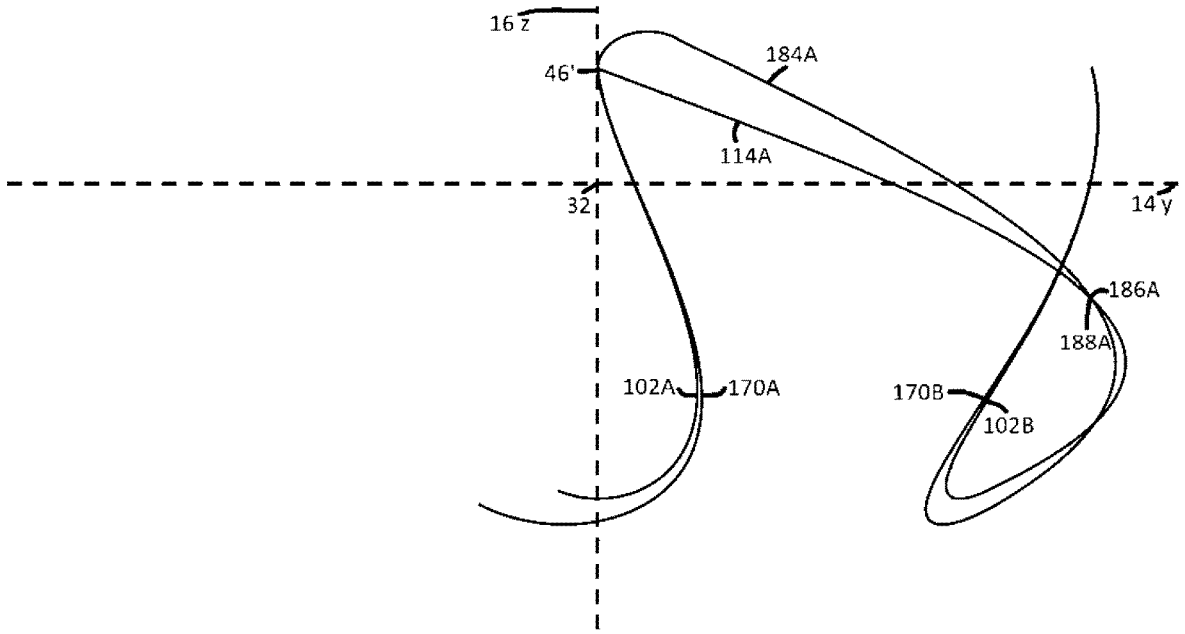
FIG. 29 is a top view of shifted offset teardrop curves and offset involute curves understood to be positioned on the outer surface of a sphere.
Figure 30:
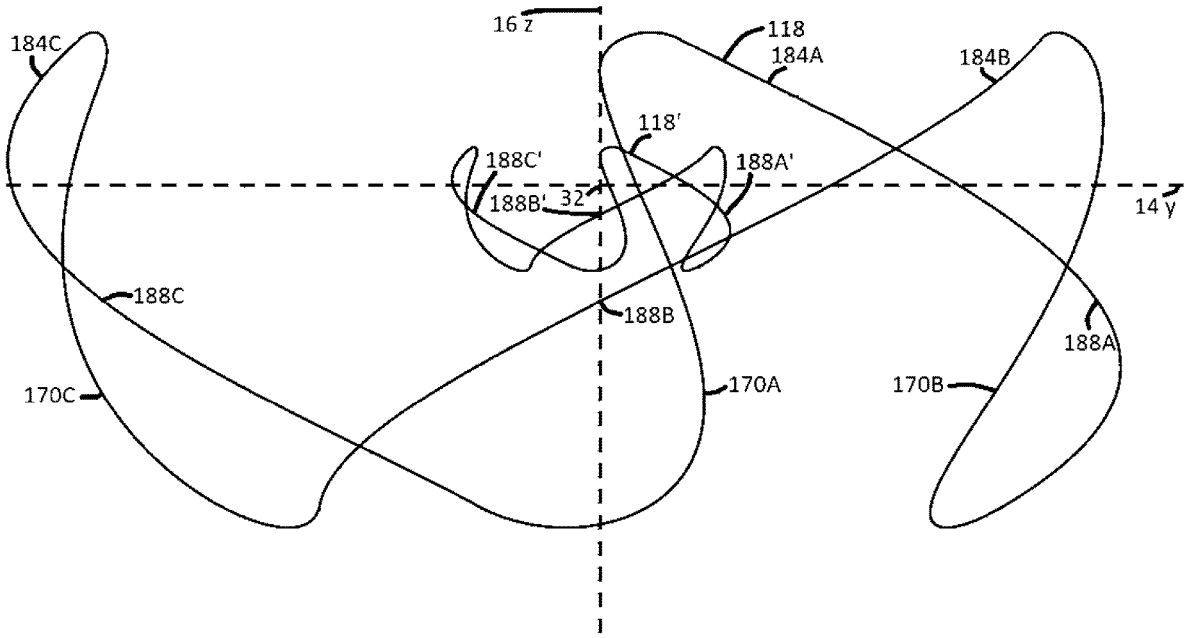
FIG. 30 is a top view of a partial wireframe model of a round lobe tip basic sawtooth three lobe rotor, including elements seen in FIG. 29.

Preferably, a geometry with multiple lobes will demonstrate circular symmetry, with identical teardrop and involute pairs that are knitted together. It is to be understood that a vector rotation about the Z-axis may be done to move coincident Points 186 and 188 to the location where the approximate midpoint of the involute should occur. In FIG. 30 a vector rotation of −120° about the +Z axis may be applied to point 188B to determine the coordinates for point 188A. In other words, the 3 lobe geometry repeats itself every 120° of rotation about the Z-axis. It is to be understood that any equation that is plotted can be shifted in the same manner. In FIG. 29, the teardrop base curve 102A was plotted with end point 46' having a positive X coordinate. A 120° rotation about the +Z axis was done to plot the teardrop base curve 102B. Involute base curve 114A connects these two teardrop base curves 102A/B. The same Total Sum of Squares (TSS) approach is done, using the constraints described, along with the requirement for point 186A to fall on the involute base curve 114A. Likewise, offset involute base curve 184A is formed, using offset teardrop base curve 170B as the end point. It contains point 188A, which is coincident with point 186A.

Figure 31:
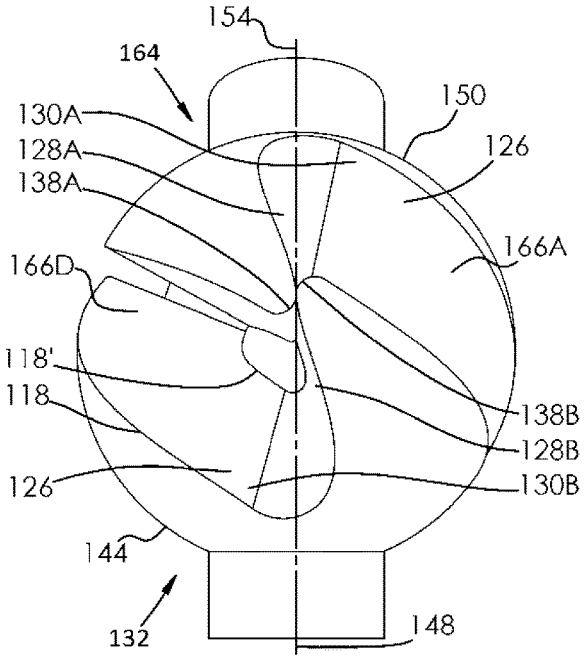
FIG. 31 is a top view of some of the elements seen in FIG. 30, to form an example sawtooth assembly, with rotors in a 180° rotational position.
Figure 32:
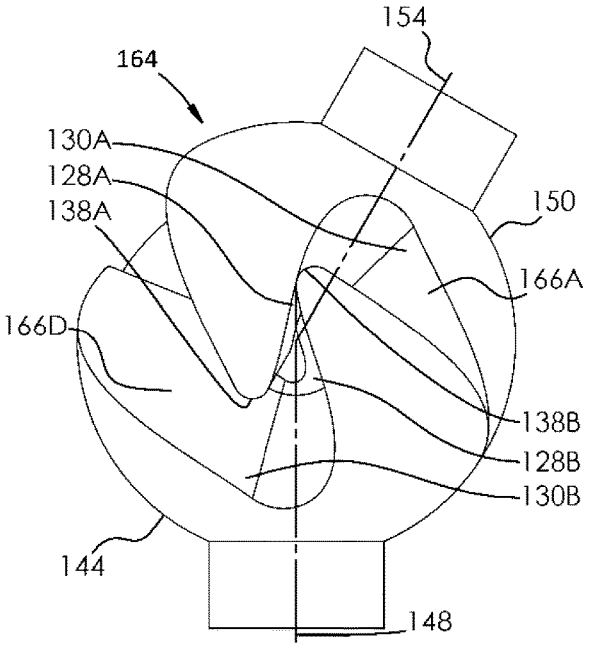
FIG. 32 is a side view of the components seen in FIG. 31, with rotors in a 270° rotational position.
Figure 33:
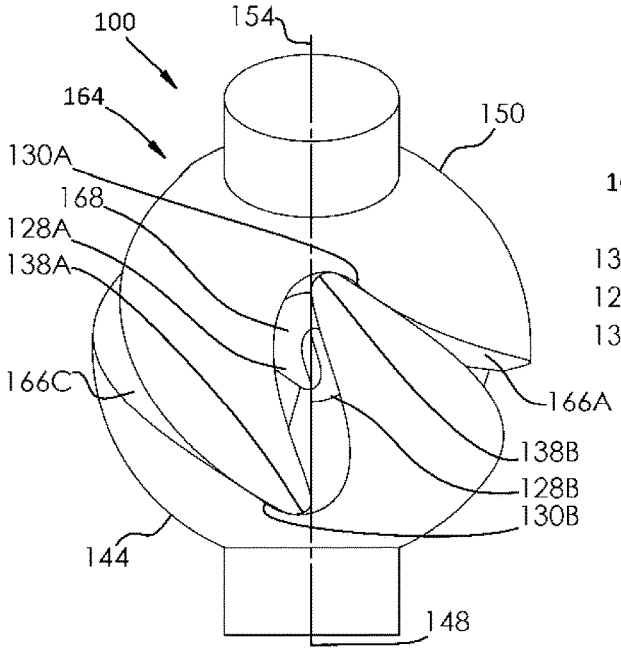
FIG. 33 is a bottom view of the components seen in FIG. 31, with rotors in a 360° rotational position.
Figure 34:
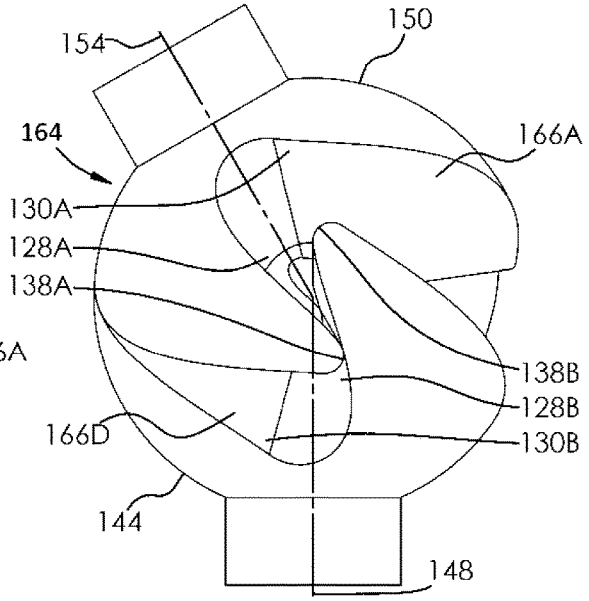
FIG. 34 is a side view taken from the opposing side seen in FIG. 32 of the components seen in FIG. 31, with rotors in a 90° rotational position.

The 3 lobe round tip solution with helical involutes is plotted in FIG. 30 at two different values for the spherical radius, 'R'. It is to be understood that the points 188A/B/C have X, Y and Z coordinates that are linearly scaled to become points 188A'B'/C'. These sawtooth rotor profiles 118/118' are used to construct the sawtooth geometry 132 seen in FIGS. 31-34. In FIG. 33, there is the teardrop volume 168 and chambers 166A/B/C along with small trapped volumes at the valleys 130A/B. Chamber 166B is at maximum volume, but is not visible since it is at the opposite side. For compression mode, the rotational position of FIG. 33 is followed by the rotational position of FIG. 34. The small volume at valley 130B in FIG. 33 expands into chamber 166D in FIG. 34 while the small volume at valley 130A and intermediate pressure teardrop volume 168 expand into chamber 166A. This chamber 166A further expands before subsequently compressing to what is seen in FIGS. 31-32. Finally, chamber 166A from FIGS. 31-32 becomes the near zero volume shown at valley 130A in FIG. 33. Chamber 166D in FIG. 34 expands to what is seen in FIG. 31 and has begun compression already in FIG. 32. This chamber 166D is split into chamber 166C and the teardrop volume 168 in FIG. 33. For expansion mode, the Rotary Positive Displacement Device 100 is reversibly operated. High pressure gas is allowed to enter the valley 130A in FIG. 33. That volume expands into chamber 166A in FIG. 32 and FIG. 31 before chamber 166A in FIG. 34 begins compressing/reducing in volume. Then, in FIG. 33, the teardrop volume 168 splits off from chamber 166A. After approximately another 120° of rotation, the volume of chamber 166A would become quite small such as the volume at the valley 130B in FIG. 33.

Sharp Lobe Tip Advanced Sawtooth Geometry—One Lobe with Advanced Involute

It will be appreciated that any working fluid that is not evacuated at the end of a compression stroke may introduce a noticeable efficiency penalty. Pressurized liquids may contain gas in solution that is subsequently vented at lower pressure and work is required to re-compress that gas. Pressurized gases may introduce a relatively higher efficiency penalty given the requirement to re-compress that gas. Similar comments can be made for the reverse (expansion) process. Volumes that cannot be evacuated are often referred to as the "clearance volume" and the relatively high pressure gas that is inefficiently recirculated is often referred to as the "recirculated volume". As discussed in later sections, the type of sawtooth geometry used at the lobe tip region may be, in preferred embodiments, particularly useful in reducing clearance volume. In particular, the advanced and customizable sawtooth geometries may beneficially facilitate orders of magnitude lower clearance and recirculated volume as compared to the known prior art.

In the applicant's opinion, an issue with the known prior art solutions is the significant recirculated volume that may be expected. For example, one prior art concept disclosed in U.S. Pat. No. 10,975,869, shown in FIG. 32 of U.S. Pat. No. 10,975,869, involved introducing an additional component affixed to the outer diameter of a frusto-spherical rotor, wherein all of the gas would be required to pass through the relatively small hole positioned at the valley of a rotor. In the applicant's opinion, this introduces a significant clearance volume which is likely to be largely gas filled, contributing to a significant efficiency penalty. Furthermore, any reduction to the cross-sectional flow area of the hole, for example to reduce the clearance volume, may increase the efficiency penalty related to the pressure drop across said restriction, likely resulting in a lower rated operational speed and power density. In another prior art concept, also disclosed in U.S. Pat. No. 10,975,869 at FIGS. 130 to 135 of U.S. Pat. No. 10,975,869, a large hole was introduced at the inside diameter of a rotor valley. While there is some uncertainty regarding how much of this clearance volume would be gas filled in oil-flooded applications, porting at the inside diameter of a rotor may require a certain minimum size of rotor, which is not believed to be practical to address the wide range of applications discussed herein. Advantageously, in one aspect of the present disclosure, the Advanced Sawtooth geometry described below will, in later sections, be used with efficient porting at the outside diameter of the rotors, without introducing any additional components affixed to the rotor and without introducing any substantial clearance volume.

It was demonstrated that the formation of the teardrop surface 128 is corollary to the geometric interaction of the first/second rotors 144/150. Therefore, the same equation is still used and repeated below for clarity.

$$\text{Teardrop} = \begin{bmatrix} T_x(t) \\ T_y(t) \\ T_z(t) \end{bmatrix} = \begin{bmatrix} R\left(\cos(p/2)\left(\cos(p)\cos(t)^2 + \sin(t)^2\right) + \sin(p/2)\sin(p)\cos(t)\right) \\ R\left(-2\sin(p/2)\sin(p)\sin(t/2)^2(\sin(t))\right) \\ R\left(\sin(p/2)(\cos(t)(\cos(p)+1) - \cos(p))\right) \end{bmatrix}$$

It was discovered that applying a vector rotation of 2*t* about the +Z axis to the teardrop equation produces an advanced involute base curve 118 for a one-lobe geometry. The mathematics are presented below:

$$\text{Advanced Involute} = I_A(t) = \begin{bmatrix} I_{A,x}(t) \\ I_{A,y}(t) \\ I_{A,z}(t) \end{bmatrix} =$$

$$\begin{bmatrix} \cos(2t) & -\sin(2t) & 0 \\ \sin(2t) & \cos(2t) & 0 \\ 0 & 0 & 1 \end{bmatrix} \begin{bmatrix} R\left(\cos(p/2)\left(\cos(p)\cos(t)^2 + \sin(t)^2\right) + \sin(p/2)\sin(p)\cos(t)\right) \\ R\left(-2\sin(p/2)\sin(p)\sin(t/2)^2\sin(t)\right) \\ R\left(\sin(p/2)(\cos(t)(\cos(p)+1) - \cos(p))\right) \end{bmatrix}$$

Plotting on a unit sphere, the advanced involute equation is written as follows:

$$\text{Advanced Involute} = I_A(t) = \begin{bmatrix} I_{A,x}(t) \\ I_{A,y}(t) \\ I_{A,z}(t) \end{bmatrix} =$$

$$\begin{bmatrix} \cos(2t) & -\sin(2t) & 0 \\ \sin(2t) & \cos(2t) & 0 \\ 0 & 0 & 1 \end{bmatrix} \begin{bmatrix} \cos(p/2)\left(\cos(p)\cos(t)^2 + \sin(t)^2\right) + \sin(p/2)\sin(p)\cos(t)\right) \\ \left(-2\sin(p/2)\sin(p)\sin(t/2)^2\sin(t)\right) \\ \left(\sin(p/2)(\cos(t)(\cos(p)+1) - \cos(p))\right) \end{bmatrix}$$

Figure 35:
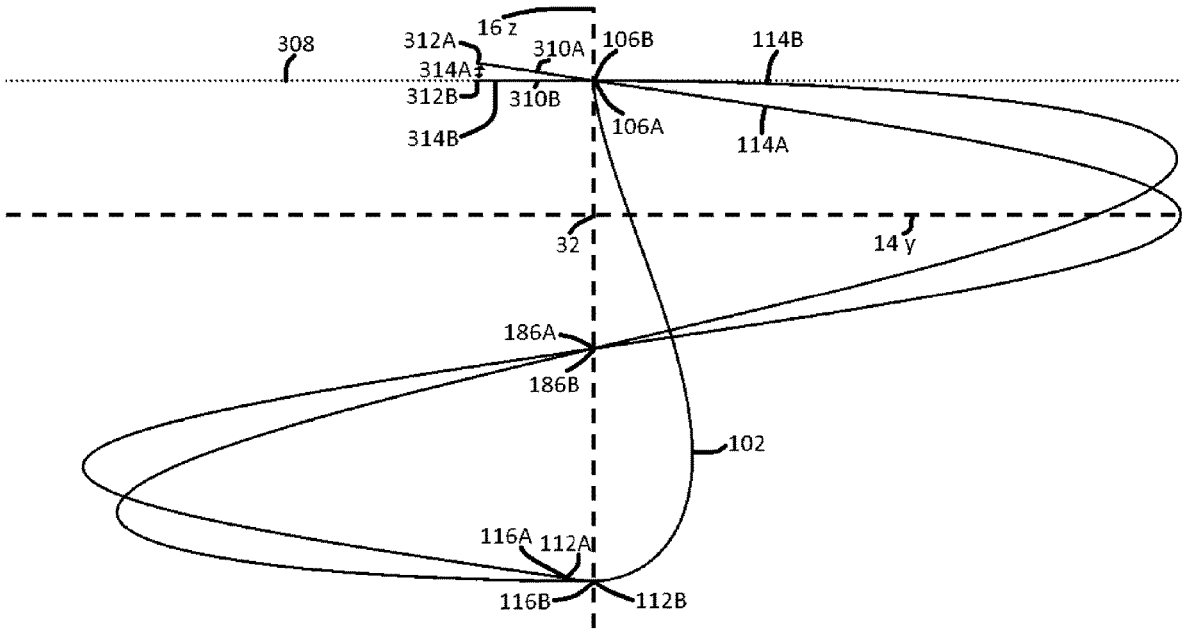
FIG. 35. is a top view with helical and advanced involute curves and a partial teardrop base curve.
Figure 36:
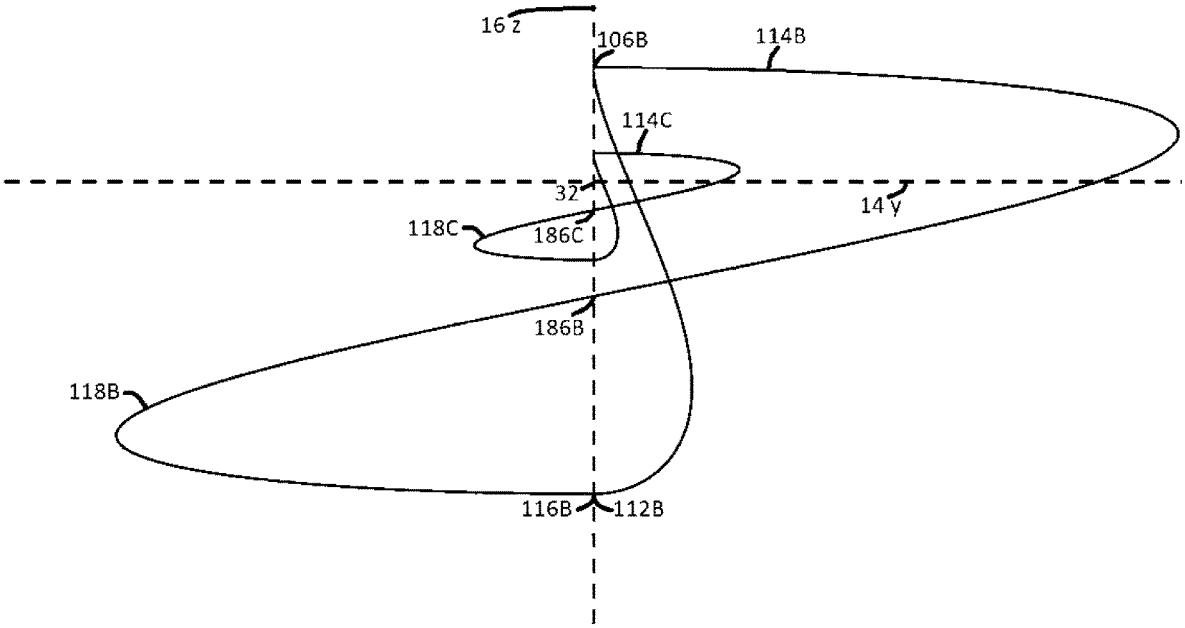
FIG. 36 is a top view of a partial wireframe model of a sharp lobe tip advanced sawtooth one lobe rotor, including elements seen in FIG. 35.
Figure 37:
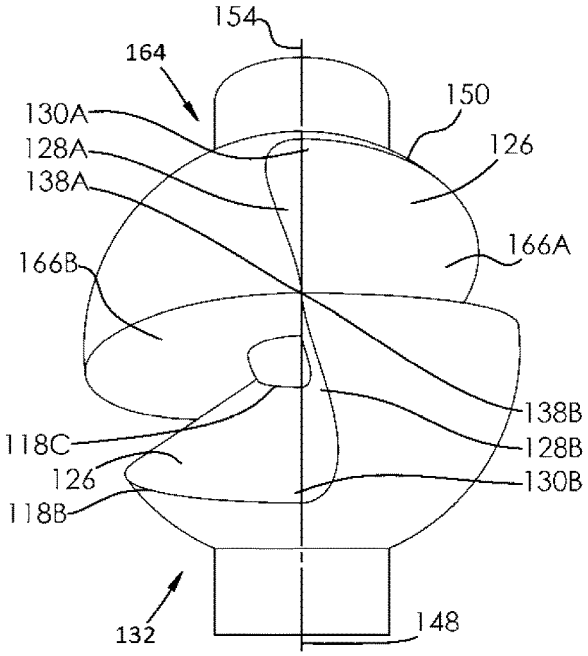
FIG. 37 is a top view of some of the elements seen in FIG. 36, to form an example sawtooth assembly, with rotors in a 180° rotational position.
Figure 38:
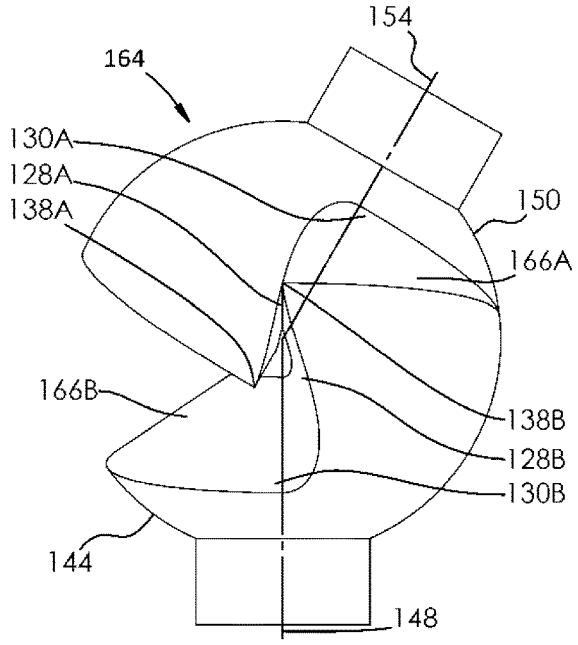
FIG. 38 is a side view of the components seen in FIG. 37, with rotors in a 270° rotational position.
Figure 39:
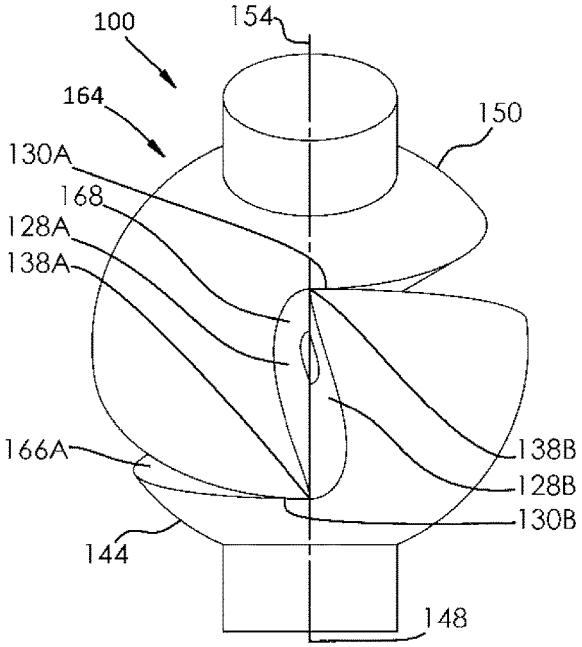
FIG. 39 is a bottom view of the components seen in FIG. 37, with rotors in a 360° rotational position.
Figure 40:
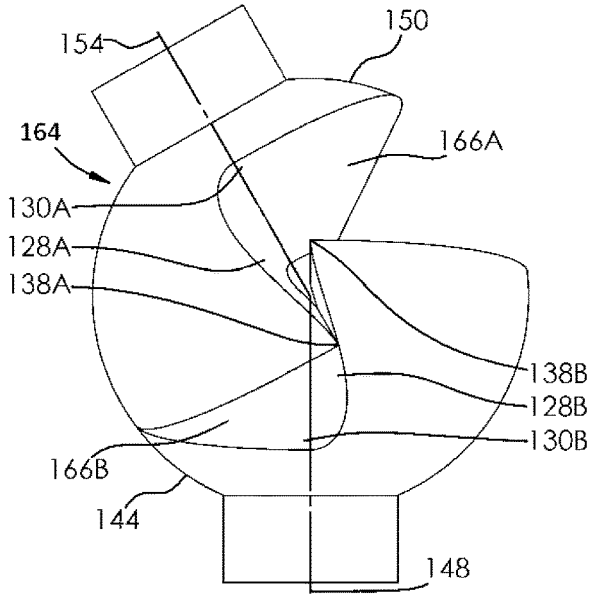
FIG. 40 is a side view taken from the opposing side seen in FIG. 38 of the components seen in FIG. 37, with rotors in a 90° rotational position.

The helical involute base curve 114 seen in FIG. 8 is plotted in FIG. 35 with an 'A' added as a suffix to compare with the advanced involute base curve 114B, which is plotted from $0 \le t \le \pi$. As seen in FIG. 35, the advanced involute base curve 114B has a horizontal slope near the start point 106B and end point 116B. The teardrop base curve 102 is plotted from $\pi \le t \le 2\pi$ to have the point 112B coincident with 116B. Later sections demonstrate how this horizontal slope at the lobe tip and valley contributes to efficiently porting gas in/out at the outside diameter of the rotors. The sawtooth rotor profiles 118B/C seen in FIG. 36 were used to construct the one lobe sawtooth geometry 132 seen in FIGS. 37-40. For further clarity and understanding, the below equation may be used to check that the rotors will mesh correctly:

$$I_{A,z}(t = t) + I_{A,z}(t = \pi - t) = 2 * I_{A,z}\left(t = \frac{\pi}{2}\right)$$

For even further clarity, this horizontal slope is defined as follows. Plane 308 in FIG. 35 is perpendicular to axis 16*z* with points 106A/B on this plane. Points 106A and 106B are understood to be coincident to one another as well. A straight line 310B connects point 106B with 312B, forming angle 314B with a magnitude of 0 degrees relative to plane 308. In other words, all of the points of straight line 310B are understood to be coincident with plane 308, forming what is referred to herein as a horizontal slope.

Unlike the advanced involute base curve 114B, the helical involute base curve 114A does not have a horizontal slope near the start point 106A. Point 106A on plane 308 and in cohort with point 312A forms straight line 310A. Straight line 310A is at an angle 314A from plane 308. In this example of FIG. 35, the magnitude of angle 314A may be measured at approximately 9.8 degrees.

Round Lobe Tip Advanced Sawtooth Geometry—One Lobe with Advanced Involute

As discussed, the use of sharp lobe tip geometry may not be practical for some applications. The offsetting methods used in foregoing examples may be applied as follows:

$$\text{Offset Advanced Involute} = I_{Ao}(t) = \begin{bmatrix} I_{Ao,x} \\ I_{Ao,y} \\ I_{Ao,z} \end{bmatrix} = \begin{bmatrix} R(\cos(b')I_{A,x} + \sin(b')N_x) \\ R(\cos(b')I_{A,y} + \sin(b')N_y) \\ R(\cos(b')I_{A,z} + \sin(b')N_z) \end{bmatrix}$$

Figure 41:
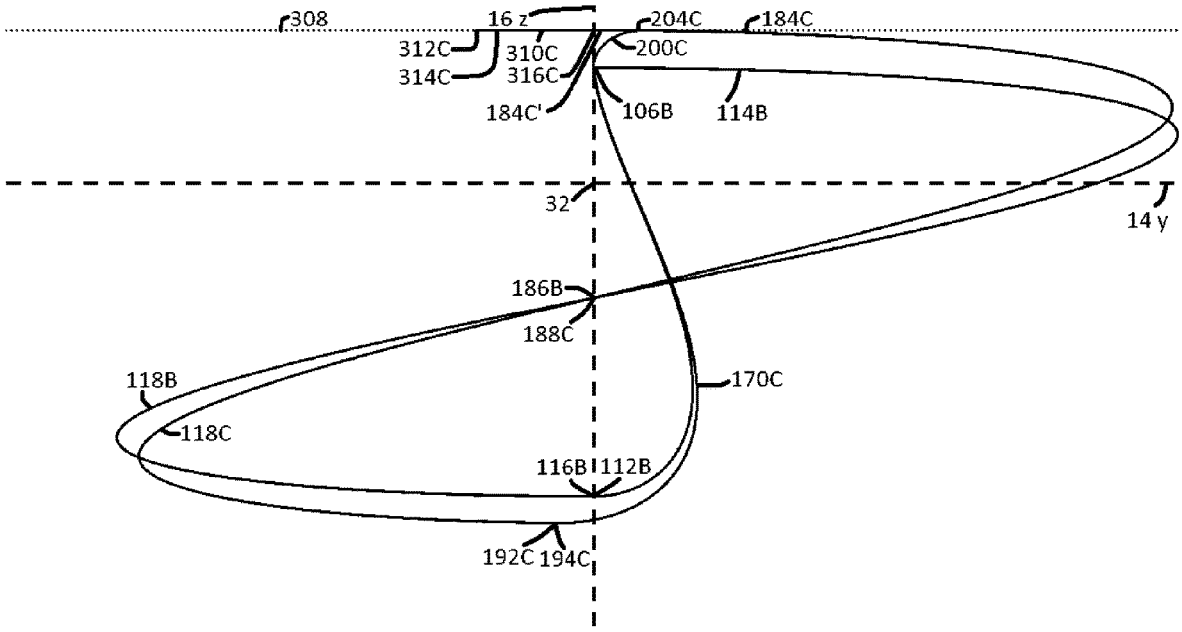
FIG. 41 is a top view of the advanced involute curve seen in FIG. 35, including an offset advanced involute curve.

In FIG. 41, the advanced involute base curve 114B and advanced offset involute curve 184C are both plotted for comparison purposes. The respective start locations, 106B/204C and end location 116B/192C of the involutes are labeled. Also included are the respective coincident points 186B and 188C which lie on the X-Y plane like the other one-lobe geometries studied. The advanced offset involute curve 184C and offset teardrop base curve 170C are substantially tangent at the involute end point 192C and teardrop point 194C. Like in previous methods, a Total Sum of Squares (TSS) approach may be used to satisfy all constraints, including varying the value of b' accordingly to ensure the sawtooth rotor profiles 118C mesh as seen in FIGS. 43-46. The below equation may be used:

$$I_{Ao,z}(t = t) + I_{Ao,z}(t = \pi - t) = 2 * I_{Ao,z}\left(t = \frac{\pi}{2}\right)$$

Figure 42:
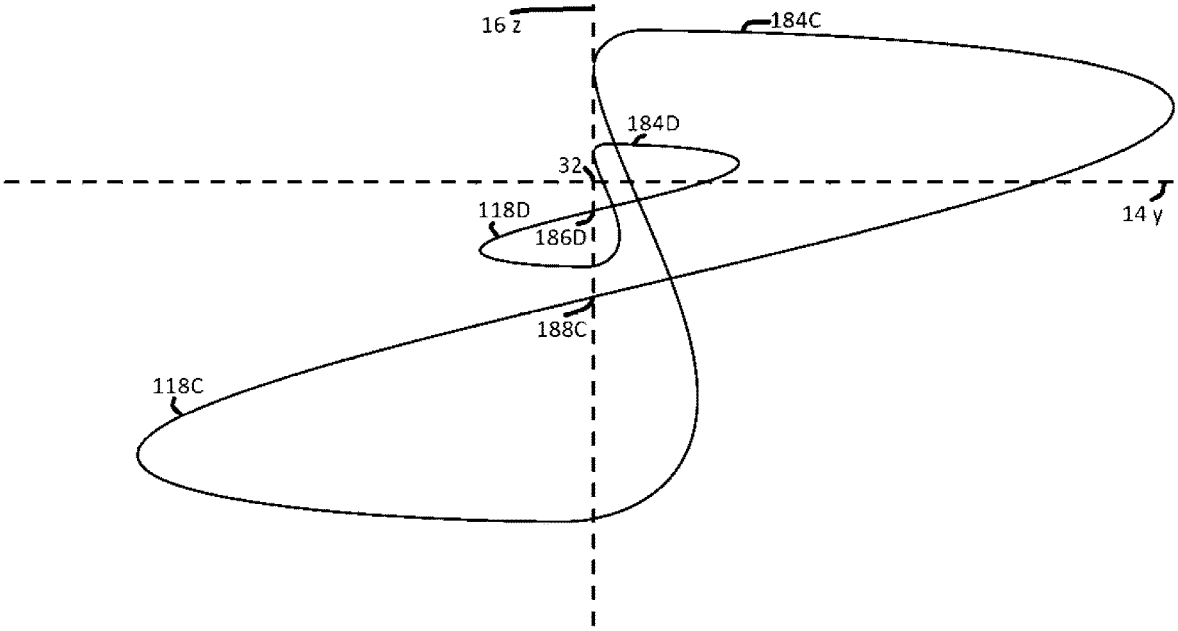
FIG. 42 is a top view of a partial wireframe model of a round lobe tip advanced sawtooth one lobe rotor, including elements seen in FIG. 41.
Figure 43:
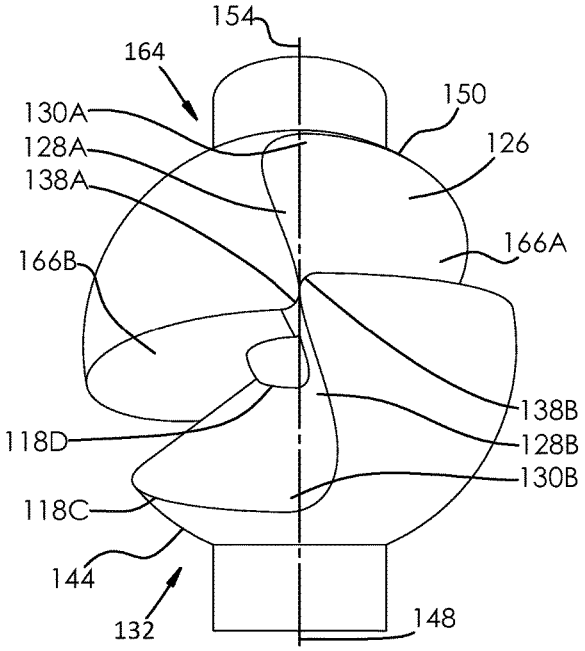
FIG. 43 is a top view of some of the elements seen in FIG. 42, to form an example sawtooth assembly, with rotors in a 180° rotational position.
Figure 44:
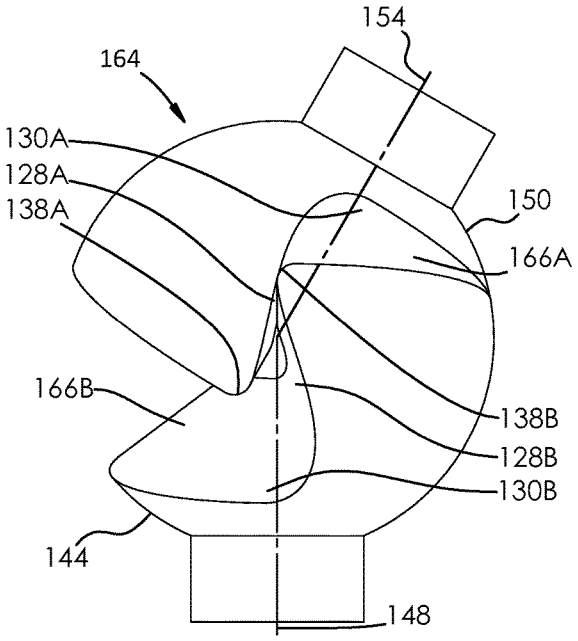
FIG. 44 is a side view of the components seen in FIG. 43, with rotors in a 270° rotational position.
Figure 45:
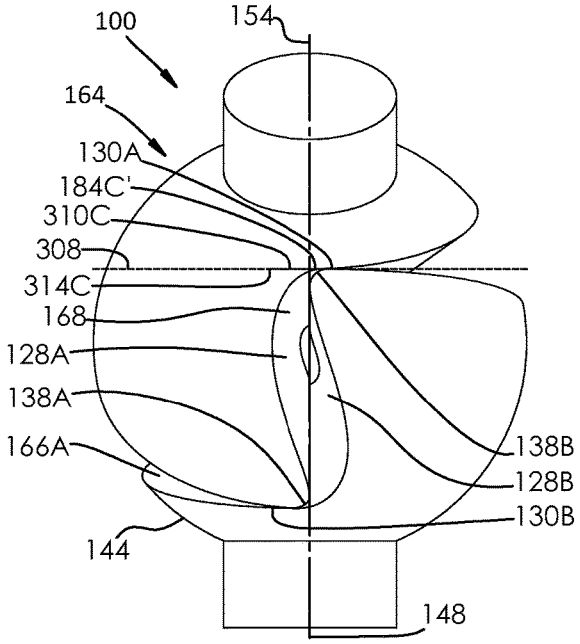
FIG. 45 is a bottom view of the components seen in FIG. 43, with rotors in a 360° rotational position.
Figure 46:
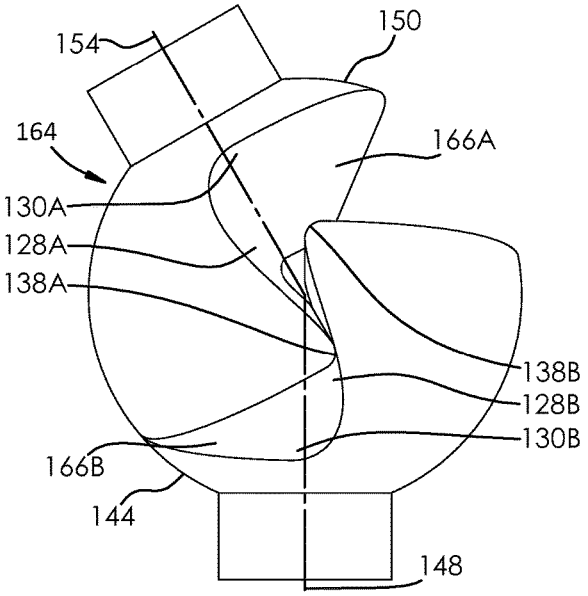
FIG. 46 is a side view taken from the opposing side seen in FIG. 44 of the components seen in FIG. 43, with rotors in a 90° rotational position.

That is, the sawtooth rotor profiles 118C/D seen in FIG. 42 were used to construct the one lobe advanced sawtooth geometry 132 seen in FIGS. 43-46. The valleys 130A/B are noticeably more accessible for machining tools compared to the sawtooth geometries made from helical involute curves. This advantageously allows a smaller lobe tip 138A/B than what is seen in FIGS. 43-46 for most applications. Decreasing the lobe tip size advantageously decreases the dynamic imbalance and reduces deflections of the lobe under pressure and/or centrifugal loading. For a given alpha angle, a smaller radius lobe tip allows for a more generously sized flow path which may be important for maximizing efficiency and/or power density by maximizing the operational speed.

The trimmed portion of the advanced offset involute curve 184' can be seen in FIG. 41, with end points 316C and 204C. Points 312C and 316C form straight line 310C and all of these points lie on plane 308, which is perpendicular to axis 16z. The magnitude of the angle 314C formed between the straight line 310C and the plane 308 is therefore 0 degrees. This advanced offset involute curve example further demonstrates the definition of a horizontal slope near the lobe tip 200C. For further clarity, the trimmed portion of the advanced offset involute curve 184C', straight line 310C, plane 308 and angle 314C seen in FIG. 41 can also be seen in FIG. 45 for this same advanced offset involute geometry.

Customizable Sawtooth Rotor Geometries and High Pressure Opening

The prior examples aid in demonstrating that the interaction of lobe tip and teardrop surfaces of meshed rotors is independent of the interaction of the respective involute surfaces. This disclosure provides for construction of sawtooth rotor geometries using helical and advanced involutes. The offsetting methods disclosed herein may be used to construct offset involute curves from sharp involute curves by adjusting the variable 'b' to be a function of the parameter 't' or the X, Y and/or Z component equations. Using this method, the helical offset involute curve 184 in FIG. 17 could have been constructed from the helical involute curve 114. Further customization is possible by making the input variables functions of t' or the X, Y and/or Z component equations.

If it is desired for the involutes of meshing rotors to form a seal, it may, in some embodiments, require maintaining the 'midpoint' location after offsetting. By way of reminder, the 'midpoint' location is not defined as a value of the parameter 't' since this may change after offsetting. As seen in FIG. 17, the 'midpoint' locations are points 186/188 are on the diametrically opposite side of the teardrop 170'. This may be said to be 180 degrees circumferentially around the Z axis, 16 z, and the Points 186/188 lie on the x-y plane. Additionally, one may appropriately offset all points of the curve such that when the involutes are meshed, no gaps or interference are expected. Depending on the geometry that is desired, it may be preferred to perform vector rotation(s) about the Z axis to relocate curve(s) that are known to mesh correctly. For example, in FIG. 47, the helical offset involute curve 184B/B', with a midpoint at 135 degrees, is rotated by 90 degrees (i.e. twice the difference between 180 degrees and 135 degrees) about the Z axis, 16 z, to be plotted as the helical offset involute curve 184D'/D.

Figure 47:
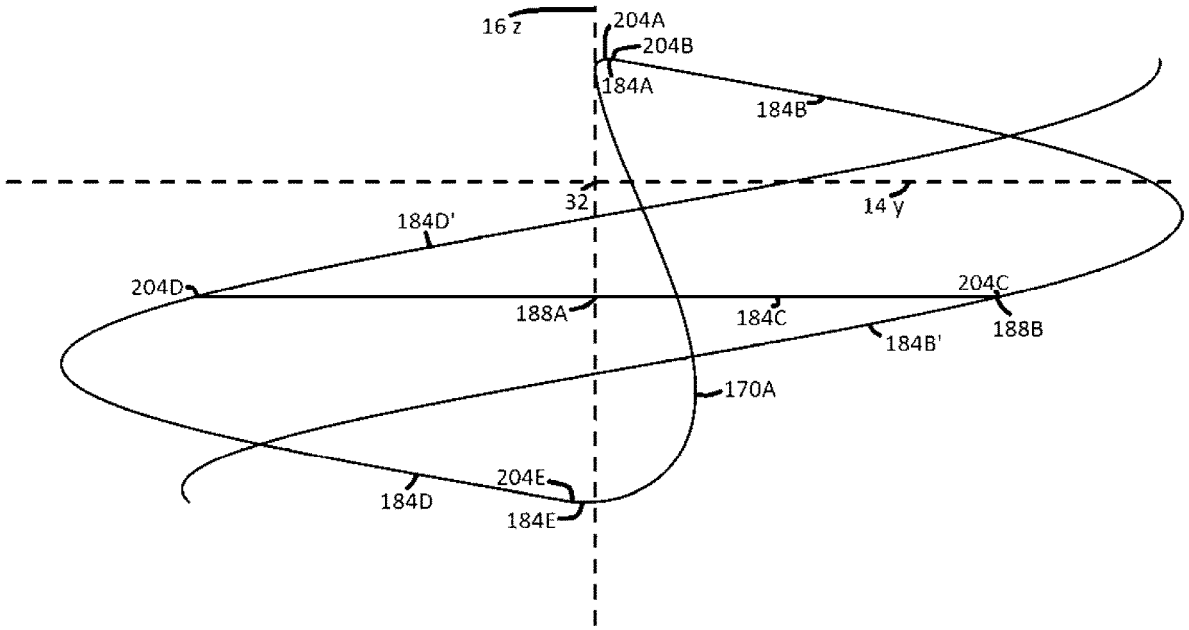
FIG. 47 is a top view of two helical offset involute curves with a midpoint at 135° rotated 900 apart and intersected with a customized advanced offset involute curve.

In FIG. 47, the advanced offset involute curve 184A is trimmed at starting point 204A and intersects the helical offset involute curve 184B, which is trimmed at starting point 204B. The helical offset involute curve 184B' is plotted to show the portion of the curve that would be discarded when the advanced offset involute curve 184C is trimmed at starting point 204C. The helical offset involute curve 184D will be trimmed at starting point 204D, such that the helical offset involute curve 184' will be discarded. Finally, the advanced offset involute curve 184E is trimmed at starting point 204E. In this manner, offset involute curves 184A/B/C/D/E are connected continuously, but are not tangent at the respective intersection points (i.e. starting points 204B/C/D/E). Tangency will result from fillets introduced in the machining process and it may be preferred to specify that geometry. Constant or variable radius fillets may be added to the geometry. Appropriate sizing can be determined based on which locations will be in close contact. For example, it may be desirable to modify adjacent seals and/or adjacent volumes, which may require different fillet sizing. The consequences at all rotational positions may be studied to also ensure interference is avoided when the rotors mesh.

Before trimming, the advanced offset involute curve 184A and the advanced offset involute curve 184E are initially the same curve with midpoint 188A at 180 degrees. In this example, the midpoint 188B of helical offset involute curve 184B/B' is at 135 degrees, which is coincidentally halfway between what is used for a conventional 1 and 2 lobe geometries. The construction of the helical offset involute curve 184B/B' does not enforce tangency at the offset teardrop base curve 170A. Rather, a value of parameter 't' or a coordinate position of the advanced offset involute curve 184A is selected. In this example, the advanced offset involute curve 184A is arbitrarily plotted up to a value of t=0.015, defining the starting point 204B of the helical offset involute curve 184B. A TSS approach may be used to satisfy all constraints, including the location of midpoint 188B.

The advanced offset involute curve 184C in FIG. 47 was created such that the z coordinate does not vary, resulting in intersection points 204C and 204D. Likewise, a large range of midpoint values may be used, including varying the midpoint value at every point that is plotted for the purpose of developing a fully customizable sawtooth rotor geometry. When using these intersection techniques, it may be preferred to have involute curves meshing with each other that were constructed from identical input variables in the respective advanced and helical methods.

In other words, while said variables can vary as a function of t or X, Y, and/or Z in their respective equations, the points of close contact of meshing involutes may ideally have substantially identical variables at those particular points. In FIG. 47, advanced offset involute curves 184A and 184E would be meshed when the lobe tip of the second rotor is interposed into the valley of the first rotor around a shaft angle of approximately 0 degrees. In compressor mode, shortly thereafter the helical offset involute curve 184B of the second rotor forms a seal with the helical offset involute curve 184D of the first rotor. Next, the seal location moves to the advanced offset involute curves 184C of the respective rotors. Subsequently, the helical offset involute curve 184D of the second rotor forms a seal with the helical offset involute curve 184B of the first rotor. Finally, as the compression stroke is near complete, the seal is between the advanced offset involute curve 184A of the second rotor and the advanced offset involute curve 184E of the first rotor.

Figure 48:
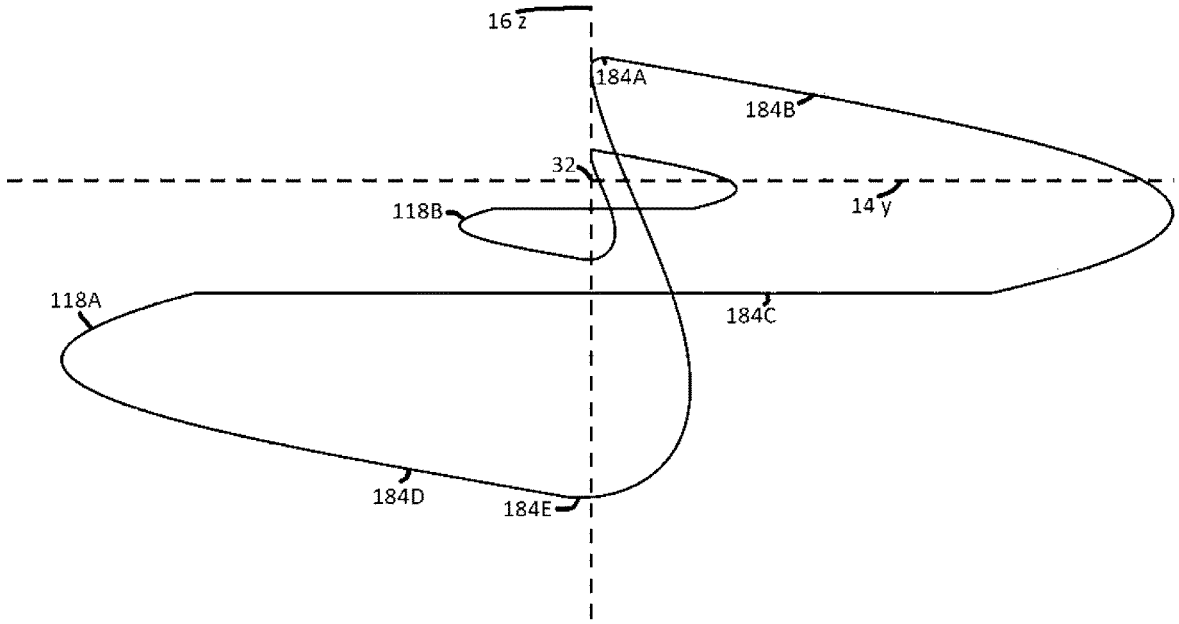
FIG. 48 is a top view of a partial wireframe model of a customized one lobe rotor using a helical involute with a midpoint at 135° and advanced offset involute curves, including elements seen in FIG. 47.

The sawtooth rotor profile 118A in FIG. 48 contains the curves 184A/B/C/D/E from FIG. 47.

Figure 49:
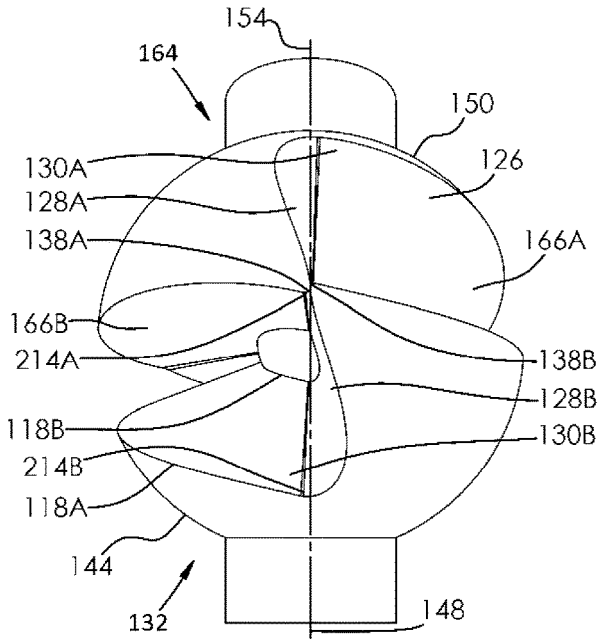
FIG. 49 is a top view of some of the elements seen in FIG. 48, to form an example sawtooth assembly, with rotors in a 180° rotational position.
Figure 50:
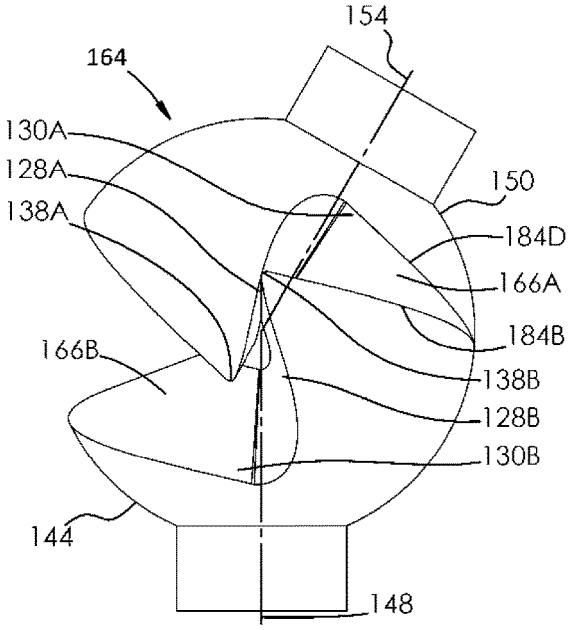
FIG. 50 is a side view of the components seen in FIG. 49, with rotors in a 270° rotational position.
Figure 51:
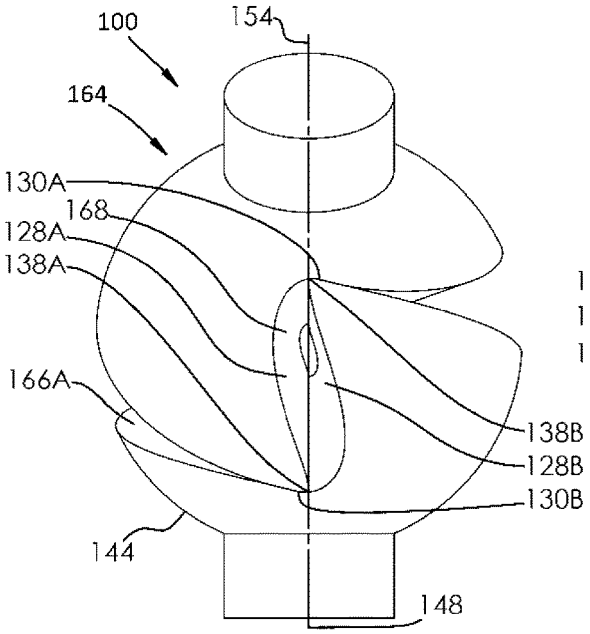
FIG. 51 is a bottom view of the components seen in FIG. 49, with rotors in a 360° rotational position.
Figure 52:
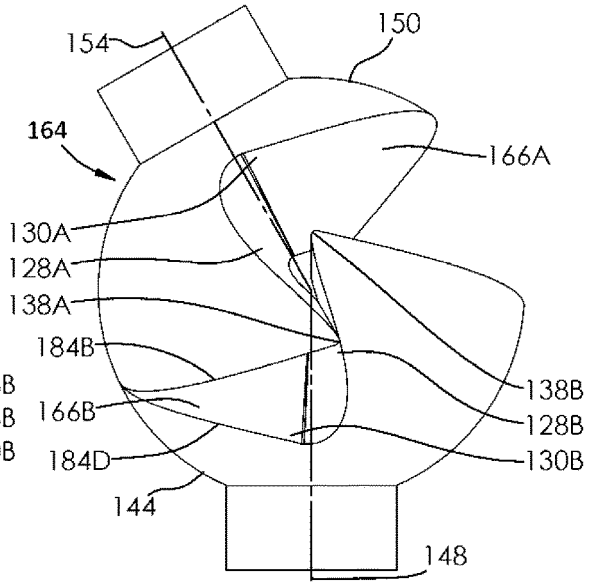
FIG. 52 is a side view taken from the opposing side seen in FIG. 50 of the components seen in FIG. 49, with rotors in a 90° rotational position.

These sawtooth rotor profiles 118A/B were used to construct the sawtooth geometry 132 seen in FIGS. 49-52. In compressor mode, FIG. 51 is at a shaft angle of approximately 0 degrees where chamber 166A is at the maximum possible volume. FIG. 52 is at a shaft angle of approximately 90 degrees, with chamber 166B intaking while the seal between chamber 166B and chamber 166A is formed by the helical offset involute curve 184B of the second rotor 150 and the helical offset involute curve 184D of the first rotor 144. FIG. 49 is at a shaft angle of approximately 180 degrees with the seal occurring at the advanced offset involute curves 184C (See FIG. 47) of the respective rotors. FIG. 50 is at a shaft angle of approximately 270 degrees with the chamber 166A typically being boosted in pressure substantially compared to the substantially larger volume shown in FIG. 51. The seal between the helical offset involute curve 184D of the second rotor 150 and the helical offset involute curve 184B of the first rotor 144 minimizes the leakage back towards chamber 166B which may be intaking at that position. Finally looking to FIG. 51 at a shaft angle of approximately 360 degrees (i.e. or 0 degrees) shows the contents of chamber 166A from FIG. 50 to be substantially discharged already, as implied by the lack of volume remaining between seal lines. As described previously, the description for expansion mode requires said figures to be discussed in a reverse order to demonstrate the reverse rotation of the shafts/rotors. In FIG. 49 fillet 214A of the second rotor 150 will eventually mesh with fillet 214B of the first rotor 144 and substantially equivalent sizes were selected. A variable radius fillet was chosen on the 3D geometry to maintain the radial scaling chosen for this example. However, as demonstrated in previous examples, the lobe tip, or other features, can be chosen to have a constant radius, if preferred. The use of fillet(s) is an optional way to accommodate how typical machining practices would require fillets larger than the expected machining tool radius.

A person skilled in the art may have many variables to consider when customizing sawtooth rotor geometry to be optimized for an application. For example, in some large horsepower applications where dynamic loads are expected to be significant even after dynamic balancing a one-lobe sawtooth geometry, it may be advantageous to select sawtooth rotor geometry with a plurality of lobes, despite the lower expected efficiency introduced from having a relatively higher pressure introduced in the teardrop volume 168 (See FIG. 51) which is later introduced into the low pressure side.

In smaller horsepower applications, the power density and efficiency are typically desirable parameters for optimization. Finding the practical maximum for the alpha angle and the operational speed is likely to maximize the power density while also reducing manufacturing costs. However, in some applications, maximizing the efficiency may provide an attractive payback period. When both rotors are rotating, it may be demonstrated how chambers may naturally become in fluid communication with a low pressure and high pressure side for compression or expansion operations. This valve-less operation is expected to maximize the reliability of the equipment, which for many operations may be amongst the most important considerations. The rate at which a given chamber is increasing or decreasing in volume is evaluated in cohort with the cross-sectional flow area and/or relative ease of the flow path. The performance at relative rotational positions may be evaluated, for example, with Computational Fluid Dynamic (CFD) studies and/or calculations including the effective hydraulic diameter; however, performance may be evaluated by other methods, as would be known to a person skilled in the art. In compressor mode, it is typically desirable for the flow area to be as large as practical during the intaking process and then have this fluid communication with the intake be naturally closed off as quickly as possible relative to the changes in chamber volume. Some amount of pressure differential is required to drive the flow into the chamber. Efficiently intaking with minimal pressure loss (i.e. compared to the intake pressure) is expected to boost volumetric throughput and power density since more gas was trapped in the chamber. When the chamber substantially reaches the desired discharge pressure it may be desirable for the chamber to be in fluid communication with the downstream/discharge piping with the flow area opening up as quickly as possible relative to the subsequent changes in chamber volume. That is, the chamber volume will continue to decrease and additional power is required to cause the gas to over-pressure. When evaluating the efficiency of sawtooth rotor geometries, it may be important to study how 'quickly' the flow area opens up naturally. Significant over-pressuring can be dangerous and while valveless equipment can very easily adjust to open the chamber up early to mitigate these effects, this can be a noticeable efficiency penalty. In one aspect, the shape of the rotor lobe may play an important role in determining how quickly the chamber opens up and therefore the appropriate operational speed range for the expected range of pressures and fluid composition.

There are other considerations to weigh. For example, increasing the steepness of the rotor lobe is likely to increase the recirculated volume somewhat. In the example provided in FIGS. 47-52, using two offset advanced involute curves 184A/C in combination with offset helical involute curve 184B was performed to maintain the high efficiency of a one-lobe geometry while still increasing the steepness of the rotor lobe. Additionally, the range of volume ratios desired in operation should ideally be known to make an educated decision on where the discharge process is likely to occur. In some applications, it may be important to be efficient under one operating condition and less important to be efficient at other operating conditions. For example, air source heat pumps in cold climates such as Canada have a challenging operational case when the ambient temperature reaches below −25° C. and especially when it reaches −40° C. A compressor of a heat pump cycle would ideally operate in a significantly different volume ratio in the winter time compared to the summer time. That is, there would be a particular volume ratio corresponding to enabling the cycle to use −40° C. ambient air and efficiently provide a desirable interior temperature of around 20° C. Perhaps the optimization efforts would be heavily skewed towards making this operational condition possible through an efficient design. As an example, this operational condition may require a maximum operational speed to accommodate such a high compression ratio, while the minor temperature boosts required in summer months would require a comparably extremely low compression ratio and minimal operational speed. The minimal operational speed would likely be combined with a form of volumetric capacity control, which will be introduced herein. It will be appreciated that there is a lot more heat demand in the wintertime, and this is combined with a much more challenging engineering objective compared to heating in the other seasons. Since such a significant amount of (driving) range of Electric Vehicles (EVs) can be lost to cabin heating in extreme climates, it may be particularly advantageous in this application to use suitable sawtooth rotor geometry.

Minimizing recirculated volume may be important in high volume ratio applications. While a high pressure ratio implies a high required volume ratio, a high volume ratio may also be associated with multi-phase applications. For example, the Trilateral Flash Cycle (TFC) or Partially Evaporated Cycle (PEC) involve transition from a fully liquid working fluid or partially liquid working fluid (respectively) into a liquid-vapor mixture. Liquids may be much higher density than gases and therefore a large volume ratio may be required even if the pressure ratio is modest. The substantially horizontal slope of the rotor lobes seen in FIGS. 43-46 may lead to little to no recirculated volume. As was demonstrated in FIG. 35, the helical sawtooth rotor geometry can provide additional slope at the rotor lobes, which can be helpful for porting, depending on when the chamber is expected to be in fluid communication with the high pressure side.

High Pressure Opening

Figure 53:
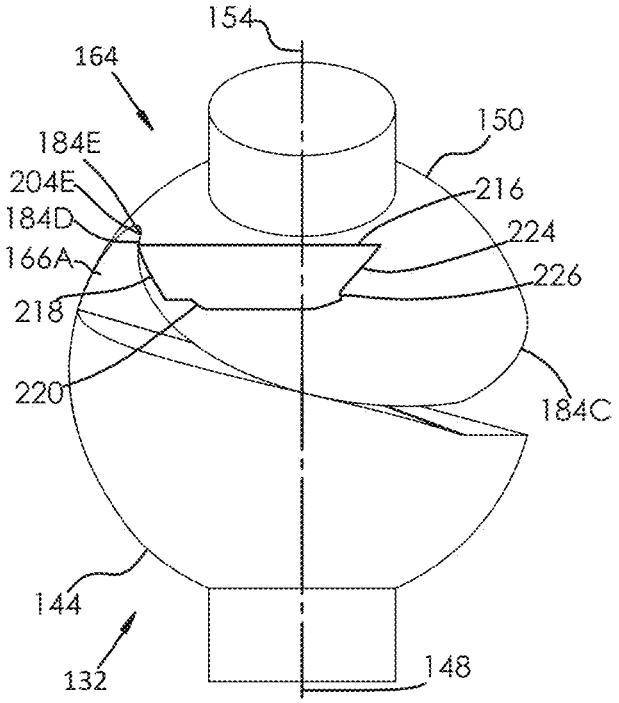
FIG. 53 is a bottom view of the components seen in FIG. 49 (customized one lobe rotors using a helical involute with a midpoint at 135° and advanced offset involute curves), with rotors in a 270° rotational position, including a high pressure opening.
Figure 54:
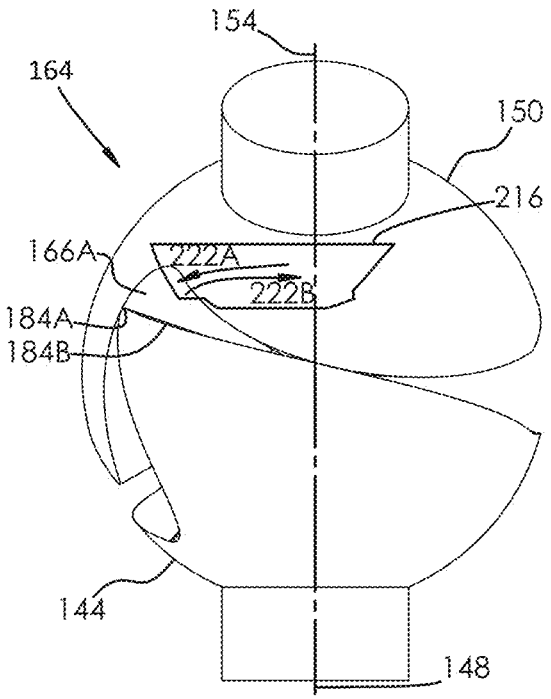
FIG. 54 is a bottom view of the components seen in FIG. 49, with rotors in a 300° rotational position, including a high pressure opening.
Figure 55:
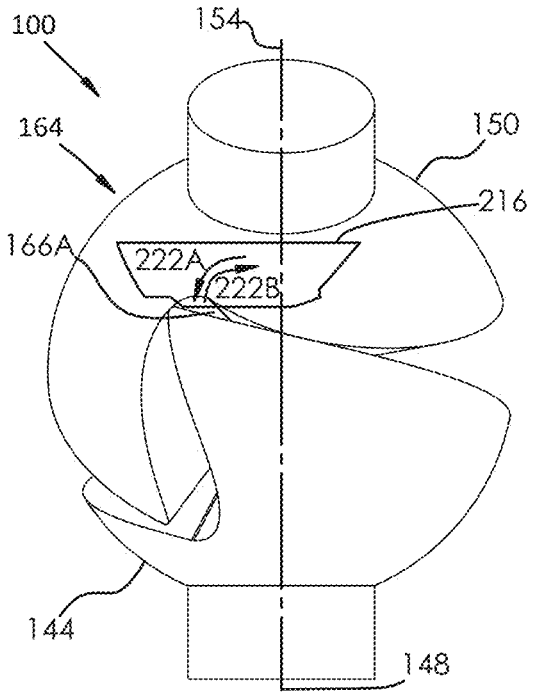
FIG. 55 is a bottom view of the components seen in FIG. 49, with rotors in a 330° rotational position, including a high pressure opening.
Figure 56:
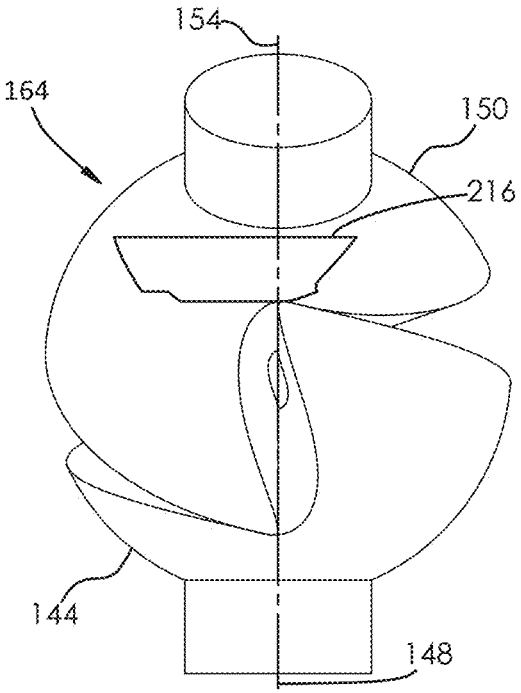
FIG. 56 is a bottom view of the components seen in FIG. 49, with rotors in a 360° rotational position, including a high pressure opening.

Several bottom view examples of the sawtooth assembly 164 are provided in FIGS. 53-68 which have a high pressure opening 216 sketched at substantially the same spherical diameter as the outside diameter of the rotors. It is to be understood that the portion, if any, of the inside of the perimeter of high pressure opening 216 that overlaps with chamber 166A allows fluid communication and flow 222A/B therebetween. As illustrated by directional arrows in FIGS. 53-68, FIGS. 77-88 and FIGS. 100-102, flows 222A and 222B illustrate respective flow into and out of the chamber via the high pressure opening 216. In these bottom view examples illustrated in FIGS. 53-68, the high pressure opening 216 remains stationary relative to the housing (not shown) or stationary observer as the rotors 144/150 rotate about their respective axes 148/154. The advanced offset involute curve 184E and helical offset involute curve 184D from FIG. 48 are labeled in FIG. 53 to highlight how the leading edges 218/220 of the high pressure opening 216 could be optimized to better match these curves 184D/E. In the examples provided, the leading edge 218 and trailing edge 224 may be re-positioned by any rotational increment about the first rotational axis 148. It is to be understood that this modification to the high pressure opening 216 may modify when the chamber 166A is in fluid communication with the high pressure opening 216. However, for the purpose of illustrating the role of customizing the sawtooth geometry 132, the same high pressure opening 216 in the same circumferential position may be seen in FIGS. 53-68.

FIGS. 53-56 are comprised of sawtooth geometry 132 with advanced offset involute curves 184A/C/E with b=1.25° at the lobe tip and a horizontal central segment and a helical offset curve 184B/D with a midpoint at 135°. This is the same geometry seen in FIGS. 47-52. Respective shaft rotational positions of 270°, 300°, 330° and 360° can be seen in FIGS. 53-56. In this respective order chamber 166A is decreasing in volume, in compression mode, with flow 222B exiting the chamber. The reverse order would indicate expansion mode, with the opposite direction of the flow 222A entering the chamber until a seal is made between leading edge 218 and the advanced offset involute curve 184D of the second rotor 150.

Figure 57:
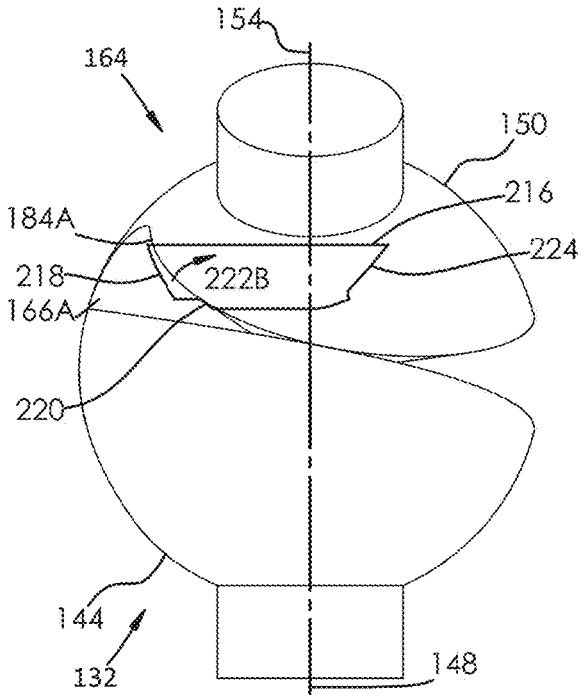
FIG. 57 is a bottom view of round lobe tip advanced sawtooth one lobe rotors forming a sawtooth assembly, with rotors in a 270° rotational position, including a high pressure opening.
Figure 58:
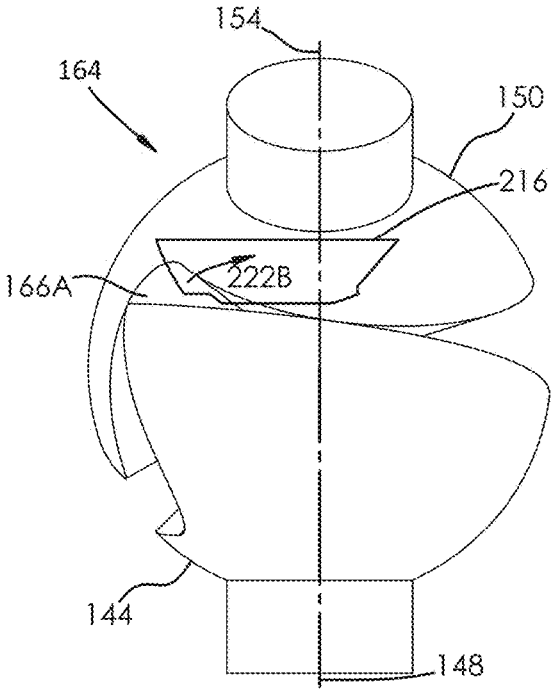
FIG. 58 is a bottom view of the components seen in FIG. 57, with rotors in a 300° rotational position, including a high pressure opening.
Figure 59:
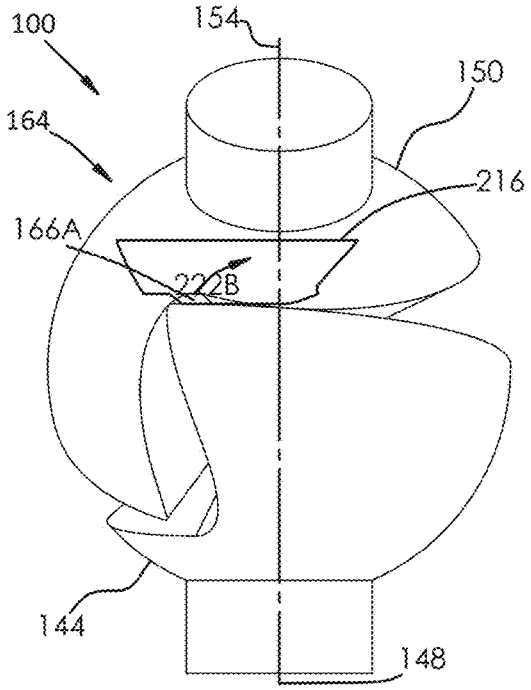
FIG. 59 is a bottom view of the components seen in FIG. 57, with rotors in a 330° rotational position, including a high pressure opening.
Figure 60:
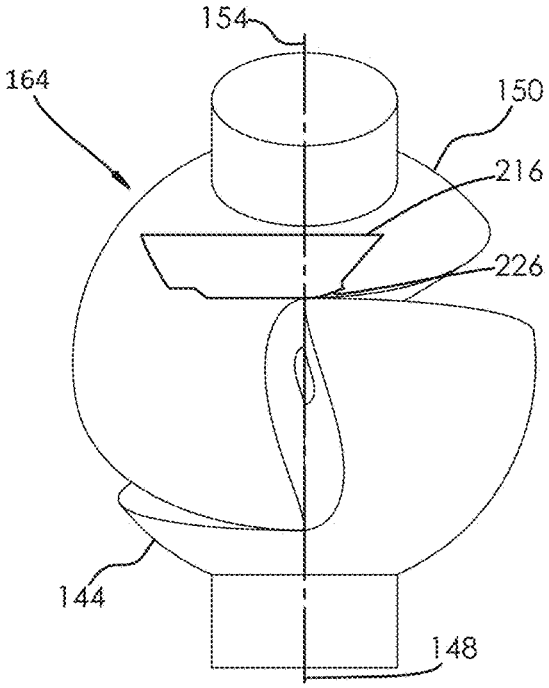
FIG. 60 is a bottom view of the components seen in FIG. 57, with rotors in a 360° rotational position, including a high pressure opening.

FIGS. 57-60 are comprised of sawtooth geometry 132 with an advanced offset involute curve 184A with b=1.25° at the lobe tip and no helical offset curves. Respective shaft rotational positions of 270°, 300°, 330° and 360° may be seen in FIGS. 57-60. In FIG. 57 the position of the advanced offset involute curve 184A and the leading edge 218 of the high pressure opening 216 would allow flow 222B to exit the chamber 166A. Soon after the shaft rotational position of 270° (FIG. 57) flow 222B may exit adjacent to leading edge 220. In this example, the leading edge 220 is not intended to be adjustable during operation since significant re-positioning of the high pressure opening 216 near the trailing edge 226 to the left in the views provided could prevent flow 222B at the end of the compression stroke (FIG. 60) and repositioning to the right could promote inefficient backflow into the adjacent chamber. The position of leading edge 220 is intended to be selected such that a higher volume ratio than is reasonably efficient is not desired in operation.

Thus, the position of leading edge 220, in some embodiments, is configured to be a stationary leading edge 220 and is configured such that a higher volume ratio than is reasonably efficient is not obtained during operation. That is, it may be preferred for the leading edge 220 to permit flow 222B no earlier than leading edge 218 permits flow 222B. In the example seen in FIG. 53, the leading edge 218 is positioned to substantially not allow fluid communication between chamber 166A and the high pressure opening 216 at this rotational position. If a stationary component that cannot be repositioned during operation comprises leading edge 220, it may be advantageous that the position of leading edge 220 blocks the flow between chamber 166A and the high pressure opening 216 at the rotational position shown in FIG. 53, as the position of leading edge 220, in this example, maintains the volume ratio that is reasonably efficient. By configuring the position of stationary leading edge 220 that is no more limiting than desired, this allows for significant adjustability of the position of leading edge 218 and trailing edge 224 without introducing recirculated volume and while maximizing flow area near the end of the compression stroke. For example, it is noteworthy how in FIG. 59 the high pressure opening 216 allows flow 222B from nearly the entire spherical diameter of the chamber 166A.

FIGS. 61-64 are comprised of sawtooth geometry 132 with an advanced offset involute curves 184A/E with b=1.25° at the lobe tip and a helical offset curve with a midpoint at 180°. The intersection point 204C between the curves 184B/184C occurs very near to the teardrop such that only curve 184B of the second rotor 150 interacts with leading edge 218 to selectively permit flow 222B. Respective shaft rotational positions of 270°, 300°, 330° and 360° can be seen in FIGS. 61-64.

FIGS. 65-68 are comprised of sawtooth geometry with a longer section of advanced offset involute curves 184A/C with b=1.25° at the lobe tip and a helical offset curve 184B with a midpoint at 180°. The intersection point 204C between the curves 184B/C occurs relatively further from the teardrop in comparison to the sawtooth geometry 132 seen in FIGS. 61-64. Respective shaft rotational positions of 270°, 300°, 330° and 360° can be seen in FIGS. 65-68.

The high pressure opening 216 seen in FIGS. 53-68 may work reasonably well for all of the examples provided even without optimizing the shape for the particular sawtooth geometry selected. However, it should be noted that all of the examples provided in FIGS. 53-68 have a common trait where an advanced offset involute curve is tangent to the teardrop. In the example seen in FIG. 67, the high pressure opening 216 has lower edge 320 that is measured by an angle 322 from the plane 318. In this example, plane 318 is perpendicular to the first rotational axis 148 and the magnitude of angle 322 is 0 degrees. This is referred to herein as a horizontal slope of the lower edge 320 of the high pressure opening 216. Looking to FIG. 67 and FIG. 68 this lower edge 320 may be preferred to maximize the flow area available at the rotor spherical diameter for flow 222B. Any substantially horizontal slope is expected to yield similar performance. It is also to be understood that the lower edge 320 may be a straight line, but it may also be any spline curve.

The following section highlights challenges of using helical offset involute curves adjacent to the teardrop primarily to illustrate how using advanced offset involute curves adjacent to the teardrop may be ideal to facilitate efficient porting at the high pressure opening 216 at the outside diameter of the rotors.

Figure 70:
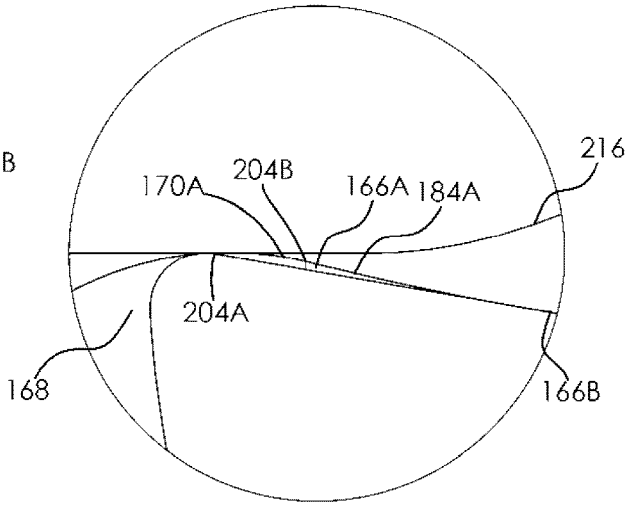
FIG. 70 is an enlarged view of the region 70 of FIG. 69.
Figure 71:
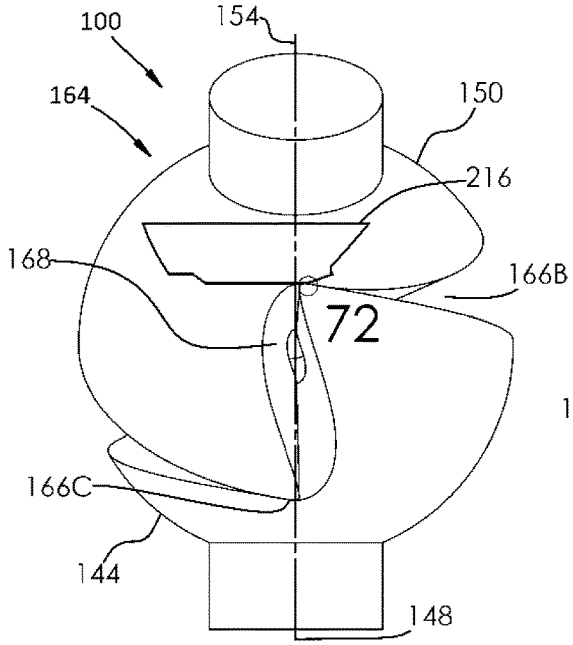
FIG. 71 is a bottom view of the components seen in FIG. 69, with rotors in a 1° rotational position, including a high pressure opening
Figure 72:
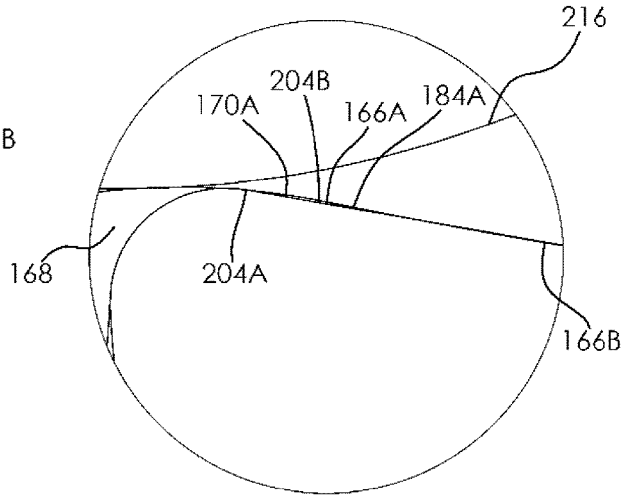
FIG. 72 is an enlarged view of the region 72 of FIG. 71.

In FIGS. 69-72 the helical offset involute curve 184A spans from points 204A/B and it is adjacent to the teardrop curve 170A. A shaft rotational position of 356° can be seen in FIG. 69. FIG. 70 is an enlarged view taken of the region 70 of FIG. 69. A shaft rotational position of 10 can be seen in FIG. 71. FIG. 72 is an enlarged view taken of the region 72 of FIG. 71. While the chamber 166A in FIG. 70 is relatively small, it is orders of magnitude smaller in FIG. 72. Given the lack of fluid communication with the high pressure opening 216, the pressure in chamber 166A may become excessively high in compression mode over this 5 degree incremental change in shaft rotational position. While there may be some leakage from chamber 166A, for example to the adjacent teardrop volume 168, if the shaft rotational speed is sufficiently high, this leakage may be so minimal from the flow becoming choked that the pressure and temperature is permitted to climb undesirably high. When reversibly operated in expansion mode, the volume in chamber 166A goes from being excessively small in FIG. 72 to orders of magnitude larger in FIG. 70. Typically chamber 166A would be sealed well enough from adjacent chambers, for example teardrop volume 168, such that the pressure in chamber 166A would become excessively low at a typical operational speed. This could cause cavitation damage as any lubricating oil and/or liquids present in the chamber become vapor at low pressure. When the implosion of liquid bubbles creates a shockwave that hits the adjacent rotor surfaces, this may cause erosion, vibration and lead to complete failure. Equivalent care should be taken when designing a low pressure passageway (not shown) for the same reasons described above. For example, the volume of chamber 166C may be excessively small in FIG. 69 and orders of magnitude larger in FIG. 71, giving rise to possible cavitation damage if chamber 166C is otherwise substantially sealed from adjacent chambers and/or a low pressure passageway.

Figure 73:
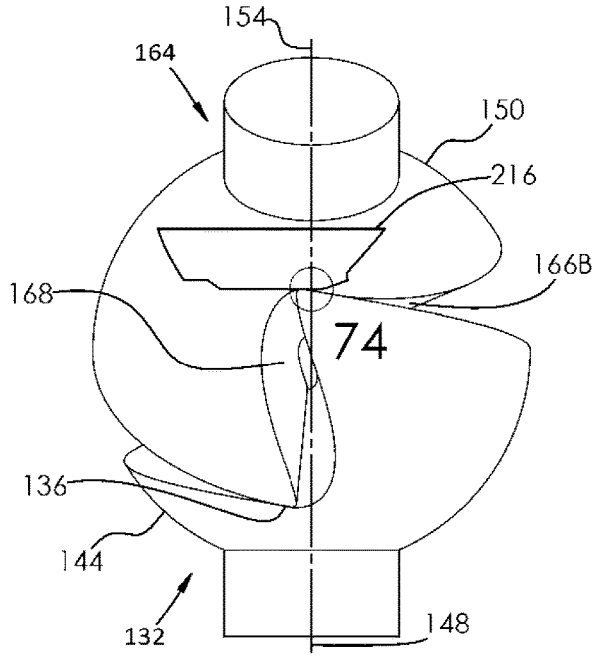
FIG. 73 is a bottom view of customized one lobe rotors using a helical involute with a midpoint of 180° and advanced offset involute curves intersecting near the lobe tip, forming a sawtooth assembly, with rotors in a 356° rotational position, including a high pressure opening
Figure 74:
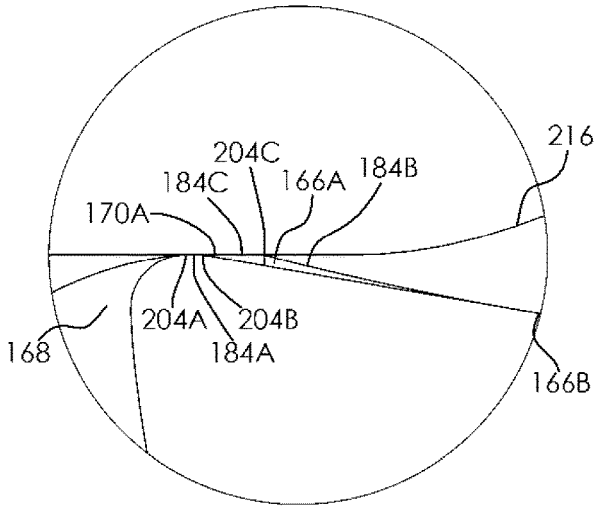
FIG. 74 is an enlarged view of the region 74 of FIG. 73.
Figure 75:
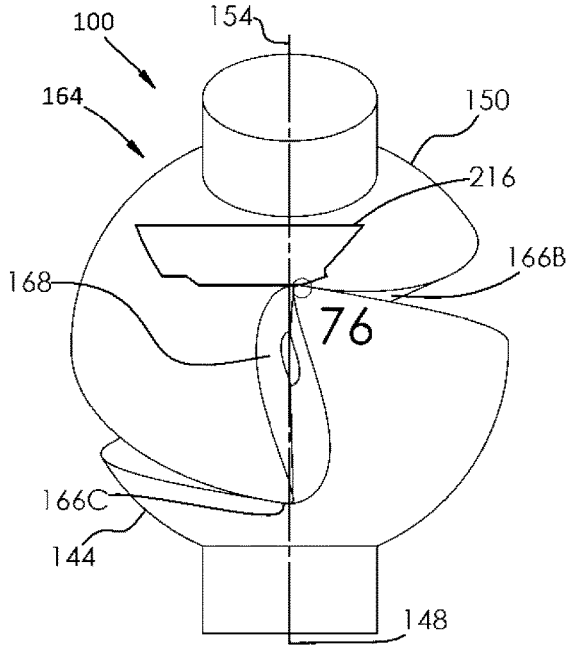
FIG. 75 is a bottom view of the components seen in FIG. 73, with rotors in a 1° rotational position, including a high pressure opening
Figure 76:
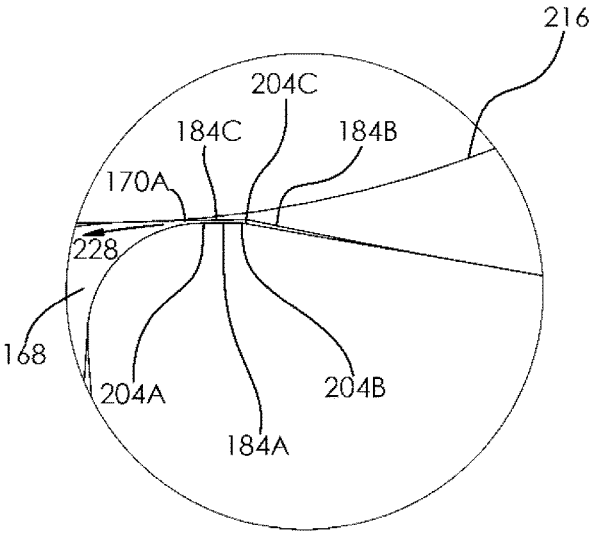
FIG. 76 is an enlarged view of the region 76 of FIG. 75.
Figure 77:
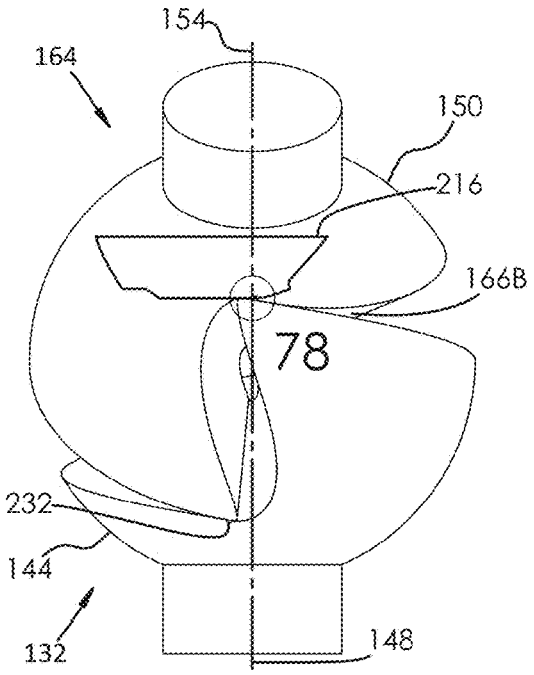
FIG. 77 is a bottom view of round lobe tip basic sawtooth one lobe rotors forming a sawtooth assembly, with rotors in a 356° rotational position, including a high pressure opening and recess

In FIGS. 73-76 the helical offset involute curve 184B spans from points 204B/C and the advanced offset involute curves 184A/C are adjacent to the teardrop curve 170A. A shaft rotational position of 356° can be seen in FIG. 73. FIG. 74 is an enlarged view taken of the region 74 of FIG. 73. A shaft rotational position of 1° can be seen in FIG. 75. FIG. 76 is an enlarged view taken of the region 76 of FIG. 75. The volume of chamber 166A in FIG. 74 may be similar to the volume of chamber 166A in FIG. 70. In compression mode, the high pressure from chamber 166A (FIG. 74) may naturally flow 228 into the lower pressure teardrop volume 168 as seen in FIG. 76. In FIG. 73 there is no small trapped chamber volume adjacent to valley 136 of the first rotor 144, helping to avoid possible cavitation. In compression mode, part of the teardrop volume 168 in FIG. 73 becomes chamber 166C in FIG. 75. As the shaft rotation angle is further increased, the pressure in chamber 166C (FIG. 75) would decrease, as expansion occurs, if it were not in fluid communication with a low pressure opening (not shown). The ease of porting with advanced offset involute curves 184A/C will be seen in subsequent sections.

Figure 78:
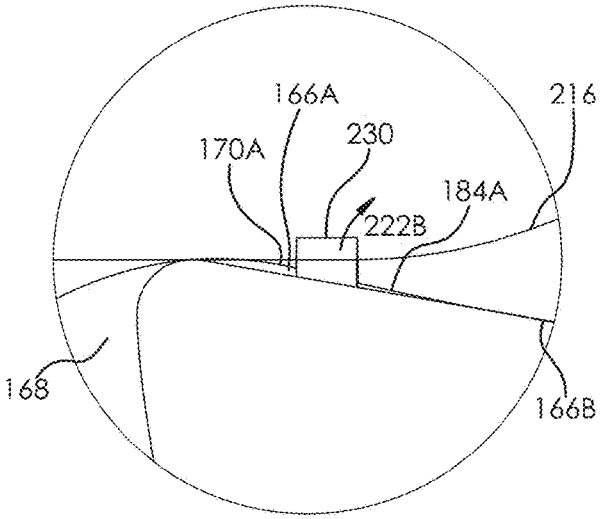
FIG. 78 is an enlarged view of the region 78 of FIG. 77.
Figure 79:
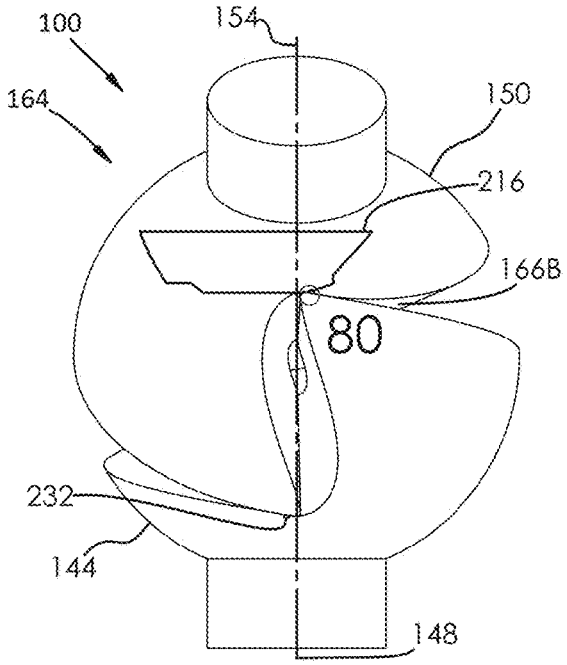
FIG. 79 is a bottom view of the components seen in FIG. 77, with rotors in a 1° rotational position, including a high pressure opening
Figure 80:
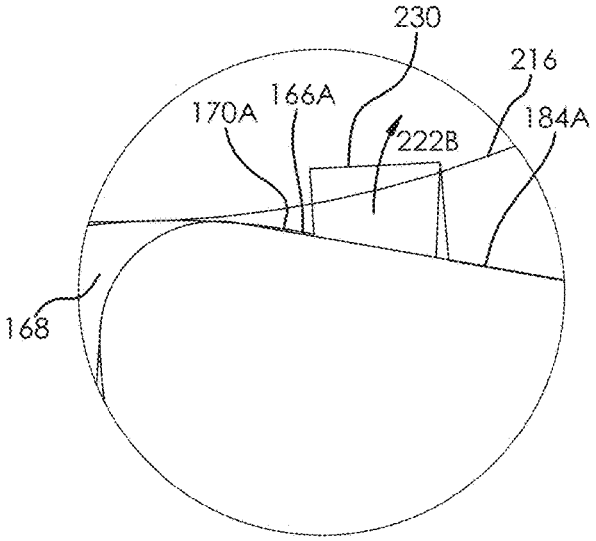
FIG. 80 is an enlarged view of the region 80 of FIG. 79.
Figure 81:
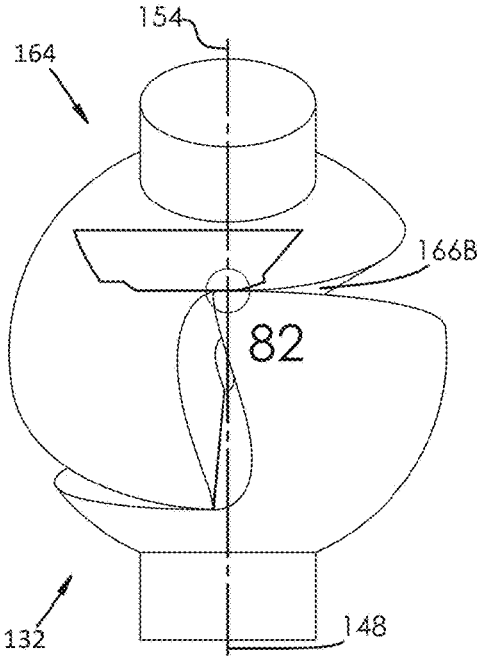
FIG. 81 is a bottom view of round lobe tip advanced sawtooth one lobe rotors forming a sawtooth assembly, with rotors in a 356° rotational position, including a high pressure opening

In FIGS. 77-80 recesses 230/232 were added to the helical offset involute curve 184A of FIGS. 69-72. A shaft rotational position of 356° can be seen in FIG. 77. FIG. 78 is an enlarged view taken of the region 78 of FIG. 77. A shaft rotational position of 1° can be seen in FIG. 79. FIG. 80 is an enlarged view taken of the region 80 of FIG. 79. Recess 230 in the valley of the second rotor 150 allows flow 222B from chamber 166A to the high pressure opening 216 in FIG. 78 and FIG. 80.

Figure 82:
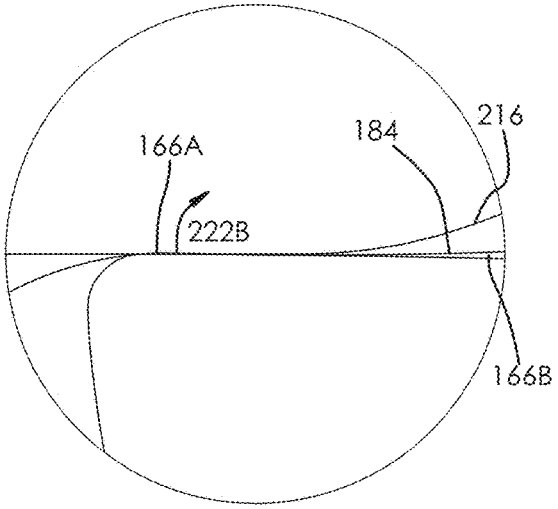
FIG. 82 is an enlarged view of the region 82 of FIG. 81.
Figure 83:
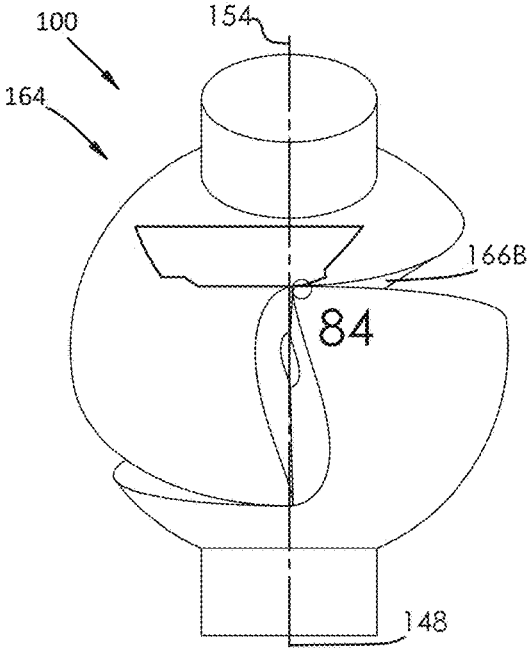
FIG. 83 is a bottom view of the components seen in FIG. 81, with rotors in a 1° rotational position, including a high pressure opening
Figure 84:
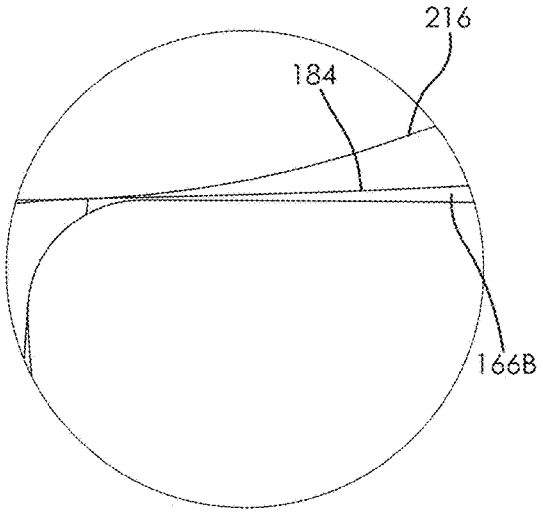
FIG. 84 is an enlarged view of the region 84 of FIG. 83.

In FIGS. 81-84 there are no helical offset involute curves; just the advanced offset involute curve 184. A shaft rotational position of 356° can be seen in FIG. 81. FIG. 82 is an enlarged view taken of the region 82 of FIG. 81. A shaft rotational position of 1° can be seen in FIG. 83. FIG. 84 is an enlarged view taken of the region 84 of FIG. 83. In FIG. 82, chamber 166A is already an exceptionally small volume, and substantially all of the remaining volume may flow 222B naturally to the high pressure opening 216. By the shaft rotation angle seen in FIG. 83/84, there is only one chamber, chamber 166B. For the one-lobe geometry examples provided, the pressure in the volumes adjacent to chamber 166A (See FIGS. 69-84) may be substantially equivalent to the pressure at the low pressure opening (not shown). If there is a volume of gas that is not forced into the high pressure opening 216, for example, the volume contained in recess 230 of FIG. 80, this relatively small volume at high pressure is mixed with a substantially larger volume at low pressure. When no volumetric capacity control is used, this adjacent volume may already be sealed from the low pressure opening (not shown), further reducing how minor the efficiency loss would be. Since the recesses 230/232 are only required to have enough cross-sectional flow area to address the start and end of the stroke, where relatively low instantaneous flow rates are anticipated, the resulting ratio of recirculated gas volume to maximum sealed chamber volume may be substantially smaller than disclosed in the prior art, to the Applicant's knowledge.

In the Applicant's opinion, relatively large instantaneous flow rates may warrant relatively slower speed operation and/or relatively large holes in prior art equipment compared to the small recesses 230/232 that are only responsible for addressing the start and end of the stroke where relatively low instantaneous flow rates are expected. That is, when the sawtooth rotor shafts are spinning at a constant velocity, the rate of change of the chamber volume decreases significantly at end of the stroke.

Figure 61:
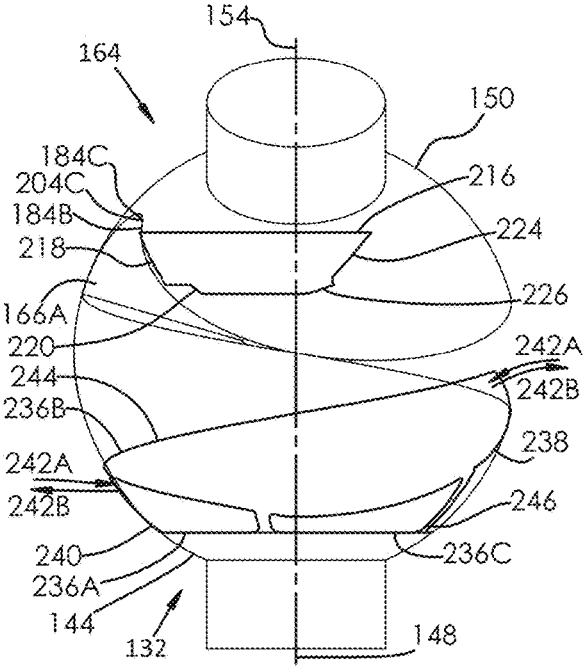
FIG. 61 is a bottom view of customized one lobe rotors using a helical involute with a midpoint of 180° and advanced offset involute curves intersecting near the lobe tip, forming a sawtooth assembly, with rotors in a 270° rotational position, including high/low pressure openings.
Figure 62:
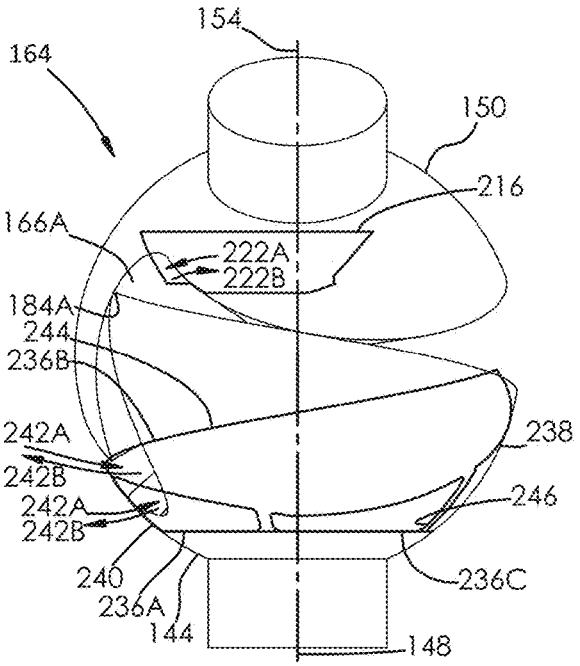
FIG. 62 is a bottom view of the components seen in FIG. 61, with rotors in a 300° rotational position, including high/low pressure openings.
Figure 63:
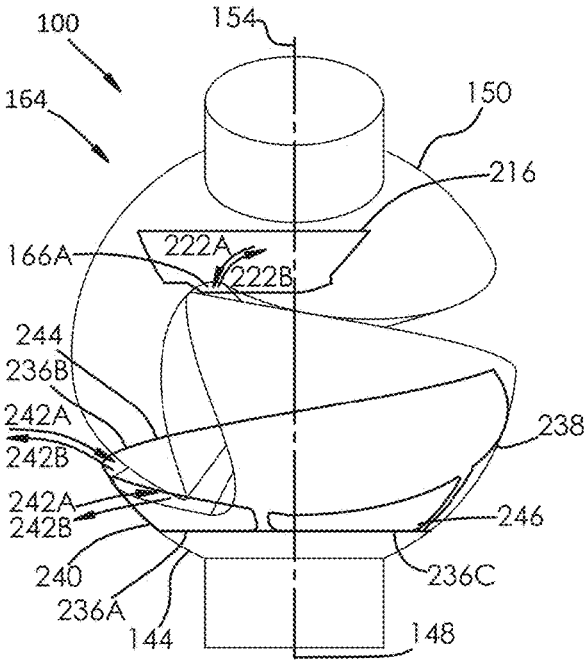
FIG. 63 is a bottom view of the components seen in FIG. 61, with rotors in a 330° rotational position, including high/low pressure openings.
Figure 85:
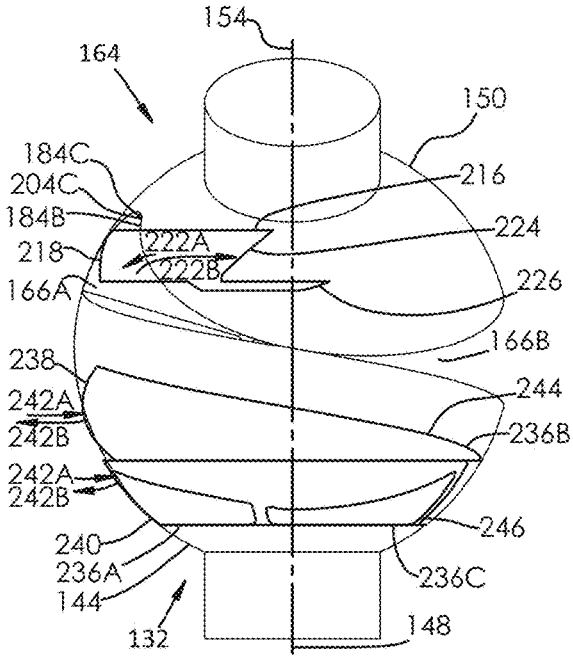
FIG. 85 is a bottom view of customized one lobe rotors using a helical involute with a midpoint of 180° and advanced offset involute curves intersecting near the lobe tip, forming a sawtooth assembly, with rotors in a 270° rotational position, including a second example of high/low pressure openings.
Figure 86:
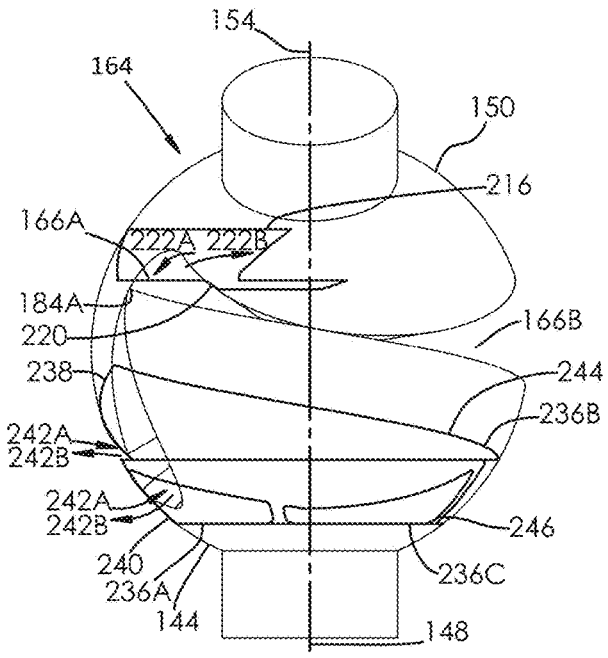
FIG. 86 is a bottom view of the components seen in FIG. 85, with rotors in a 300° rotational position, including a second example of high/low pressure openings.
Figure 87:
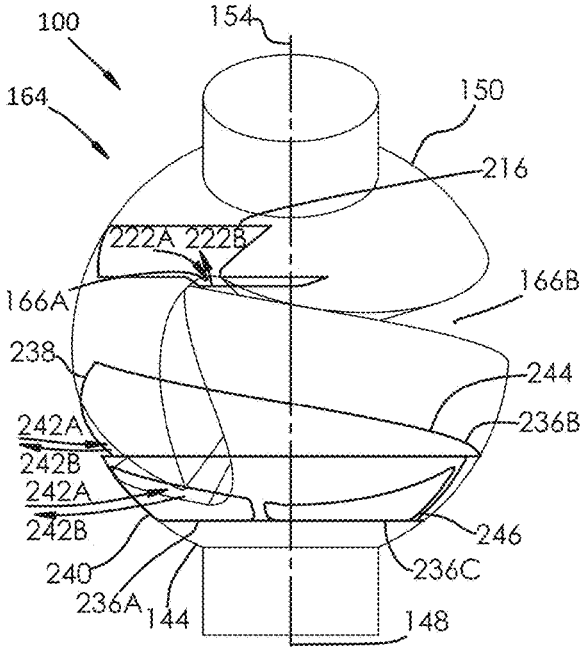
FIG. 87 is a bottom view of the components seen in FIG. 85, with rotors in a 330° rotational position, including a second example of high/low pressure openings.
Figure 93:
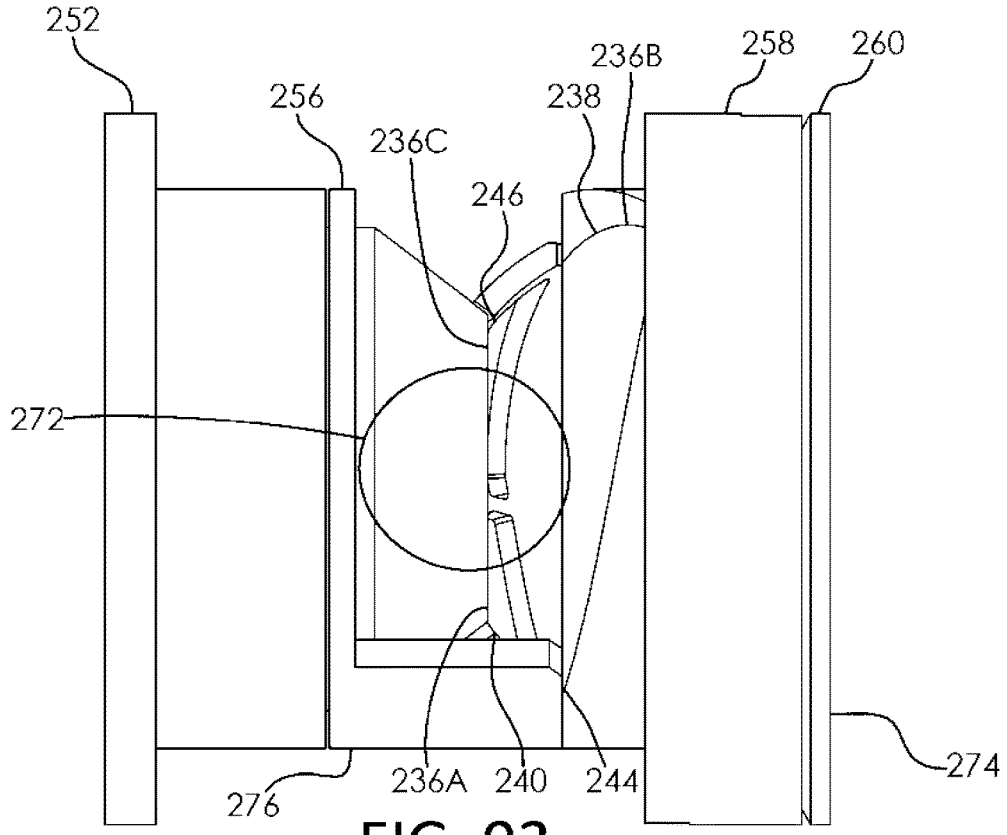
FIG. 93 is a top view of some of the components seen in FIG. 92, including the low pressure port and low/high pressure gates.
Figure 94:
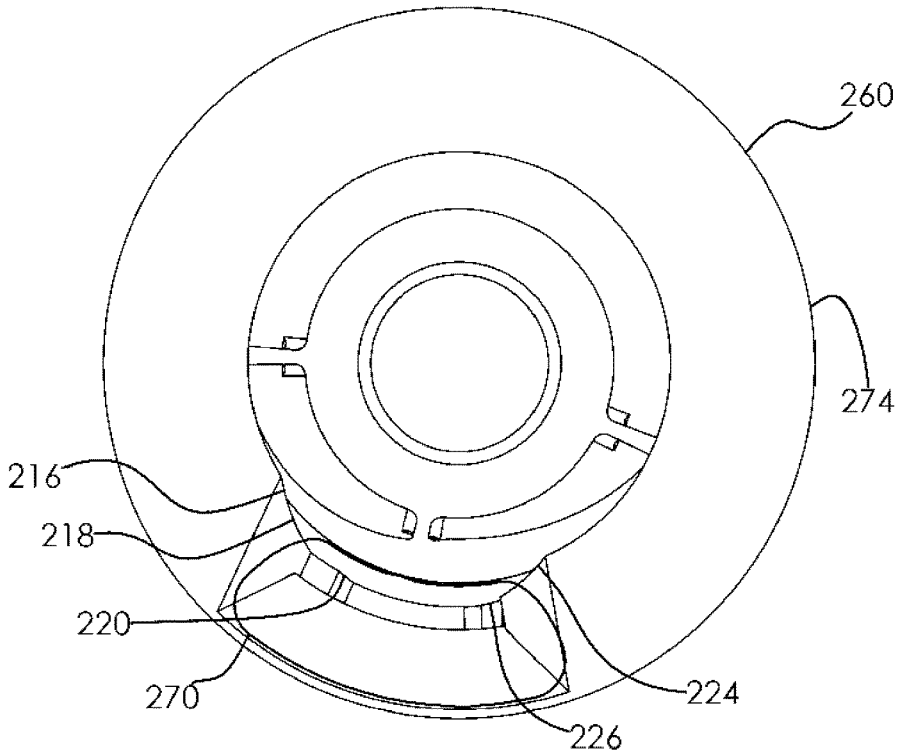
FIG. 94 is an end view of some of the components seen in FIG. 92, including the high pressure port and low/high pressure gates.

As seen in FIGS. 53-68, the high pressure opening 216 is formed by stationary components (not shown) as the chamber 166A simply moves past to allow flow 222B. In FIGS. 85-88 the high pressure opening 216 is circumferentially adjusted relative to the same sawtooth geometry 132 seen in FIGS. 61-64. Respective shaft rotational positions of 270°, 300°, 330° and 360° can be seen in FIGS. 85-88. The chambers 166A in FIG. 61 and FIG. 85 are substantially equivalent in size at this 270° rotational position. It is to be understood that the high pressure opening 216 in FIG. 61 may not be in fluid communication with chamber 166A, but the high pressure opening 216 in FIG. 85 allows flow 222B and that this adjustment may be gradually made while the first and second rotors 144/150 maintain their rotational speed. In the example provided, the circumferential position of leading edge 218 and trailing edge 224 were varied by substantially equivalent values. It may be desirable to leave fixed leading edge 220 and fixed trailing edge 226 as non-adjustable as long as the desired pressure ratio will not allow chamber 166A to be in fluid communication with the high pressure opening 216 prematurely. By leaving these edges 220/226 as stationary and non-adjustable, additional flexibility of leading edge 218 and trailing edge 224 may be possible while also preventing the adjacent low pressure chamber 166B from being in fluid communication with the high pressure opening 216. In the example seen in FIGS. 89-94, the central inner housing 258 comprises fixed leading edge 220 (FIG. 94) and fixed trailing edge 226 (FIG. 94). Also seen in FIG. 94 is the high pressure gate 260 comprised of leading edge 218 and trailing edge 224, where the high pressure opening 216 is comprised of edges 220/226/218/224. It is to be understood that the circumferential positions of leading and trailing edges 218/220/224/226 can be varied more than in the example provided and that there are no implied limitations regarding minimum or maximum circumferential spans between edges. Even so, the amount of flow area seen in the example of FIG. 85 may represent a step change improvement to what is disclosed in the prior art, allowing a substantially higher rotational speed for the same pressure drop across flow passageways and/or advantageously requiring a substantially lower pressure differential at the same rotational speed. A relatively high rotational speed may reduce the manufacturing costs by achieving a higher power density in a more compact design. It is noteworthy that little to no recirculated volume is introduced by the high pressure opening 216 and when sealing occurs at such a minimal amount of surfaces, this is expected to reduce internal inefficiencies and also lower production cost. For further clarity, the example seen in FIGS. 89-94 includes edges 220/226/218/224 on a stationary central inner housing 258 and a repositionable high pressure gate 260, which may increase the circumferential repositioning of edges 218/224 while maintaining a position of edges 220/226 that may be desired to efficiently and safely accommodate the end/start of respective compression/expansion strokes. However, it is to be understood that some or all of these edges may alternatively be included on just one of those components or on more than two components.

Low Pressure Opening

It is to be understood that the sawtooth geometry 132 seen in FIGS. 61-64 is substantially identical to the sawtooth geometry 132 seen in FIGS. 85-88. Respective shaft rotational positions of 270°, 300°, 330° and 360° can be seen in FIGS. 61-64. and FIGS. 85-88. As discussed above, the high pressure opening 216 in FIGS. 61-64 is a different shape in comparison to the high pressure opening 216 in FIGS. 85-88. It can also be noted that the low pressure opening 236 in FIGS. 61-64 is a different shape in comparison to the low pressure opening 236 in FIGS. 85-88. In the examples provided, the low pressure opening 236 is divided into three openings, labeled as 236A/B/C, but it is to be understood that this may not be typically required. This illustrates how low pressure openings 236A/C may have a fixed leading edge 240 and fixed trailing edge 246, while low pressure opening 236B may have an adjustable leading edge 238 and adjustable trailing edge 244. Keeping the low pressure openings 236A/B/C separate at substantially the same spherical diameter as the rotors 144/150 allows different fluids to flow 242A into the chambers, if configured in that manner. These fluids could vary in temperature and/or liquid/vapor fraction for example. In typical compression applications, flow 242A enters chambers via the low pressure opening(s) 236A/B/C and exits chambers via the high pressure opening 216 (i.e. flow 222B). In typical expansion applications, flows 222A/242B are illustrated to be in the opposite direction, proceeding from the high pressure opening 216 to the chamber before exiting via the low pressure opening(s) 236A/B/C.

Volumetric Capacity Control and Pressure Ratio Adjustment

Figure 64:
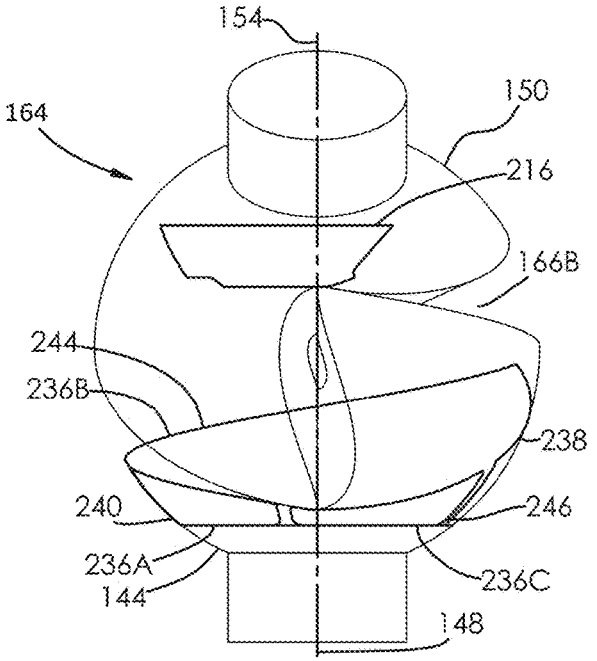
FIG. 64 is a bottom view of the components seen in FIG. 61, with rotors in a 360° rotational position, including high/low pressure openings.
Figure 65:
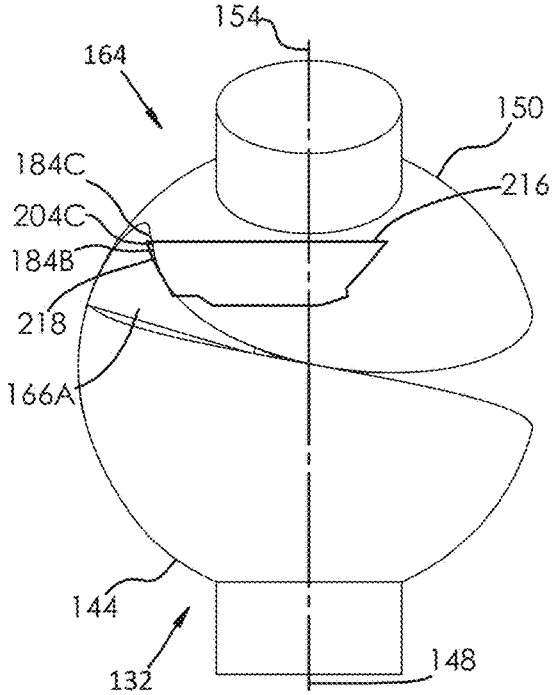
FIG. 65 is a bottom view of customized one lobe rotors using a helical involute with a midpoint of 180° and advanced offset involute curves intersecting relative further from the lobe tip, forming a sawtooth assembly, with rotors in a 270° rotational position, including a high pressure opening.
Figure 66:
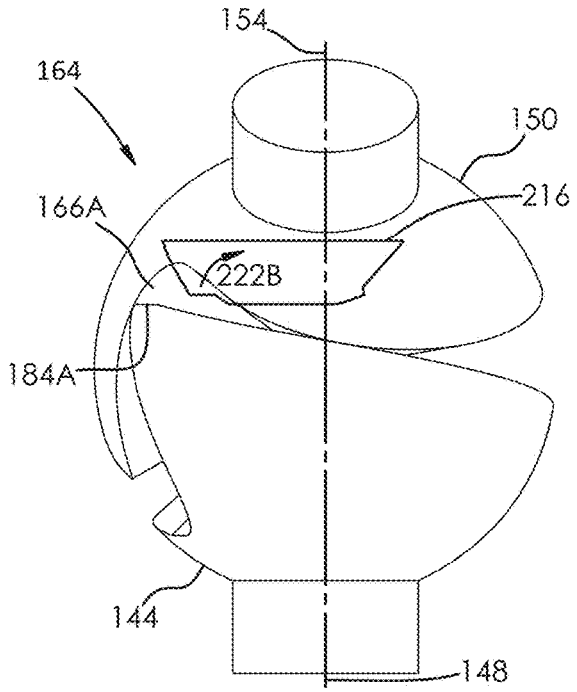
FIG. 66 is a bottom view of the components seen in FIG. 65, with rotors in a 300° rotational position, including a high pressure opening.
Figure 67:
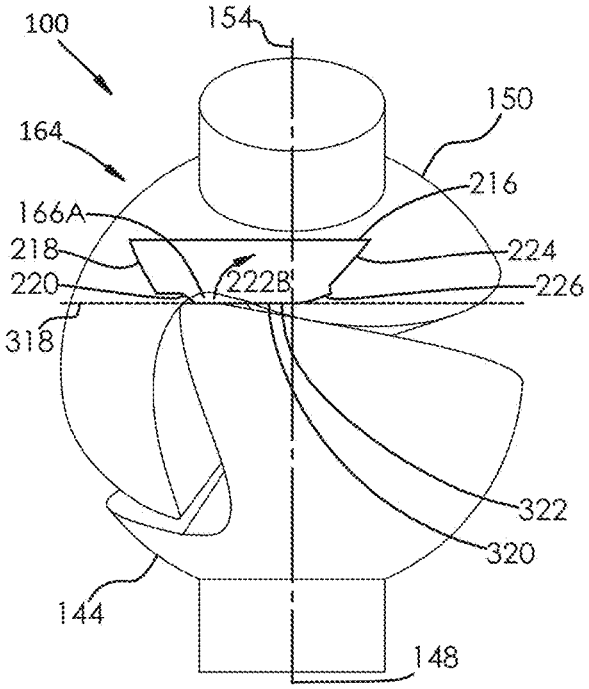
FIG. 67 is a bottom view of the components seen in FIG. 65, with rotors in a 330° rotational position, including a high pressure opening.
Figure 68:
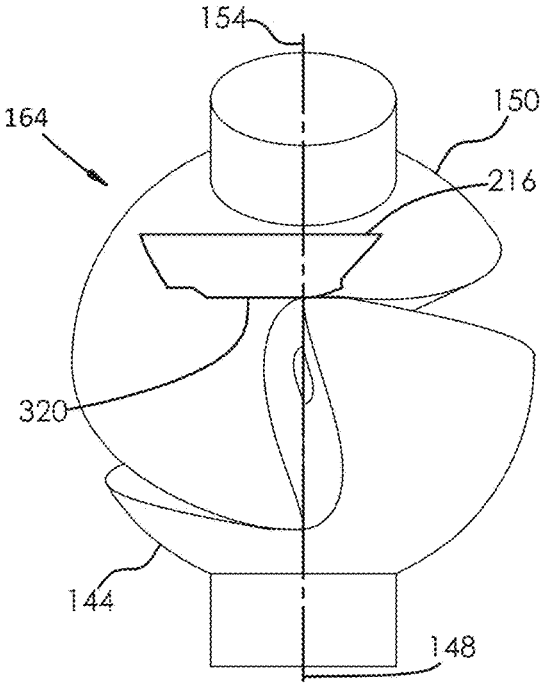
FIG. 68 is a bottom view of the components seen in FIG. 65, with rotors in a 360° rotational position, including a high pressure opening.
Figure 69:
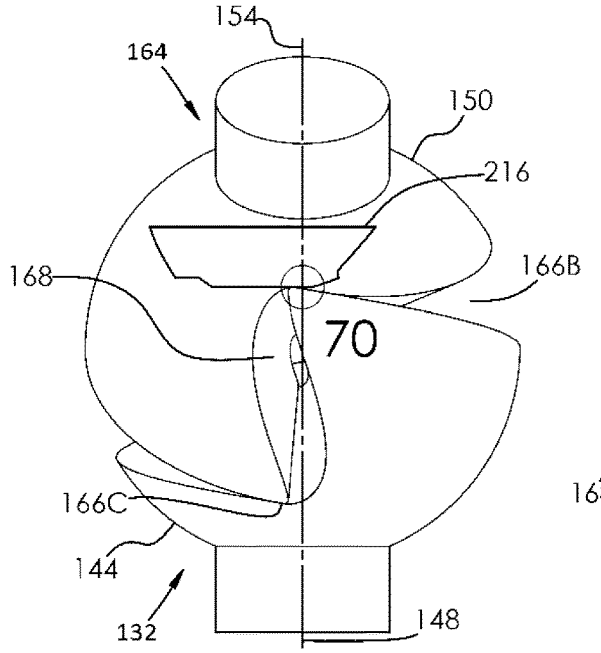
FIG. 69 is a bottom view of round lobe tip basic sawtooth one lobe rotors forming a sawtooth assembly, with rotors in a 356° rotational position, including a high pressure opening
Figure 88:
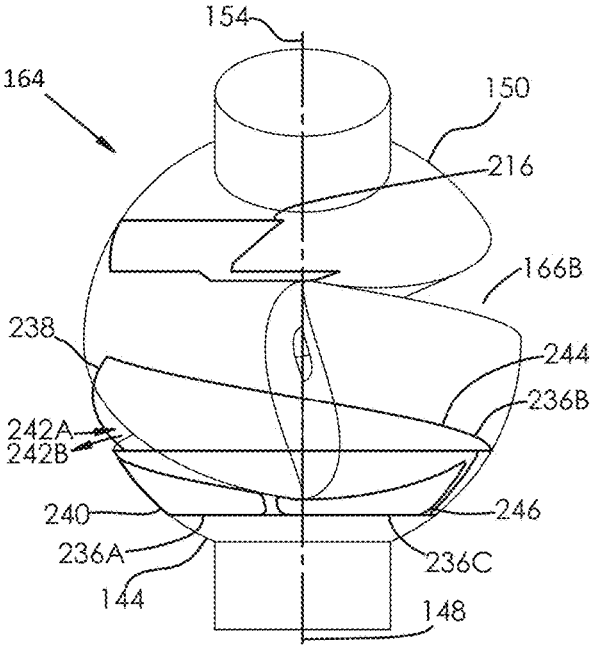
FIG. 88 is a bottom view of the components seen in FIG. 85, with rotors in a 360° rotational position, including a second example of high/low pressure openings.

Still referring to FIGS. 61-64 and FIGS. 85-88, the above sections provided examples of how the shapes of the low pressure opening(s) 236A/B/C and high pressure opening 216 may be modified. In FIG. 64 the rotors 144/150 are at a 360° shaft rotational position, where chamber 166B may be at a maximum volume and both the high pressure opening 216 and low pressure opening(s) 236A/B/C may not be substantially in fluid communication with chamber 166B. Therefore, in compression mode, the pressure in chamber 166B may increase as the volume decreases through subsequent changes in shaft rotational position. In FIG. 88 the same rotors 144/150 are at a 360° shaft rotational position, but chamber 166B is still in fluid communication with the low pressure opening 236B with flow 242A. In compression mode, as the volume of chamber 166B decreases through subsequent changes in shaft rotational position, flow 242B illustrates the expected directional change as fluid exits the chamber via the low pressure opening 236B. In the example provided, this fluid communication may be naturally sealed at a shaft rotational position of 180° (i.e. or equivalently, 360°+180°=540°), when chamber 166B may be around half the size that is seen in FIG. 88. It is to be understood that the fluid may not require a significant amount of compression work to flow back out the low pressure opening 236B and therefore, this method of volumetric capacity control may be particularly efficient. In one example, the efficiency may be approximately equivalent to an alternative configuration of the rotors, wherein the rotors themselves are made smaller to only allow approximately half of the volumetric flow rate of fluid. If around half of the fluid is sealed in a rotary positive displacement device, then around half of the volumetric flow rate is expected, and in this case, around half of the compression work may be required if all other variables are kept equal. Typically, traditional equipment known in the art introduces significant inefficiencies when volumetric capacity control is required, especially when the lack of flexibility of such traditional equipment requires the already compressed gas to be re-routed to the low pressure side for re-compression, and/or if significant throttling is required at the low pressure side. While these comments are made in regards to compression, it will be appreciated that traditional equipment faces similar inefficiencies when attempting volumetric capacity control in the expansion processes.

It is also understood that if the working fluid has gas present, then for a rotary positive displacement device to be efficient, the chamber should experience a noticeable change in volume while it is substantially sealed from both the high pressure opening 216 and low pressure opening(s) 236A/B/C. This ideal change in volume is dependent on a number of variables, including the gas composition, solid and/or liquid entrainment and the upstream/downstream pressures and temperatures. It may be typical for the position of the high pressure opening 216 and low pressure opening(s) 236A/B/C to be optimally set to allow for a chamber to change volume while sealed therebetween by a "volume ratio" that corresponds to the upstream and downstream pressures, forming a "pressure ratio". In compression, the chamber increases in pressure as the volume decreases and there is an efficiency penalty if that chamber becomes in fluid communication with the high pressure opening 216 too early or too late. Similar efficiency penalties are expected in expansion mode where additional flow is required to produce the desired amount of power. It is also understood that strain gauges (not shown) affixed to rotational shafts may be used to determine torque and therefore power at a given rotational speed. Therefore, in this manner the control system may facilitate adjustment to the optimal shapes of these openings 216 and 236/A/B/C on-the-fly by minimizing the ratio of power/flow in compression and maximizing the ratio of power/flow in expansion. Often, only a certain amount of power is available or required and these adjustments may allow the equipment to still successfully operate within torque capabilities of attached equipment such as a motor or generator. It will be appreciated that a motor consumes electricity to power a compressor and an expander produces electricity via a generator, which may be a motor operating in reverse. In some embodiments, the sawtooth assembly 164 may be capable of considerable volumetric capacity control and pressure ratio flexibility such that substantially similar power and/or flow may be maintained over a wide range of gas compositions and upstream/downstream pressures and temperatures. It may also be possible for a chamber to be in fluid communication with both the high pressure opening 216 and low pressure opening(s) 236/A/B/C simultaneously, for example Chamber 166A in FIG. 101, which can be useful to reduce torque in compression mode. When an engine is used as a driver, it may have particularly low torque capabilities at low rotational speeds, so being able to unload the compressor may allow a smaller engine to get up to speed without requiring a clutch. In expansion, there may be situations where the flow through the equipment should be maximized to satisfy other objectives in the surrounding process/system and short circuiting the chamber in this manner may be helpful to this purpose.

For further clarity, any combination of housing and gate components may be used to form the low pressure opening(s) 236A/B/C and high pressure opening 216. The low pressure gate is understood to have a low pressure aperture which may be circumferentially repositioned to align the low pressure aperture with each chamber of the at least two chambers such that each chamber will pass the low pressure aperture and be sealed by the low pressure gate at a selected volumetric capacity and maintain a selected pressure ratio. The high pressure gate is understood to have a high pressure aperture which may be circumferentially repositioned to align the high pressure aperture with each chamber of the at least two chambers such that each chamber will pass the low pressure aperture and be sealed by the high pressure gate at a selected volumetric capacity and maintain a selected pressure ratio (or selected volume ratio). In other words, the high pressure gate and/or the low pressure gate may be used for volumetric capacity control and to maintain a selected pressure ratio (or selected volume ratio). In one example, in compression or expansion mode it may be preferred to use the low pressure gate for volumetric capacity control and subsequently circumferentially reposition the high pressure gate to maintain a selected pressure ratio (or selected volume ratio) because it may be easier to maximize volumetric capacity. However, it is to be understood that the high pressure gate may be used for volumetric capacity and the low pressure gate may be used to maintain a selected pressure ratio (or selected volume ratio).

The following are illustrative examples of how the devices and methods disclosed herein may be utilized in practical applications. These examples are provided for illustrative purposes only, and are not intended to be limiting.

Remote Power Example—Utilities

Many companies may require relatively small amounts of power at remote locations, for example to facilitate remote monitoring and to actuate valves. In one example, 200 W of power may be required year-round. Compressors are used along natural gas pipeline networks to convey natural gas to end users. For example, utility companies may throttle the pressure down to less than 100 psig upstream of cities for safer distribution to residential and commercial buildings. In Alberta, Canada it may be typical for the pressure upstream of these sites to approach 900 psig in the summertime, when usage is lower, and be drawn down to around 400 psig in the winter time when usage is higher. Since 200 W is such a low power requirement, it may be typical to divert only a small percentage of the flow, as required, to a parallel pathway for that power generation. In this scenario there may be limitations to how much flow may be diverted without interfering with the control system that is throttling the main gas stream. A higher efficiency expander is expected to reduce flow requirements accordingly. Using these numbers as a demonstrative example, let's say that the operational specification is to be able to produce 200 W of power from 900 psig being expanded down to around 60 psig to 100 psig and also produce 200 W of power from 400 psig being expanded down to around 60 psig to 100 psig. The pressure ratio of 900 psig being expanded down to 60 psig is higher than 400 psig being expanded down to 100 psig.

Thermodynamically, if the flow rates were equivalent, it is theoretically possible to produce more power in the higher pressure ratio example. However, the flow rate, and therefore power associated with positive displacement devices depends on the amount of working fluid that may be sealed. For example, if an inflexible prior art device were used, or if the low pressure openings 236A/B/C seen in FIGS. 61-64 were kept in that same position for both of these scenarios, the 400 psig to 100 psig scenario may produce around twice as much electricity as the 900 psig to 60 psig scenario. To produce substantially equivalent power without requiring shaft speed adjustments, the 400 psig to 100 psig scenario could have low pressure openings 236A/B/C as positioned in FIGS. 85-88 to reduce the expected flow by around half and therefore the power to 200 W. For the 900 psig to 60 psig scenario, low pressure openings 236A/B/C may be positioned as seen in FIGS. 61-64 to maximize volumetric throughput to produce the 200 W.

The shape/position of the high pressure opening 216 was varied in FIGS. 61-64 compared to FIGS. 85-88; it is to be understood that any desirable position may be selected to optimize the efficiency of the operational examples provided. Having the ability to produce the desired amount of power may, for example, eliminate the need for a resistor bank. These details are highlighted because it is expected that the sawtooth assembly 164 is capable of efficiently operating per this example performance specification and to the best of the knowledge of the applicant, there is no other known piece of equipment with comparable performance. It is believed that all other known pieces of equipment would require a control valve upstream of the expander to adjust the system to account for changes in pressure differential or power generation requirements. For example, it will be appreciated that a throttling process upstream of the expander could be used to substantially maintain a pressure of around 400 psig upstream of the expander year-round. Traditional expanders may claim to be acting as a power-generating pressure reducing valve in this operational scenario that substantially lacks the capability to adjust the volumetric flow rate. However, in this operational scenario, the sawtooth assembly 164 adequately adjusts the volumetric flow rate to function as a power-generating gas control valve. Additionally, the Rotary Positive Displacement Device 100 may seamlessly adapt to varying working fluid compositions. As an example, if increasing percentages of hydrogen are introduced into natural gas pipelines, this is not a concern for the Rotary Positive Displacement Device 100.

0-100% Volumetric Capacity Control

Figure 101:
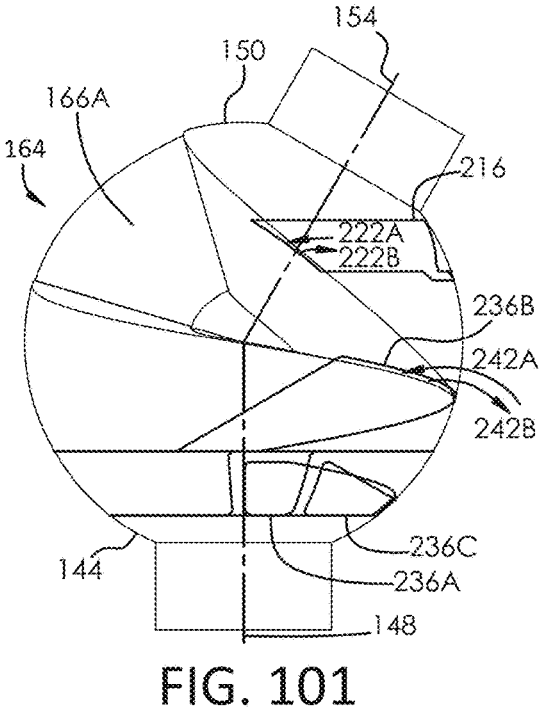
FIG. 101 is a side view of the components seen in FIG. 85, with rotors in a 172.5° rotational position and including the same example of high/low pressure openings illustrated in FIG. 85.
Figure 102:
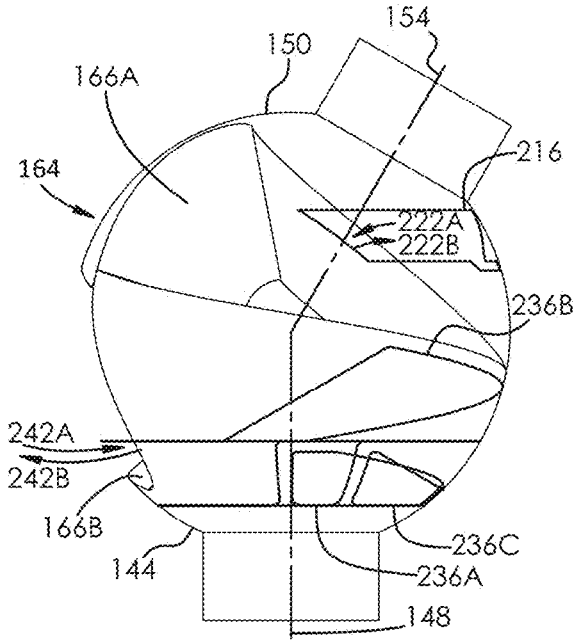
FIG. 102 is a side view of the components seen in FIG. 85, with rotors in a 202.5° rotational position and including the same example of high/low pressure openings illustrated in FIG. 85.

While the examples provided do not quantitatively imply any limitation of the equipment, it is to be understood that the sawtooth assembly 164 may have additional forms of volumetric capacity control flexibility. It will be appreciated that the full range of 0-100% volumetric capacity control may be desired in many (power-generating) control valve applications. In-line/series operation may require the expander to allow passage of variable amounts of flow. If the working fluid composition and upstream/downstream pressures and temperatures would produce more power than the electrical generator is rated for, then it may be desirable to operate less efficiently, increasing volumetric throughput accordingly. This may be accomplished by reducing the volume ratio that is sealed as a chamber passes between the high pressure opening 216 and the low pressure opening(s) 236A/B/C up to the extreme scenario, for example as seen in FIG. 101, where the chamber is simultaneously in fluid communication with both the high pressure opening 216 and low pressure opening(s) 236A/B/C to allow as much volumetric throughput as possible with minimal pressure loss as the fluid flows through the expander. It was described how volumetric throughput may be reduced in a similar manner. Additionally, looking to FIG. 92, if first rotor shaft 146 and/or second rotor shaft 152 have electrical generator(s) attached, Variable Frequency Drive(s) (VFDs) may be used to adjust the respective shaft rotational speeds. It will be appreciated that for rotary positive displacement equipment, this method may reduce volumetric throughput accordingly, although a VFD may increase the cost of the device. The sawtooth assembly 164 may allow for a higher ratio of chamber volume/chamber cross sectional flow area at perimeter relative to known prior art. This may reduce leakage at low speeds accordingly. Since the sawtooth assembly 164 may provide for reversible compressor/expander operation without modifications to internal structures, if an unacceptable amount of flow is passing through the equipment, compression mode may be periodically turned on to counteract the internal leakage. This compression mode functionality may also be desirable for companies to substantially evacuate working fluid from the low pressure side of the sawtooth assembly 164, for example if maintenance is required. In such scenarios it may be common practice to vent or flare the natural gas contained at the low pressure side, so companies may avoid or significantly reduce such economic penalties with the sawtooth assembly 164.

Figure 89:
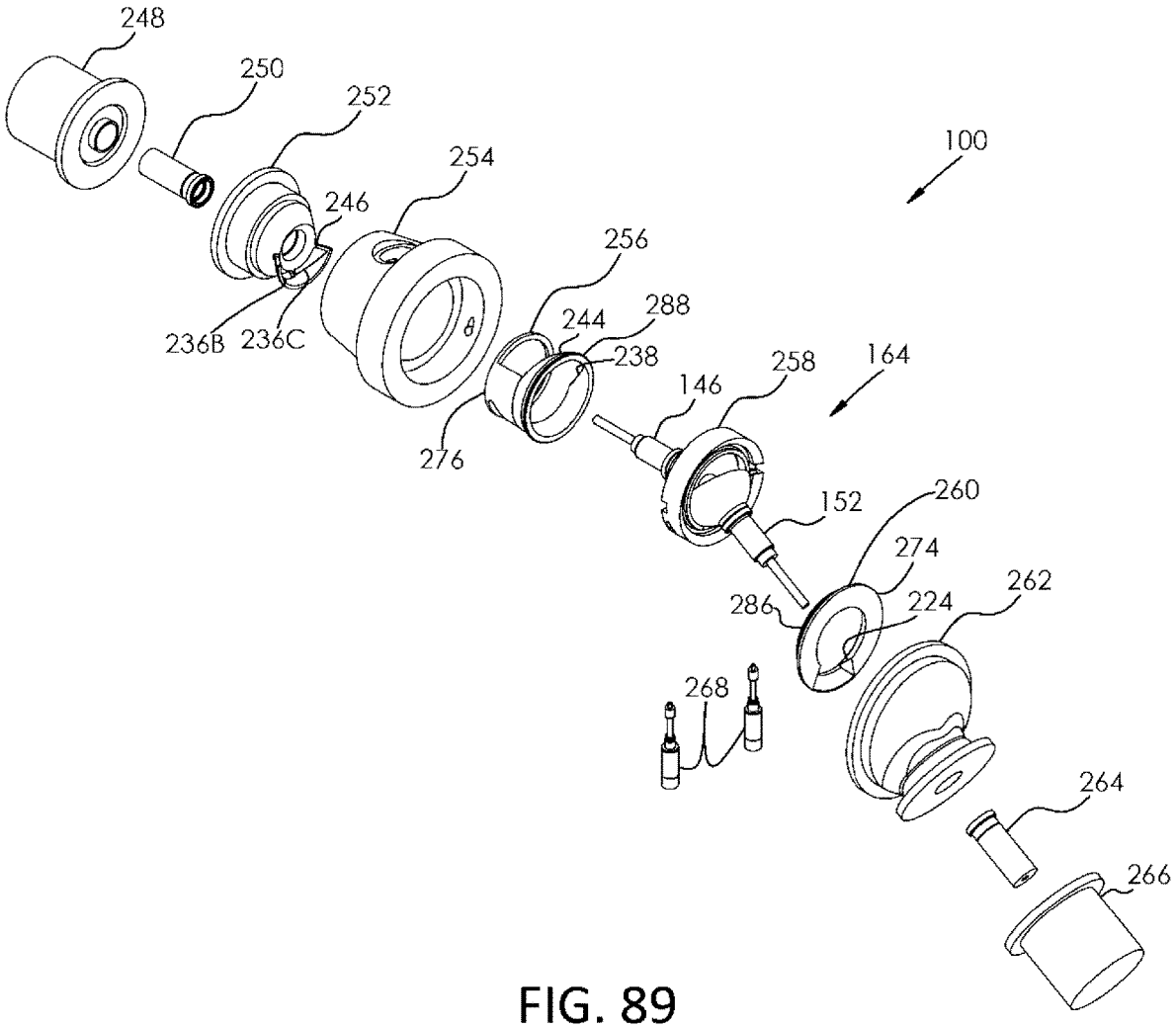
FIG. 89 is an exploded view of one example of the disclosed Rotary Positive Displacement Device with the same components also seen in FIG. 92.
Figure 90:
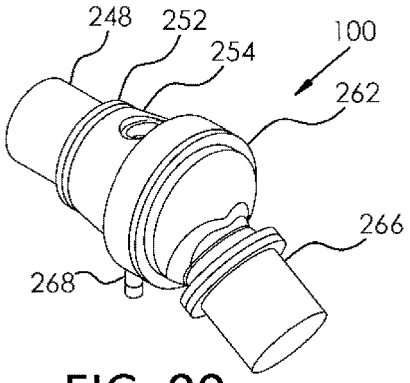
FIG. 90 is an isometric view of the same example of the disclosed Rotary Positive Displacement Device seen in FIG. 89.

As an additional safety precaution, the upstream and downstream sides of the sawtooth assembly 164 may be sealed to substantially prevent internal leakage when the equipment is not in service. Looking to FIG. 89, an exploded view is provided as an example of components that may be present in a sawtooth assembly 164 to facilitate the shapes of the high pressure opening 216 and low pressure opening 236A/B/C seen in FIGS. 53-88. These components are assembled in FIG. 90. In FIG. 89, a sawtooth assembly 164 may be seen with an immediately adjacent central inner housing 258. It is to be understood that the low pressure gate 256, first outer housing 254, first inner housing 252, first rotor end assembly 250 and first motor assembly 248 that are seen to be substantially concentric with the first rotor shaft 146 may be assembled in the order displayed. It is also to be understood that the high pressure gate 260, second housing 262, second rotor end assembly 264 and second motor assembly 266 that are seen to be substantially concentric with the second rotor shaft 152 may be assembled in the order displayed. Subsequently, the two gate actuator assemblies 268 may be vertically positioned in this image to rest inside of the first outer housing 254 and central inner housing 258. It is to be understood that while gravity may act vertically downwards, this is not a requirement. The first inner housing 252 has the fixed trailing edge 246 and low pressure openings 236B/C labeled. It is to be understood that the low pressure gate 256 may be circumferentially positioned with adjustable leading edge 238 and adjustable trailing edge 244 to define part of the boundary of the low pressure opening 236A seen in FIGS. 61-64. The central inner housing 258 and high pressure gate 260, with adjustable trailing edge 224 visible, in cohort may be used to define part of the high pressure opening 216 seen in FIGS. 61-64.

Figure 91:
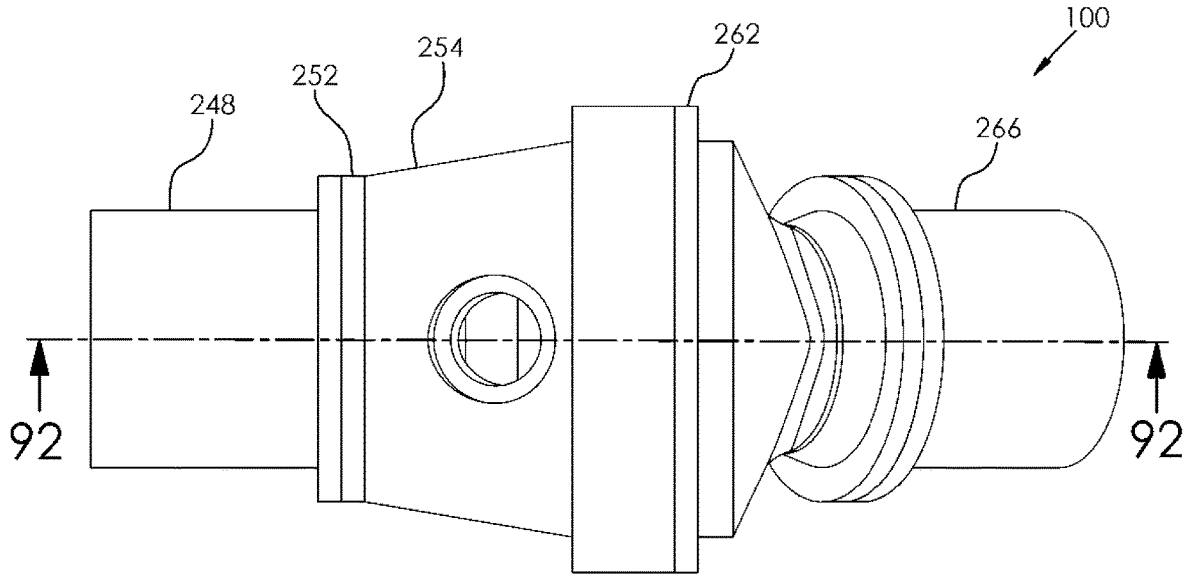
FIG. 91 is a top view of the same example of the disclosed Rotary Positive Displacement Device seen in FIG. 89.

The component assemblies and components seen in FIG. 89 may also be seen in FIG. 91 and FIG. 92, which are discussed further in below sections. FIG. 91 is a top view of the Rotary Positive Displacement Device 100 and Section 92 may be seen in FIG. 92. High pressure port 270 and low pressure port 272 are introduced in FIG. 92 and can be seen in FIGS. 93-96. In FIG. 93 a top view is shown with some of the components seen in FIG. 92. In FIG. 94 an end view, looking from the second rotor side, is shown with some of the components seen in FIG. 92. In FIGS. 93-94, the low pressure gate 256 and high pressure gate 260 are circumferentially positioned to reflect substantially the same shape of high pressure opening 216 and low pressure openings 236A/B/C seen in FIGS. 61-64 where substantially 0% volumetric capacity control is expected. In other words, these rotational positions may facilitate a maximum volumetric throughput while efficiently addressing a particular fluid composition and desired ratio of upstream/downstream pressures and temperatures. Therefore, in this example, the high pressure port 270 and low pressure port 272 are substantially unobstructed by the outer high pressure seal 274 and outer low pressure seal 276, respectively. It will be appreciated that lower fluid velocities and lower pressure drop is expected when the flow path has a relatively larger cross sectional flow area.

Figure 95:
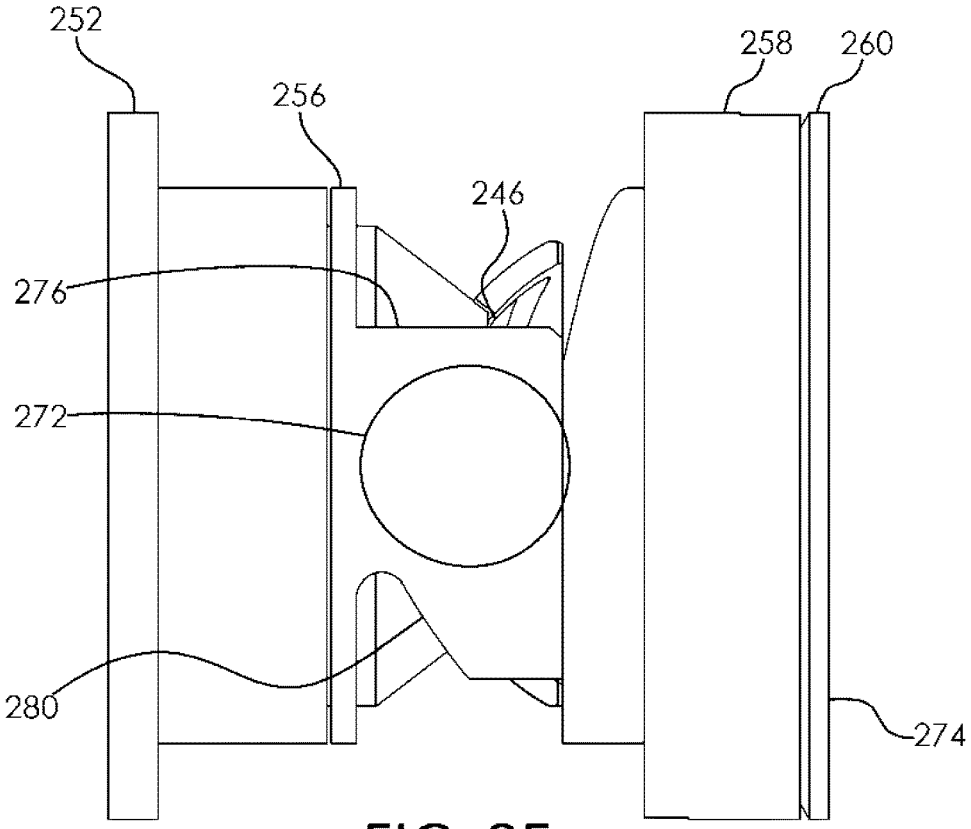
FIG. 95 is a top view of the components seen in FIG. 93, with low/high pressure gates both seen in a second rotational position.
Figure 96:
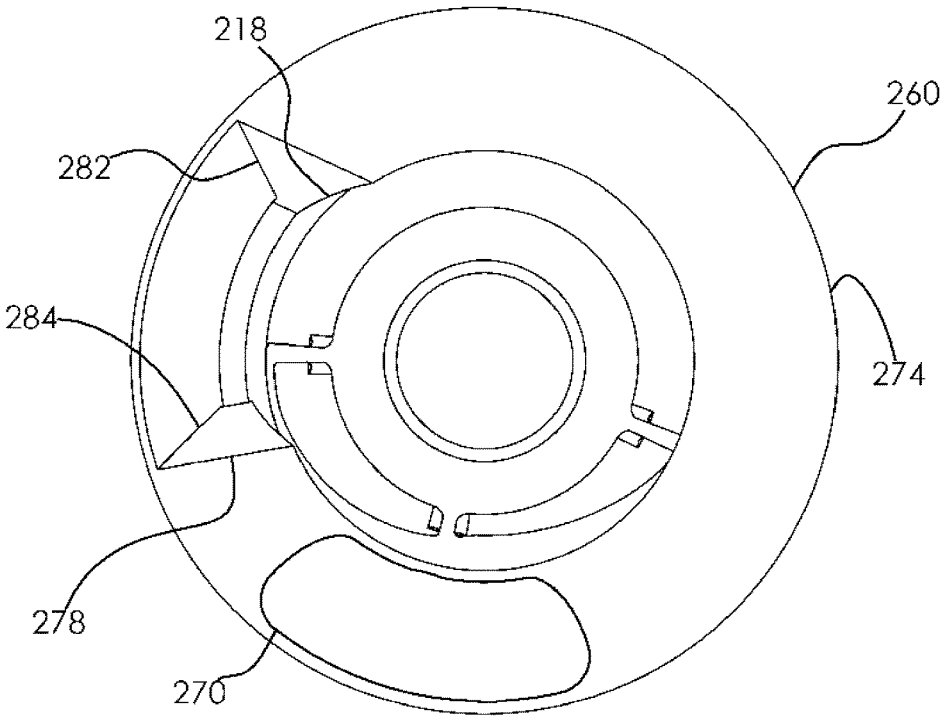
FIG. 96 is an end view of the components seen in FIG. 94, with low/high pressure gates both seen in a second rotational position.

Another example may be seen in FIGS. 95-96 where the respective top view and end view (i.e. looking from the second rotor side) may be seen with the same components seen in FIGS. 93-94. In this example, the low pressure gate 256 is rotationally positioned such that the outer low pressure seal 276 is substantially obstructing the low pressure port 272. Additionally, in this example, the high pressure gate 260 is rotationally positioned such that the outer high pressure seal 274 is substantially obstructing the high pressure port 270. While these obstructions may independently be capable of preventing substantial flow, the first/second rotors may be held in a stationary position by first and/or second motors with chambers in a position that are not simultaneously in fluid communication with both the high pressure opening 216 and low pressure opening(s) 236A/B/C. It is to be understood that this is a third method of reducing internal leakage and that if there is still internal leakage through the Rotary Positive Displacement Device 100, compressor mode may be engaged to prevent the leakage and/or allow flow from the low pressure side to the high pressure side of the equipment. In the example provided in FIG. 96, the outer high pressure seal 274 is a substantially planar surface. However, it is to be understood that this surface and the substantially mating surface of the high pressure opening 270 may be any shapes that best meet the desired design objectives. For example, these surfaces may be substantially cylindrical or substantially frusta-conical. The edge 278 of the outer high pressure seal 274 may be tapered to provide a smoother transition and/or a variable gap between the outer high pressure seal 274 and the high pressure port 270 may be desired.

In the example provided in FIG. 95, the outer low pressure seal 276 is a substantially cylindrical surface. However, it is to be understood that this surface and the substantially mating surface of the low pressure opening 272 may be any shapes that best meet the desired design objectives. For example, these surfaces may be substantially planar or substantially frusta-conical. The edge 280 of the outer low pressure seal 276 may be formed at any angle or depth to provide a smoother transition and/or a variable gap between the outer low pressure seal 276 and the low pressure port 272 may be desired. As another example, one or more holes (not shown) may be provided in the outer low pressure seal 276, for example, to provide varying cross sectional flow area through portions of the low pressure seal 276. It is to be understood that the example edge 280 seen in FIG. 95 may achieve a similar purpose when the rotational position of the low pressure gate 256 has the outer low pressure seal 276 only partially obstructing the low pressure port 272.

Actuation of Gates

It is to be understood that in the examples provided herein, the low pressure gate 256 and high pressure gate 260 may be rotationally positioned from 0° to 360° rotational positions or even angles exceeding 360°. In some applications it may be desirable to quickly ramp to substantially 0% volumetric throughput. Typically, if the rotational inertia of the motor components and first/second rotors 144/150 is relatively low, it may be sufficiently fast for the driver itself to provide braking horsepower until the rotating components come to rest. In one example, the driver is a motor, which is understood to be reversibly operated as a generator. If a motor were used to rotate components fixed to the first/second rotors 144/150 in a sense to provide compression work, then simply stopping the input electrical current or even reversing the direction may quickly cause the rotating components to come to rest. If a generator were producing electricity when a sudden stop is desired, then the electrical current may be reversed to attempt to provide compression work until the rotating components come to rest. If the sufficient volumetric throughput reduction may be provided quick enough from the actions of the motor/generator and attached components, then the actuation of the gates 256/260 may not need to be relatively fast-acting. Often it is desirable for control systems to control relatively slow-acting actuation components, which may include reducing the measurement speed and therefore cost of required sensors and/or impact of inertial effects and measurement lag.

The position of a gate may be impacted by the net loading in the circumferential direction, which is tangent to the motion. The high pressure gate 260 seen in FIG. 96 may experience little to no net loading in the circumferential direction from pressure loads since the projected areas of the leading high pressure surface 282 and trailing high pressure surface 284 may have substantially identical projected areas in respective planes perpendicular to the circumferential movement and the weighted average of the total pressure is substantially identical. Since the total pressure does take into account the dynamic pressure associated with bringing the fluid, which has direction-specific kinetic energy, to rest at the wall, it is possible for the total pressure to vary at surfaces 282/284, resulting in some amount of net loading. However, this may typically be quite a negligible amount of net loading compared to alternate designs, for example in the prior art, that have significant differences in said projected areas and/or total pressures acting on those areas. Net loading in the circumferential direction acts to rotationally re-position the gate and net loading in radial or axial directions increases dynamic and static friction, in one example even causing unacceptable misalignment of the component in extreme scenarios. It is to be understood that the working fluid pressure may be applied accordingly to opposing surfaces of a gate 256/260 by introducing holes and seals (not shown) to reduce net loading in radial or axial directions, if desired. The friction which tends to prevent stationary surfaces from being set in motion is defined as "stiction", which is a common problem that valves and other actuated components experience, which may present some challenges for the control system. For example, if it is more challenging to predict when the component will move, it may be more challenging to actuate the component appropriately. The gates 256/260 may have exceptionally low net loading in the circumferential direction as well as relatively low frictional forces, which may reduce the size and cost of the respective actuators. There are potential challenges in controlling actuators, including one challenge commonly known as "hunting", where the system first overcorrects itself in one direction and then overcorrects itself in the opposite direction. Additionally, if the actuation component undesirably drifts out of the correct position over time, additional energy is required to correct this position. It will be appreciated that a self-locking gear profile, such as a worm gear profile, used in cohort with an actuator may hold the actuator component in the desired location without expending energy. Additionally, sensors may be used to measure the rotational position of the actuator shaft and the position of the actuator component may be determined accordingly. Generally, the gear ratio may be quite high, so this method may be the most suitable when the actuator component does not need to be positioned quickly.

Figure 97:
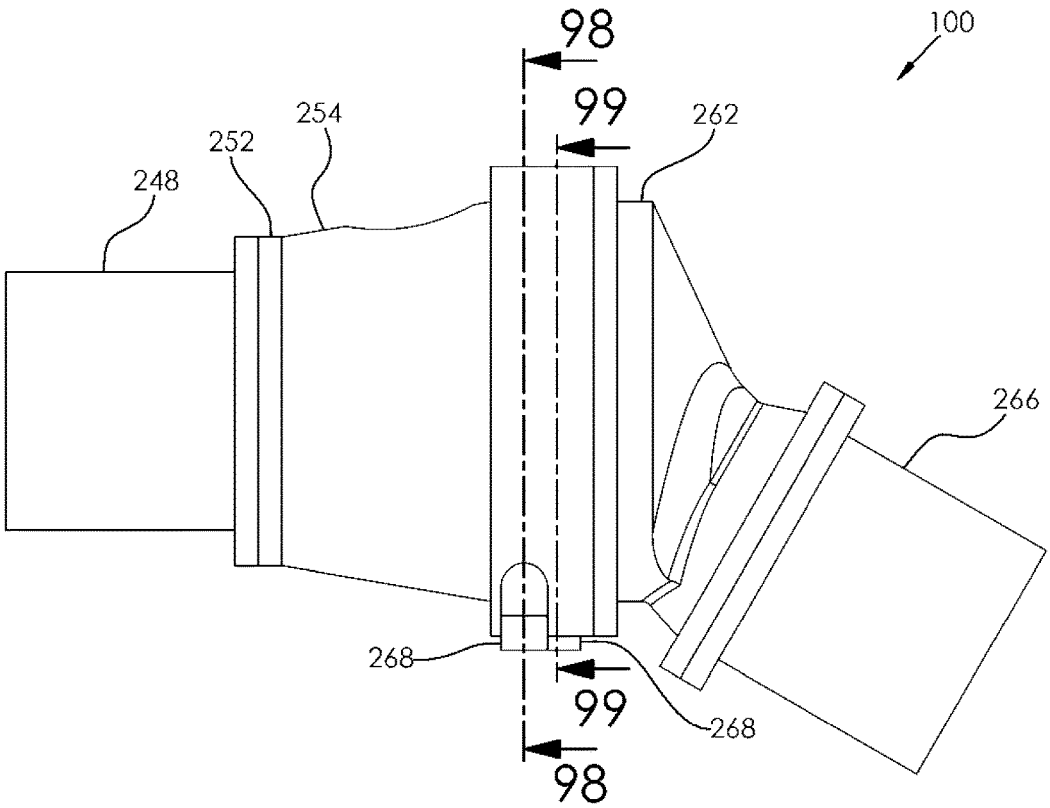
FIG. 97 is a side view of the same example of the disclosed Rotary Positive Displacement Device seen in FIG. 89.
Figure 98:
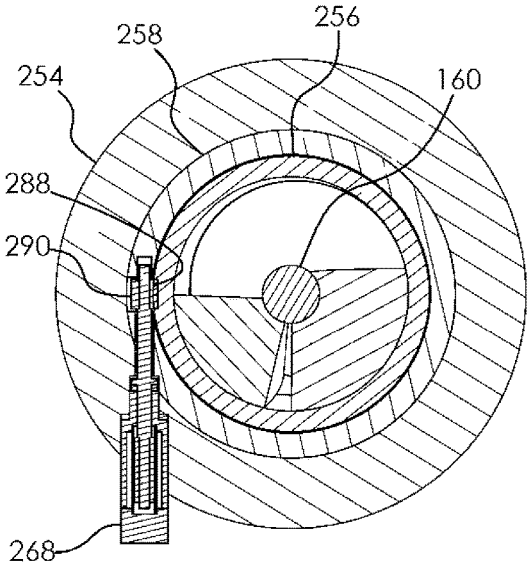
FIG. 98 is a cutaway view taken along section line 98-98 of FIG. 97, including the low pressure gate and actuation assembly.
Figure 99:
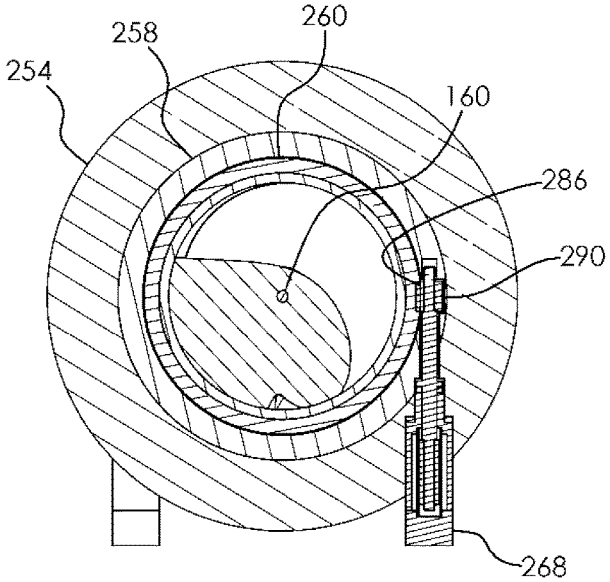
FIG. 99 is a cutaway view taken along section line 99-99 of FIG. 97, including the high pressure gate and actuation assembly.
Figure 100:
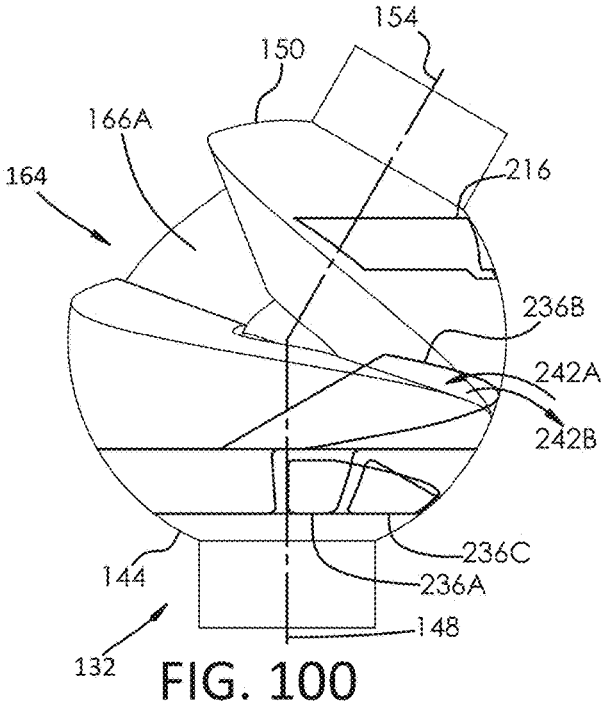
FIG. 100 is a side view of the components seen in FIG. 85, with rotors in a 142.5° rotational position and including the same example of high/low pressure openings illustrated in FIG. 85.

A side view of the Rotary Positive Displacement Device 100 may be seen in FIG. 97 with section 98 seen in FIG. 98 and section 99 seen in FIG. 99. Looking to FIGS. 97-99, the Rotary Positive Displacement Device 100 may provide precise position control of, in one example, relatively slow moving gates 256/260 with worm wheels 286/288 while optimally reducing the size and cost of the gate actuator assemblies 268 with respective worm gears 290. The low resistance to movement of the well load-balanced gates 256/260 and self-locking capabilities of the worm gears 290 may significantly reduce parasitic energy losses, especially over long periods of time. It may often be challenging for other types of devices to accommodate the space required for such a self-locking actuation strategy.

As an example, a remote power application was disclosed where the upstream/downstream pressures that natural gas utility companies may often have at their remote sites may vary substantially from season to season. While more frequent adjustments are expected than a seasonal time scale, this example does serve the purpose of demonstrating that systems that continuously re-adjust are expected to waste a lot more energy. In one example, continuously adjusting systems may require more than one adjustment every minute even if there were no notable changes in gas composition and/or upstream/downstream pressure and temperature for example. In the examples provided herein, electrical actuation is discussed, but it is to be understood that other forms of actuation, including using hydraulics or gases are known in the art and are applicable. It should also be noted that since the Rotary Positive Displacement Device 100 does not require any pressure-activated valves, this helps to facilitate the wide capabilities, but also may make it more robust should the operational strategy include intentionally opening a chamber early or late. Such an operational strategy may reduce the operational life of pressure-actuated valves, for example in reciprocating compressors.

Looking back to the example provided for natural gas utility companies that may wish to have 200 W of power at remote sites for remote monitoring, small reductions in the efficiency of the Rotary Positive Displacement Device 100 may not be concerning provided that only a relatively small amount of flow is still diverted to the expander. In this example, if the gates 256/260 were positioned accordingly for upstream/downstream pressures of 900 psig and 100 psig, respectively and the downstream pressure were to drop to 60 psig, this may not influence the power output significantly enough to cause concern. That is, the position of the gates 256/260 may correspond to a particular volumetric flow rate and pressure ratio while sealed. The notable difference in operation is that a given chamber may be closer to 100 psig than 60 psig when it becomes in fluid communication with the downstream piping. Essentially, a certain amount of potential energy in the gas was wasted. In other words, 200 W of power can be produced with less volumetric flow rate of the gas if the pressure ratio is higher, but to do this both gates 256/260 may need to be repositioned. If a Variable Frequency Drive (VFD) were employed or a multi-speed transmission with an engine, this rotational speed is another variable that may be adjusted accordingly.

Input/Output Drivers and General Layout

Figure 92:
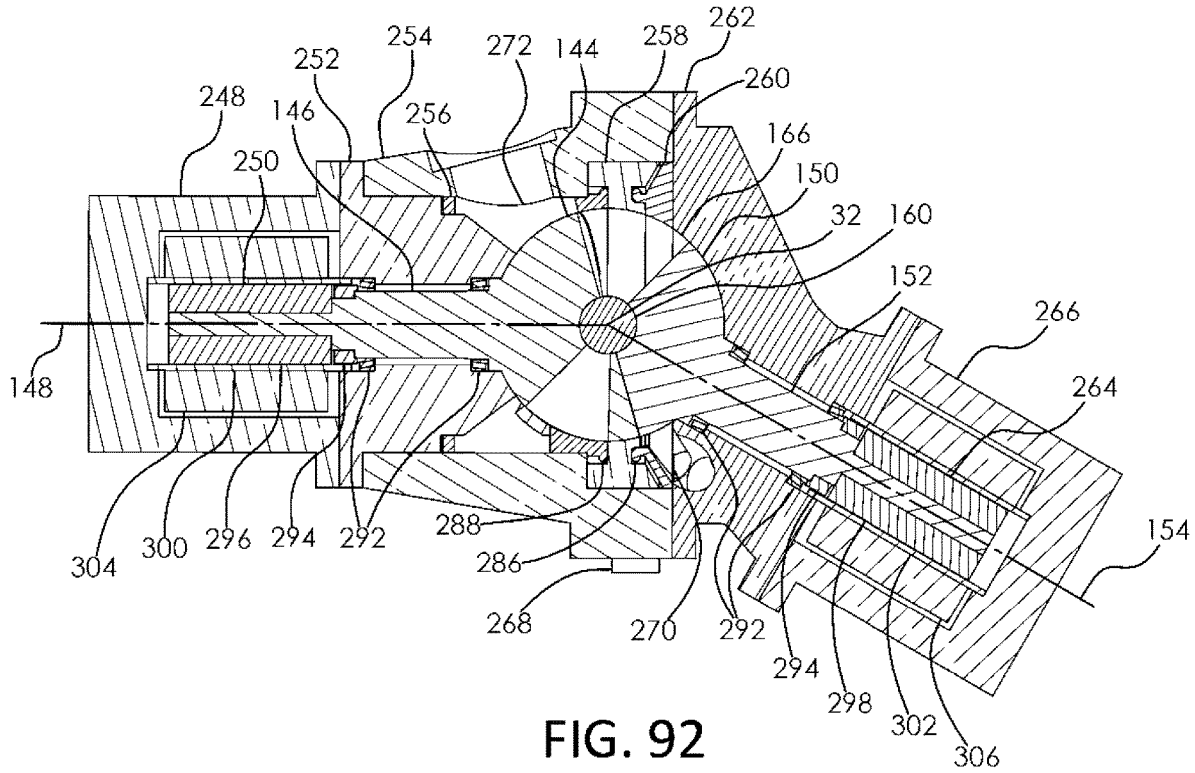
FIG. 92 is a cutaway view taken along section line 92-92 of FIG. 91.

In the example provided in FIG. 92, first/second motor assemblies 248/266 may be seen as part of the Rotary Positive Displacement Device 100. Including two electrical motors/generators in this example may provide a plurality of detailed configuration options. For example, both motors/generators could have substantially equivalent rated speeds, with an equivalent number of poles. As chamber pressures act to rotate rotor shafts 146/152, this torque is expected to be reacted by both first/second motor assemblies 248/266. It is to be understood that the second motor assembly 266 is optional. In the absence of the second motor assembly 266 and any kind of U-joint or gear arrangement to transfer torque between rotors 144/150, the chamber pressures that act on the second rotor 150 are expected to result in a torque that is transferred directly to the surfaces of the immediately adjacent first rotor 144. In scenarios where the torque transfer is relatively high, for example resulting in high Hertzian contact stresses, and/or there is a significant amount of solid entrainment in the fluid, surfaces may prematurely wear and/or fail. A gear arrangement or U-joint may transfer torque in a controlled and typically lubricated environment with little to no contamination of the working fluid. This method, as well as using two motor assemblies 248/266, may significantly or completely reduce torque transfer at the chambers 166 where the working fluid is present, which may significantly increase the lifespan of components in some scenarios. In scenarios where the torque transfer is low, for example resulting in relatively low Hertzian contact stresses, and/or where the working fluid is relatively free of significantly sized solid debris, it may be desirable to either forgo the second motor assembly 266 or configure the second motor assembly 266 with a differing number of poles than the first motor assembly 248. It will be appreciated that the number of poles in a motor influence the motor's rated rotational speed and that many types of motors are known in the art. A Variable Frequency Drive (VFD) is capable of allowing a wide range of motor/generator operational speeds, but, in some scenarios, may significantly increase overall costs even compared to including two motors. In one example, a VFD may be around an order of magnitude more expensive than a motor. A VFD implemented with a motor will typically reduce possible power output below the maximum rated speed, because unlike a transmission, there is no expected increase in torque output. Power is linearly proportional to the product of rotational speed and torque, and torque is proportional to the pressures acting on areas of the rotor faces. Since the Rotary Positive Displacement Device 100 may be capable of a wide range of internal volumetric throughput adjustment, with a-much of that being operated in an efficient manner, it may be most cost effective to configure the first/second motor assemblies 248/266 to have different rated speeds. In one example, the first motor assembly 248 may be a 200 W rated motor that has 2 poles and a speed rating of approximately 3600 RPM, while the second motor assembly 266 may be a 200 W rated motor that has 8 poles and a speed rating of approximately 900 RPM. In this example, a shaft rotational speed of either approximately 900 RPM or either approximately 3600 RPM may be maintained to produce, for example, around 200 W. If it is also desirable to reduce torque transfer between Rotors 144/150, then it is to be understood that the first motor assembly 248 and second motor assembly 266 may each be partitioned to contain two or more motors with differing rated speeds. As a simple example, the first motor assembly 248 may have a 100 W 2-pole motor and 100 W 8-pole motor and the second motor assembly 266 may also have a 100 W 2-pole motor and 100 W 8-pole motor to achieve some load sharing. If the pressure-induced loads acting to apply torque on the first rotor 144 are expected to be larger than the pressure-induced loads acting to apply torque on the second rotor 150, then it may be desirable to increase the size(s) of the motor(s) in the first motor assembly 248 accordingly with respect to the motor(s) in the second motor assembly 266. In this scenario, it may be desirable to add mass to the smaller rotating assembly, which in this example is the rotating components of the second motor assembly 266 and rotating components of the second rotor 150, such that this second side will have substantially the same rotational inertia as the rotating components on the first side. By matching the rotational inertia, undesirable torque transfer between rotors 144/150 may be minimized when rotating components are accelerated or decelerated, for example during startup and shutdown.

It should however be noted that when the working fluid contains a fuel and/or combustible gas, the use of electrical motors/generators may require hazardous certification approval(s) and design considerations to ensure that the ambient air is not likely to be mixed with the working fluid and that any resulting explosion may be contained in the housing of the equipment. While the temperatures may not typically be high enough to facilitate auto-ignition, the electrical motors/generators are one potential ignition source. Looking to FIG. 92, further details are provided to show how the Rotary Positive Displacement Device 100 may address these concerns in an explosion proof motor/generator example. First/second rotor shafts 146/152 may be supported by respective bearings 292 with retaining nuts 294 and first/second motor rotors 296/298. In one example, the first/second motor rotors 296/298 may have internal permanent magnets that are not exposed to the working fluid; for example, they may be hermetically sealed to mitigate potential corrosion etc. The first/second motor sleeves 300/302 may help to maintain a seal between the working fluid, for example at the inside diameter, and the ambient air which may be expected at the outside diameter where the first/second motor stators 304/306 may be present. Magnetic forces acting radially between first/second motor rotors 296/298 and first/second motor stators 304/306 can be significant enough to justify adding one or more bearings or positioning bearings 292 accordingly to prevent contact between the first/second motor rotors 296/298 and first/second motor sleeves 300/302. It is to be understood that these bearings (not shown) and/or bearings 292 may be lubricated and/or cooled accordingly to pro-long expected life. First/second motor rotors 296/298 may be comprised of relatively lower cost magnetic materials without experiencing significant undesirable de-magnetization if a lower maximum temperature limit is maintained. First/second motor stators 304/306 may also have cost savings and higher expected reliability, if a lower maximum temperature limit is maintained. Furthermore, in one example involving expander mode, it may be desirable to increase the temperature of the working fluid at the low pressure opening 272 before introducing it into the downstream piping, for example to mitigate the risks of any blockage caused by moisture freezing. Therefore, in one example, it may be desirable to route the working fluid at the low pressure opening 272 directly past the bearings 292 to provide some amount of lubrication, while cooling the bearings 292 and adjacent motor components and simultaneously heating the working fluid. In another example, the working fluid composition may contain a large amount of abrasive solids, for example sand, that could reduce the expected lifespan of the components accordingly and it may be preferred to reduce direct contact of the working fluid with the bearings 292. Alternatively, the bearings 292 could be sealed and/or have seal(s), as understood by persons skilled in the art, to reduce solid contamination and the thermal connection between the working fluid at the low pressure opening 272 and the bearings 292 could be as a result of a plurality of flow passageways in the first/second motor assembly 248/266 and/or the first inner housing 252 and second housing 262. It will be appreciated that this thermal communication could also be increased by a tubing coil helically wound around the first/second motor assembly 248/266 that carries the working fluid from the low pressure opening 272. This may be a preferred method inside of a heated building, that may also absorb heat energy from a relatively warmer ambient environment and could be combined with methods known in the art to increase heat transfer accordingly. In one example, the inside of a heated building is maintained around 20° C. year-round.

Instead of using electrical motors, it is to be understood that other types of drivers may be used. For example, it will be appreciated that magnetic couplings may also be used to facilitate other types of off-the-shelf input/output drivers while maintaining a hermitic or semi-hermitic seal of the Rotary Positive Displacement Device 100, if desired. Alternatively, dynamic seals, for example mechanical seals, may be used. In either sense, since the Rotary Positive Displacement Device 100 is expected to be capable of varying compression/expansion scenarios, one possible example is using a Rotary Positive Displacement Device 100 to drive another Rotary Positive Displacement Device 100. It will be appreciated that compressors and expanders sharing a common shaft in turbine applications is known, and therefore no further illustrations need to be provided in this regard as it will be appreciated that first/second motor assemblies 248/266 may be modified and/or removed as required to facilitate this example.

It is to be understood that the high pressure port 270 may form a perimeter of a fluid pathway that may be fluidly connected to piping and/or tubing.

It is also be understood that the low pressure port 272 may form a perimeter of a fluid pathway that may be fluidly connected to piping and/or tubing.

It is also to be understood that seals, fasteners and pins may be added to the Rotary Positive Displacement Device 100 as required. In the example provided in FIGS. 91-92, the Rotary Positive Displacement Device 100 fasteners may be used to substantially rigidly connect the first motor assembly 248, first inner housing 252, first outer housing 254, central inner housing 258, second housing 262 and second motor assembly 266. Also, the inner ball 160 and first motor rotor 296 may be fastened to the first rotor 144. In another example, the first inner housing 252 and first outer housing 254 may be combined as a single component. In another example, especially at a lower alpha angle than the example seen in FIG. 92, chambers may be defined by the volume between the first/second rotors 144/150 and inner ball 160, with outer components, including the low/high pressure gates 256/260 and/or the central inner housing 258, but not requiring any frusto-spherical surfaces on the first inner housing 252 or on the second housing 260. In yet another example, both the low/high pressure gates 256/260 may be omitted to yield a single volume ratio, which could be a practical simplification for pumping and/or liquid motor applications with a substantially incompressible working fluid. A detailed manufacturing and assembly strategy may be formulated to aid in such decisions, for example to reduce costs.

It is to be understood that a working fluid may comprise of a combination of one or more gases and/or one or more liquids. While solid entrainment may often not be desirable, in part because it may lead to accelerated wear, it is sometimes a reality. For example, even pipeline grade natural gas contains some amount of solids. As another example, air compression applications often still contain residual dust in the air. The amount of solids in the gas may be meaningful in some scenarios. For example, isothermal or near isothermal compression processes may require significantly less work in comparison to isentropic compression processes. It should also be understood that the higher heat capacity of liquids and/or solids may desirably reduce the work required to compress the gas while also reducing the discharge temperature.

It should be understood that even before any attempt at optimization, the Rotary Positive Displacement Device 100 may have substantial competitive advantages over currently employed technologies. Chamber volumes are cubically related to the (frusto-spherical) rotor diameter in contrast to the chamber volumes of a screw profile being related to the screw rotor diameter squared and linearly related to the length. This may allow for much smaller space usage and therefore a higher power density when comparing equivalent operational speeds. The high ratio of volume to linear sealing perimeter may substantially minimize volumetric inefficiencies from internal leakage, especially if the gaps between the rotor outer diameter and housing inner diameter can also be minimized. The long screw rotors are supported by bearings at the ends of the shafts. This mechanical limitation of screw rotors is not well suited to withstanding relatively larger pressure-induced loads expected from higher pressure ratings. Over time, including during upset conditions, high loading conditions, for example pressures exceeding 350 psig, may cause the screw rotors to separate and undesirably contact adjacent (stationary) housing components and/or cause unacceptable high internal leakages. While some individuals may compare aspects of the Rotary Positive Displacement Device 100 core technology to the prior art of a screw rotor, it is clear that there are considerable differences. Looking to FIGS. 91-92, it may be seen how bearings 292 may be positioned in close proximity to chambers 166, which the Applicant anticipates will allow the Rotary Positive Displacement Device 100 to have significantly higher pressure ratings as compared to screw rotor equipment, which is understood to have relatively limited design capabilities, requiring bearings to be placed relatively further from the chambers where pressure-induced loads may act. The maximum deflection of rotor surfaces may be substantially cubically related to the distance between the bearings and the radial component of the pressure-induced load, acting in a direction perpendicular to the respective first/second rotor shaft 146/152.

Comparisons are made to screw compressors since they are a rotary positive displacement technology with widespread global dominance that are well understood by compressor experts that have managed to displace a substantial amount of the reciprocating compressor market that was previously dominant below 350 psig. Screw rotor equipment has been successfully demonstrated to operate in reversible compressor/expander modes and the limited internal adjustability capabilities and lack of valves have been found to be quite attractive. Advantageously, the novel Rotary Positive Displacement Device 100 disclosed herein is expected to have capabilities that may address a wide range of markets and fulfill the requirements for a wide range of different applications. Discoveries disclosed herein may represent a step-change improvement over the prior art and lead to a new class of Rotary Positive Displacement Devices 100 being adopted in widespread commercial applications.

What is claimed is:

1. A rotary positive displacement device, comprising:

a housing having a low pressure port and a high pressure port;

a first rotor having a frusto-spherical outer surface, an axial surface, a first rotor shaft and a first rotational axis passing through the first rotor shaft, wherein the axial surface comprises at least one teardrop surface and at least one involute surface, the at least one teardrop surface and at least one involute surface together defining at least one lobe and a corresponding valley;

a second rotor having a frusto-spherical outer surface, an axial surface, a second rotor shaft and a second rotational axis passing through the second rotor shaft, the axial surface comprises at least one teardrop surface and at least one involute surface, the at least one teardrop surface and at least one involute surface together defining at least one lobe and a corresponding valley, the second rotational axis intersecting with the first rotational axis;

a high pressure opening extending between the first and second rotors and the high pressure port of the housing;

a low pressure opening extending between the first and second rotors and the low pressure port of the housing, wherein the low pressure opening is configured to selectively communicate with one or more chambers of at least two chambers;

wherein the second rotor is configured to intermesh with the first rotor such that the at least two chambers are separated by the axial surfaces of the first and second rotors, each chamber of the at least two chambers having a variable volume as the first and second rotors rotate about their respective rotational axes; and wherein a lobe tip of each rotor is in contact with, so as to form a seal against, the corresponding teardrop surface of the other rotor; and wherein the involute surface of each rotor is in contact with, so as to form a seal against, the corresponding involute surface of the other rotor; and wherein the high pressure opening comprises a lower edge, the lower edge positioned along an outer diameter of the frusto-spherical outer surface of the second rotor, wherein the lower edge is positioned between the second rotor shaft and the at least one valley of the first rotor.

2. The device of claim 1 wherein each involute surface of the first and second rotors includes an involute curve at the outer diameter of the first and second rotors, the involute curve having a distal point adjacent to the corresponding lobe tip, the distal point having a distance measured between the distal point and the corresponding shaft of the rotor, wherein the said measured distance is greater than a distance measured between any other point on the involute curve and the corresponding shaft, and wherein each involute curve has a substantially horizontal slope at the distal point, the substantially horizontal slope being tangent to the involute curve and the substantially horizontal slope lying in a plane that is substantially perpendicular to the corresponding rotational axis of the first and second rotors.

3. The device of claim 1, wherein the lobe tip of each lobe of each of the first and second rotors is a rounded lobe tip, the rounded lobe tip comprising a spline curve.

4. The device of claim 3, wherein the spline curve of each lobe tip varies at each diameter of each rotor of the first and second rotors.

5. The device of claim 1, wherein the at least one involute surface of each axial surface of each rotor includes a radial recess extending along the at least one involute surface, the radial recess extending to the outer diameter of the rotor.

6. The device of claim 1 wherein the high pressure opening is formed in the housing of the device.

7. The device of claim 1 wherein the high pressure opening comprises an aperture in a repositionable high pressure gate, the high pressure gate sandwiched between the intermeshed first and second rotors and the housing, wherein the aperture of the high pressure gate may be selectively circumferentially positioned relative to the position of the at least two chambers formed between the intermeshed first and second rotors.

8. The device of claim 1 wherein the low pressure opening is formed in the housing of the device.

9. The device of claim 1 wherein the low pressure opening comprises an aperture in a repositionable low pressure gate, the low pressure gate sandwiched between the intermeshed first and second rotors and the housing, wherein the aperture of the low pressure gate may be selectively circumferentially positioned relative to the position of the at least two chambers formed between the intermeshed first and second rotors.

10. The device of claim 9 wherein the low pressure gate comprises two or more low pressure apertures.

11. The device of claim 7 wherein the low pressure opening is an aperture in a repositionable low pressure gate and the low pressure gate is sandwiched between the intermeshed first and second rotors and the housing, wherein each aperture of the low pressure and high pressure gates may be independently and selectively circumferentially positioned relative to the position of the at least two chambers formed between the intermeshed first and second rotors.

12. The device of claim 11, wherein at least one of the high pressure gate and the low pressure gate are selectively circumferentially positionable via an actuator.

13. The device of claim 12, wherein the actuator drives a worm drive and wherein at least one of the high pressure gate and the low pressure gate comprises a worm wheel of the worm drive.

14. The device of claim 7, wherein the high pressure opening comprises the aperture in the repositionable high pressure gate and an abutting aperture in the housing, wherein the aperture in the repositionable high pressure gate comprises adjustable leading and trailing edges and the abutting aperture in the housing comprises stationary leading and trailing edges and the lower edge, and wherein the configuration of the high pressure opening may be changed by selectively positioning the aperture of the repositionable high pressure gate relative to the stationary abutting aperture in the housing.

15. The device of claim 9, wherein the low pressure gate is selectively circumferentially positioned so as to align the low pressure aperture with each chamber of the at least two chambers such that each chamber will pass the low pressure aperture and be sealed by the low pressure gate at a selected volumetric capacity of each chamber.

16. The device of claim 7, wherein the high pressure gate is selectively circumferentially positioned so as to align the high pressure aperture with each chamber of the at least two chambers such that each chamber will pass the high pressure aperture and the volume in each chamber of the at least two chambers will be maintained at a selected volume ratio.

17. The device of claim 11, wherein at least one of the high pressure gate and the low pressure gate is circumferentially repositioned so as to selectively form a seal between the at least two chambers formed between the intermeshed first and second rotors and the corresponding high pressure port or low pressure port.

18. The device of claim 1, wherein at least one of the first and second rotors is a driven rotor, wherein the shaft of the driven rotor is driven by a driver.

19. The device of claim 18, wherein the driver is selected from a group comprising: an electric motor, an electric motor controlled with a variable frequency drive (VFD), hydraulics, pneumatics, a second rotary positive displacement device of claim 1.

20. The device of claim 1 wherein the lower edge of the high pressure opening substantially lies in a plane that is substantially perpendicular to the first rotational axis.

21. The device of claim 1 wherein the lower edge of the high pressure opening is positioned substantially between the at least one lobe tip of the first rotor and the at least one valley of the second rotor.

22. The device of claim 7, wherein the low pressure opening is formed in the housing of the device.

23. The device of claim 14, wherein the low pressure opening is formed in the housing of the device.

* * * * *